US008671681B1

(12) United States Patent
Borner et al.

(10) Patent No.: US 8,671,681 B1
(45) Date of Patent: Mar. 18, 2014

(54) OPPOSED PISTON INTERNAL COMBUSTION ENGINE AND METHOD OF OPERATION THEREOF

(76) Inventors: Paul E Borner, Wingdale, NY (US); Matthew J Borner, Wingdale, NY (US)

( * ) Notice: Subject to any disclaimer, the term of this patent is extended or adjusted under 35 U.S.C. 154(b) by 465 days.

(21) Appl. No.: 13/111,995

(22) Filed: May 20, 2011

Related U.S. Application Data

(60) Provisional application No. 61/349,248, filed on May 28, 2010.

(51) Int. Cl.
*F02B 71/06* (2006.01)

(52) U.S. Cl.
USPC ..... 60/595

(58) Field of Classification Search
USPC ..... 60/595; 180/165, 242, 307, 308, 302, 180/305; 123/46 R, 495, 46 B
See application file for complete search history.

(56) References Cited

U.S. PATENT DOCUMENTS

| | | | | | |
|---|---|---|---|---|---|
| 2,246,701 | A | | 6/1941 | Steiner | |
| 2,452,194 | A | | 10/1948 | Huber | |
| 2,581,600 | A | * | 1/1952 | Pescara | 60/595 |
| 2,584,981 | A | * | 2/1952 | Bright | 126/46 |
| 2,872,778 | A | | 2/1959 | Dane | |
| 2,978,986 | A | * | 4/1961 | Carder et al. | 417/11 |
| 3,024,591 | A | | 3/1962 | Ehrat | |
| 3,072,315 | A | * | 1/1963 | Wachsmuth | 417/324 |
| 3,089,305 | A | | 5/1963 | Hobbs | |
| 3,119,230 | A | * | 1/1964 | Kosoff | 60/595 |
| 3,779,005 | A | * | 12/1973 | Sorensen | 60/617 |
| 4,085,711 | A | | 4/1978 | Braun | |
| 4,097,198 | A | | 6/1978 | Herron | |
| 4,227,587 | A | | 10/1980 | Carman | |
| 4,308,720 | A | | 1/1982 | Brandstadter | |
| 4,350,220 | A | | 9/1982 | Carman | |
| 4,402,182 | A | * | 9/1983 | Miller | 60/712 |
| 4,441,573 | A | | 4/1984 | Carman | |
| 4,803,960 | A | | 2/1989 | Köppen | |
| 5,167,292 | A | * | 12/1992 | Moiroux et al. | 180/165 |
| 5,464,331 | A | * | 11/1995 | Sawyer | 417/364 |
| 5,957,234 | A | * | 9/1999 | Manor | 180/302 |
| 6,293,231 | B1 | * | 9/2001 | Valentin | 123/46 R |

* cited by examiner

*Primary Examiner* — Thomas Denion
*Assistant Examiner* — Shafiq Mian
(74) *Attorney, Agent, or Firm* — UCONN IP Law Clinic; Robert S. Smith; Dmitry Zuev

(57) ABSTRACT

An internal combustion hydraulic engine for producing a supply of pressurized hydraulic fluid includes a frame, a pair of pivot pins, two levers, and combustion assemblies and hydraulic assemblies mechanically communicating with each other through the levers. Each of the assemblies includes a pair of opposed pistons engaged to the levers with a variable volume chamber between them, the piston faces being movable boundaries defining the variable volume chamber. In cyclic operation, a compressed fuel-air mixture in a first combustion chamber detonates, driving the combustion pistons apart. The pistons drive connecting rods, pivoting the lever arms, the lever arms, in turn drawing apart the pistons of a first hydraulic assembly, driving together the pistons of a second hydraulic assembly to produce pressurized hydraulic fluid, and driving together the combustion pistons of a second combustion assembly into which a fuel-air mixture has been introduced, compressing the mixture therein.

20 Claims, 38 Drawing Sheets

HYDRAULIC ENGINE

FIGURE 1. HYDRAULIC ENGINE
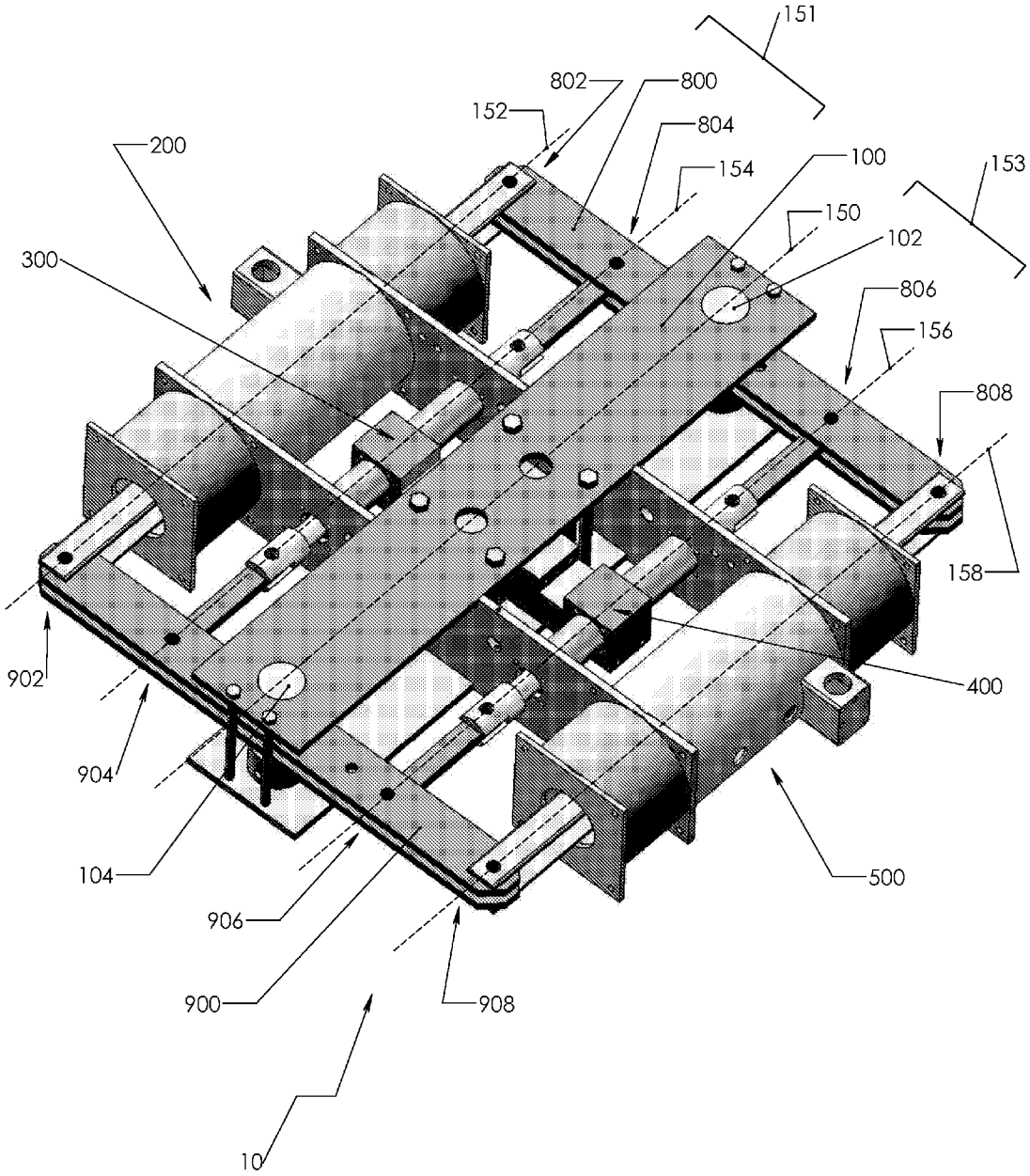

FIGURE 2. ENGINE FRAME
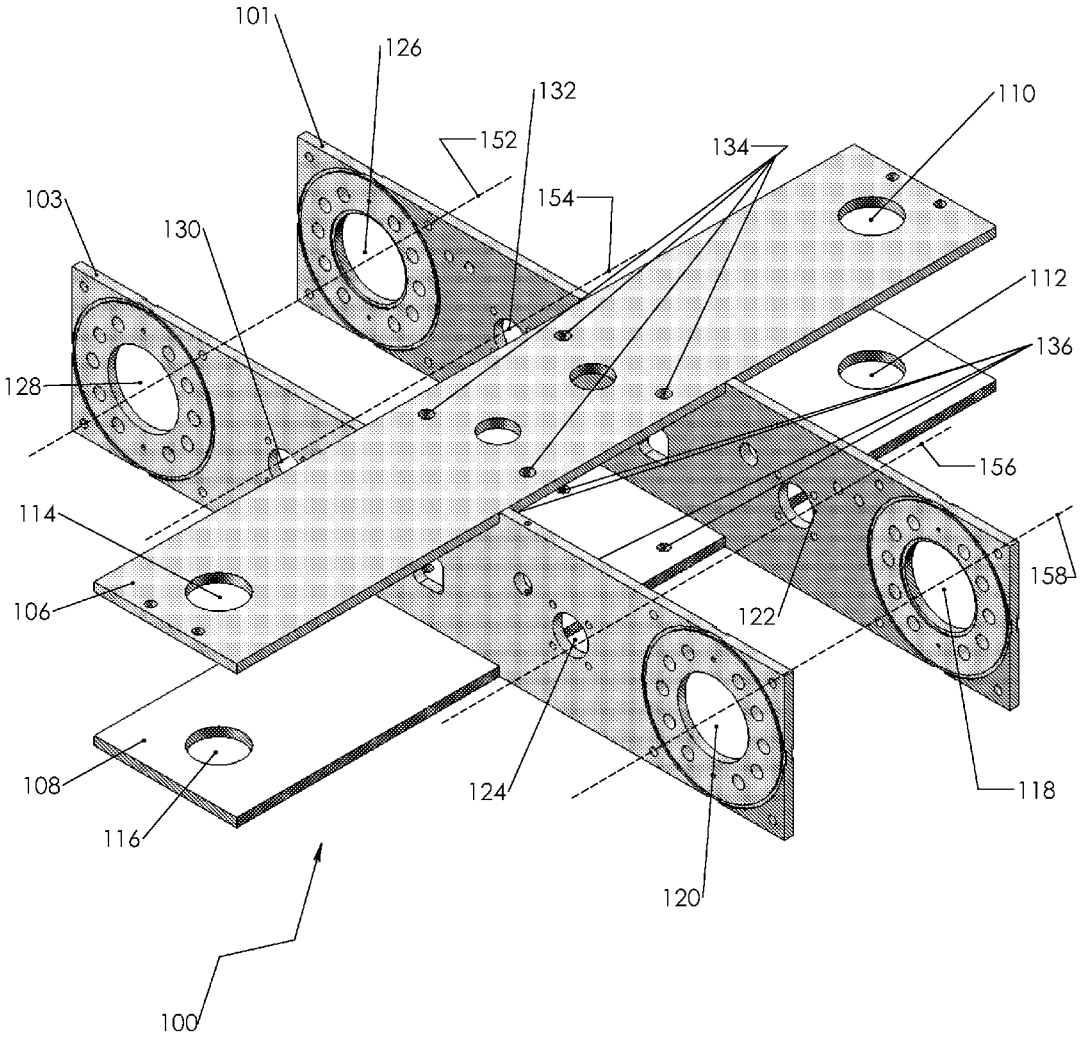

FIGURE 3. ENGINE LEVER ARM
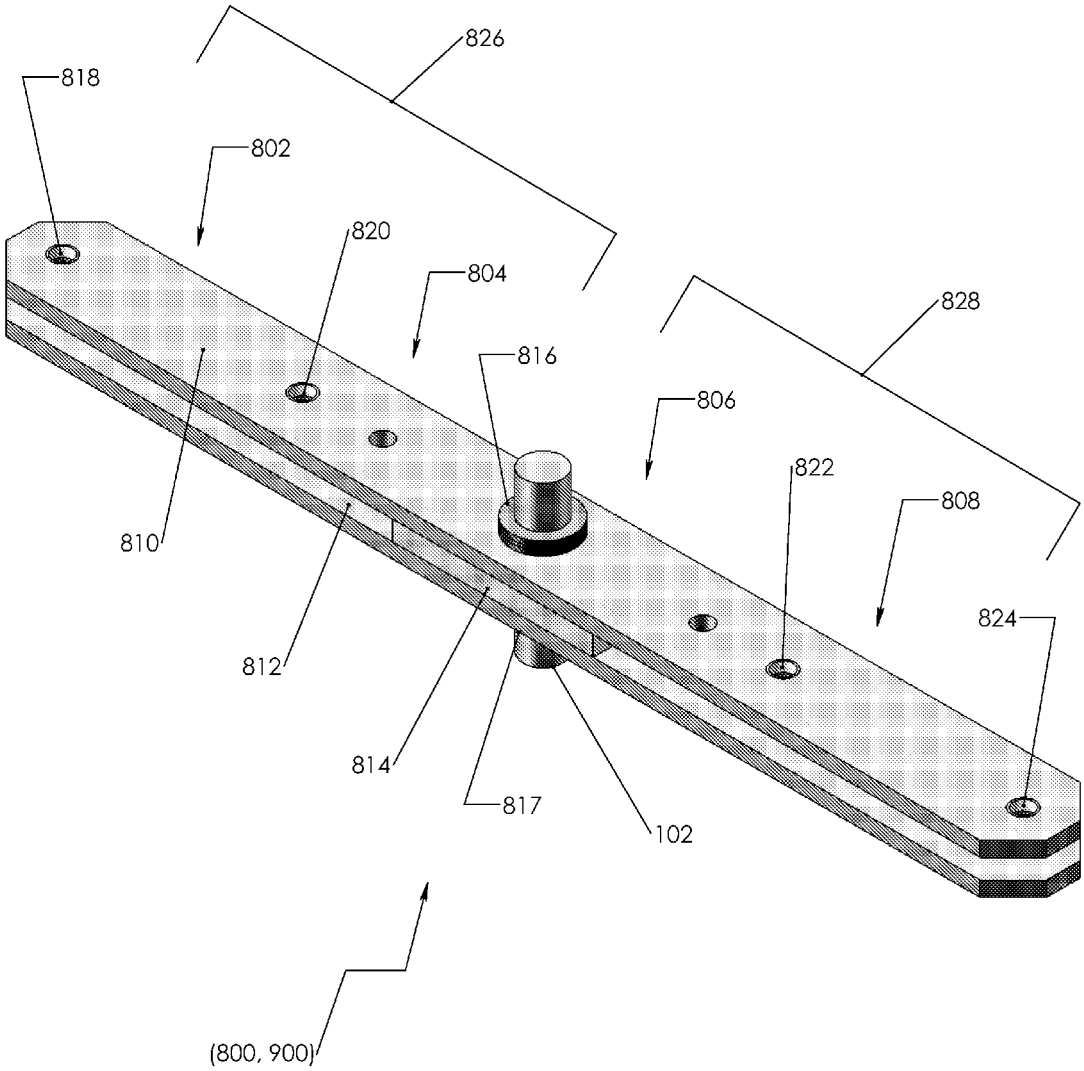

FIGURE 4. ENGINE HYDRAULIC ASSEMBLY
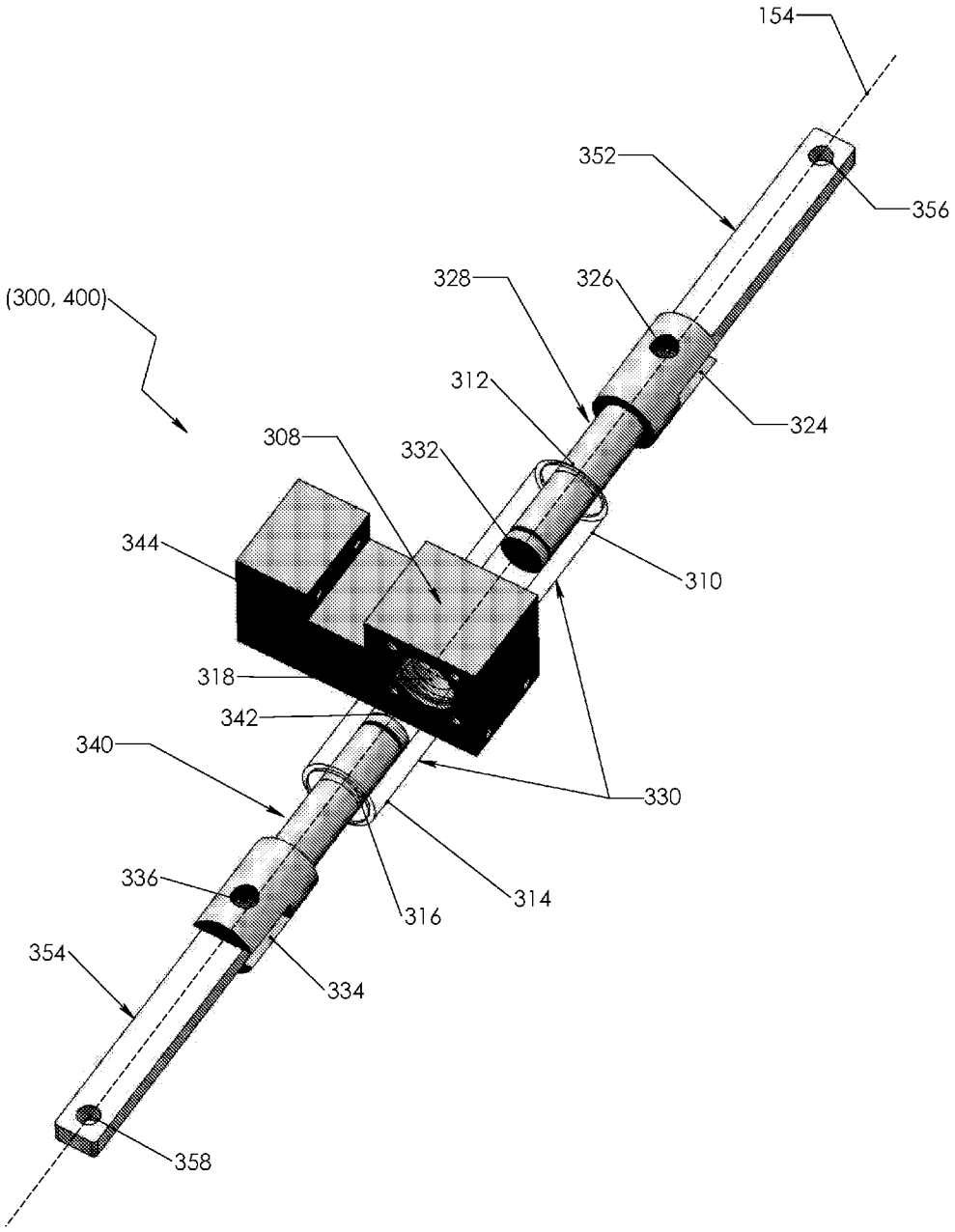

FIGURE 5. HYDRAULIC PISTON ASSEMBLY
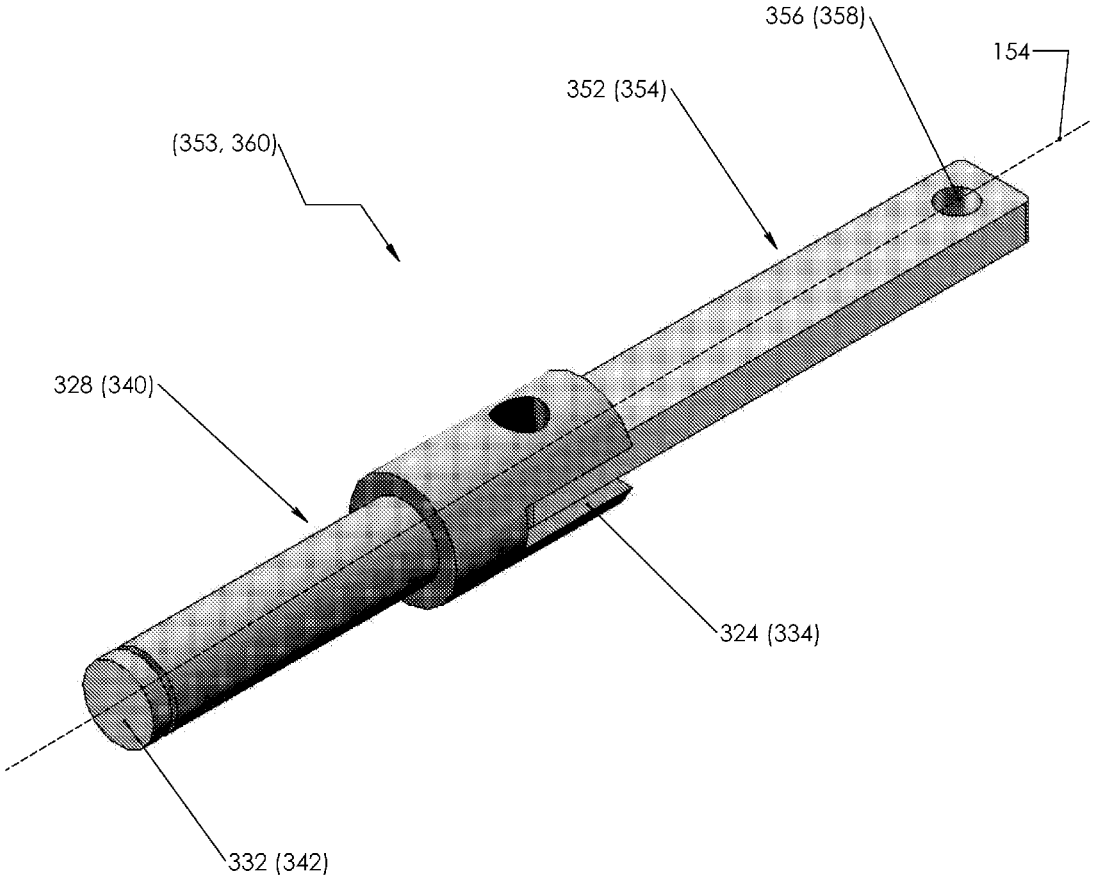

FIGURE 6. ENGINE COMBUSTION ASSEMBLY
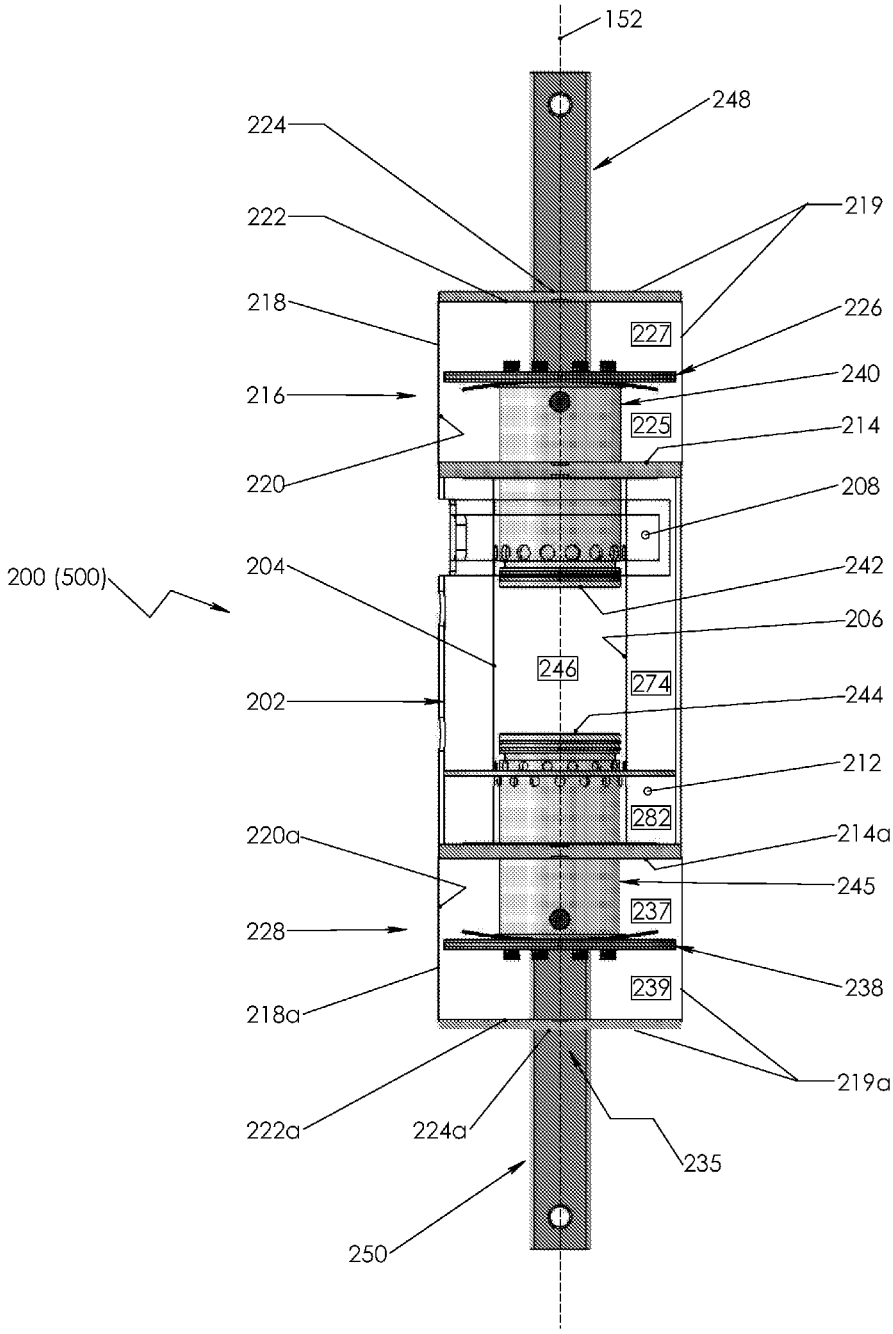

FIGURE 7. COMBUSTION PISTON ASSEMBLY
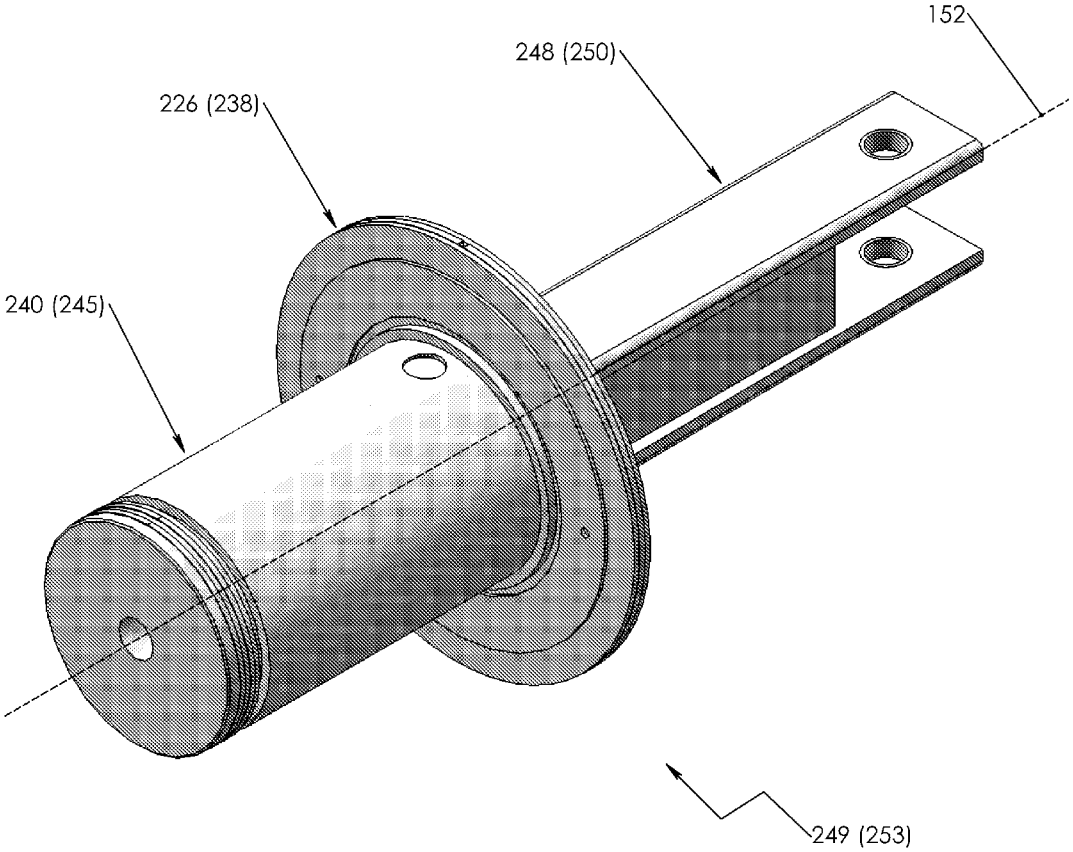

FIGURE 8A. VIEW OF ENGINE SEQUENTIALLY SHOWING ITS OPERATION
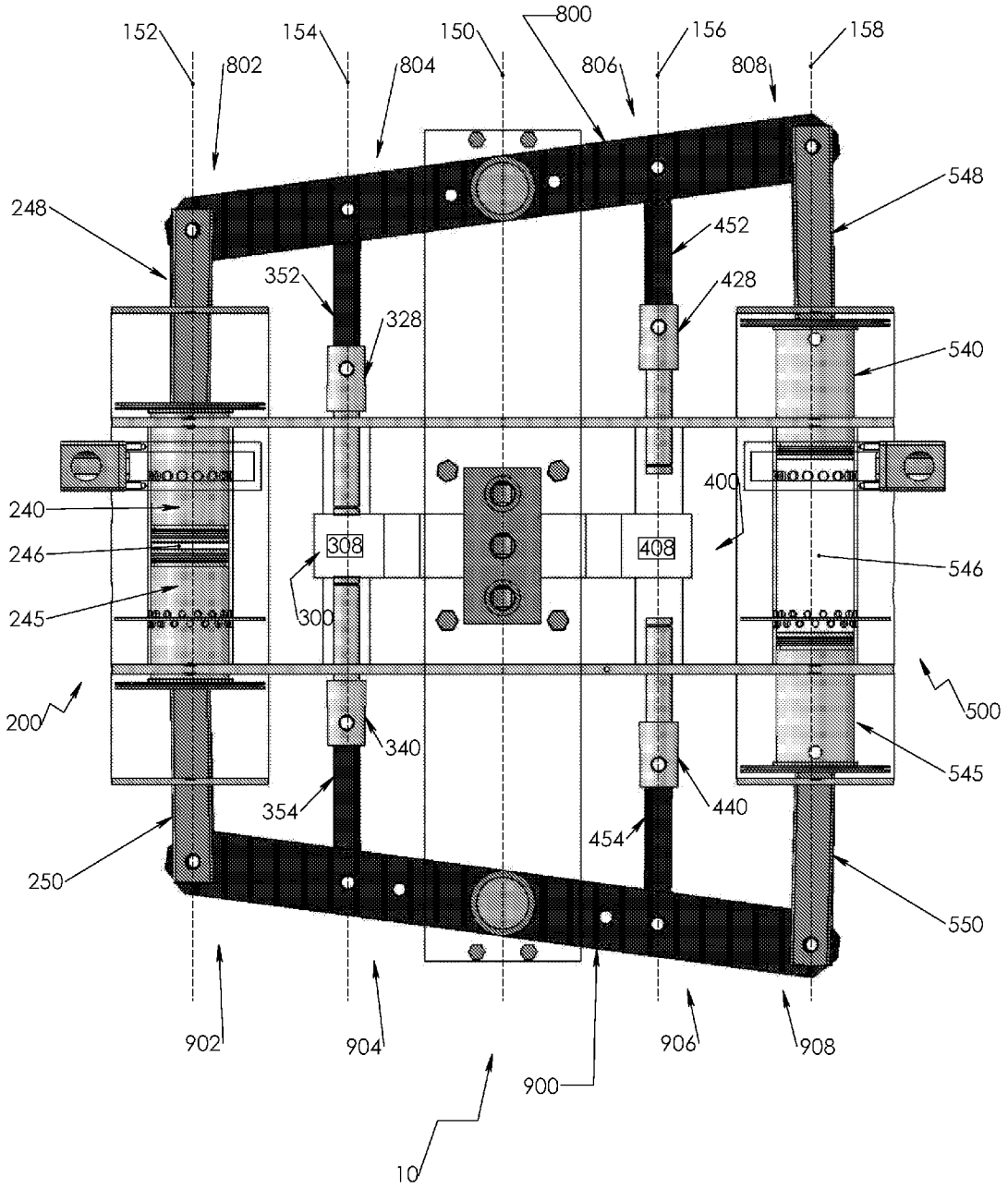

FIGURE 8B. VIEW OF ENGINE SEQUENTIALLY SHOWING ITS OPERATION
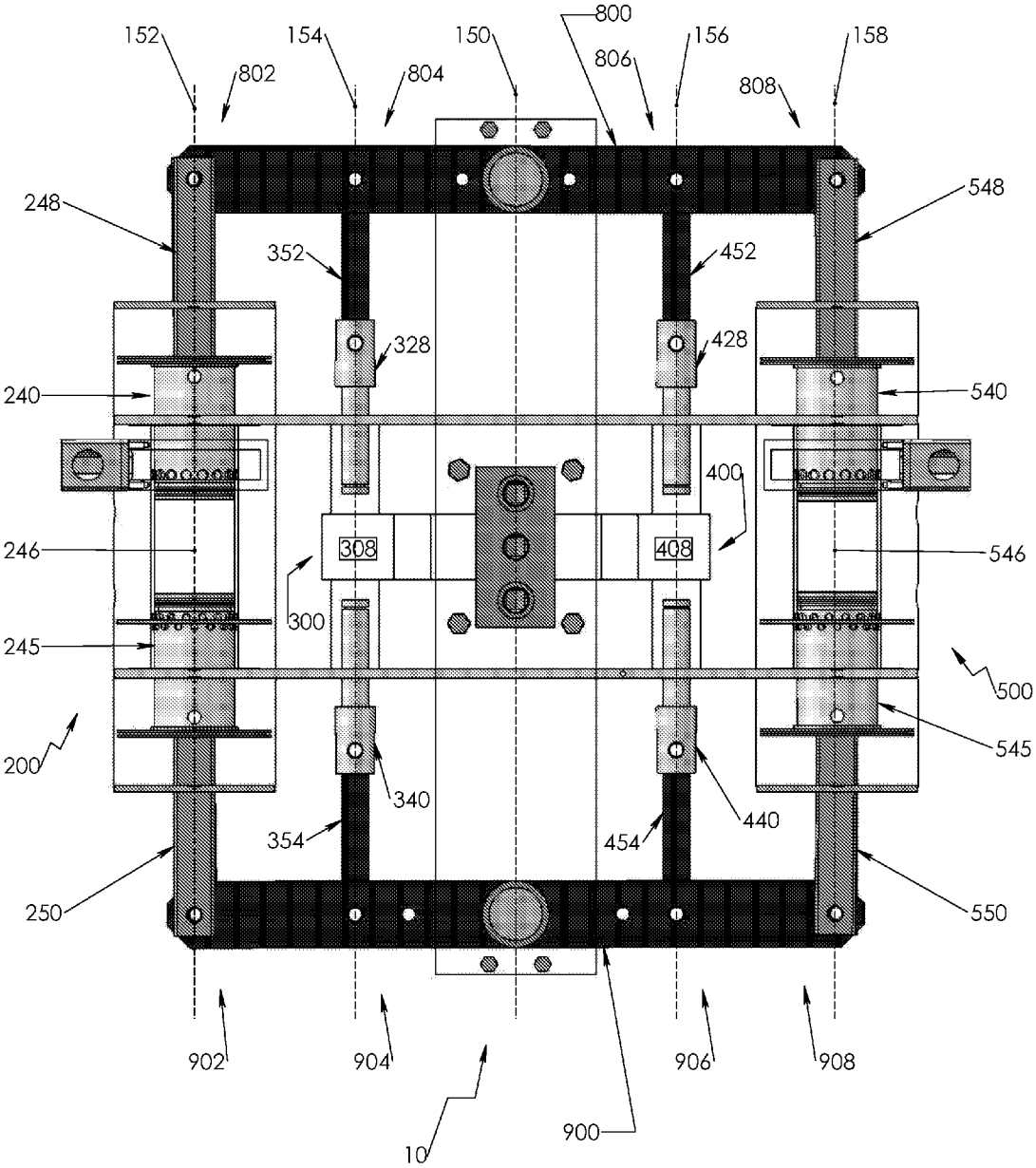

FIGURE 8C. VIEW OF ENGINE SEQUENTIALLY SHOWING ITS OPERATION
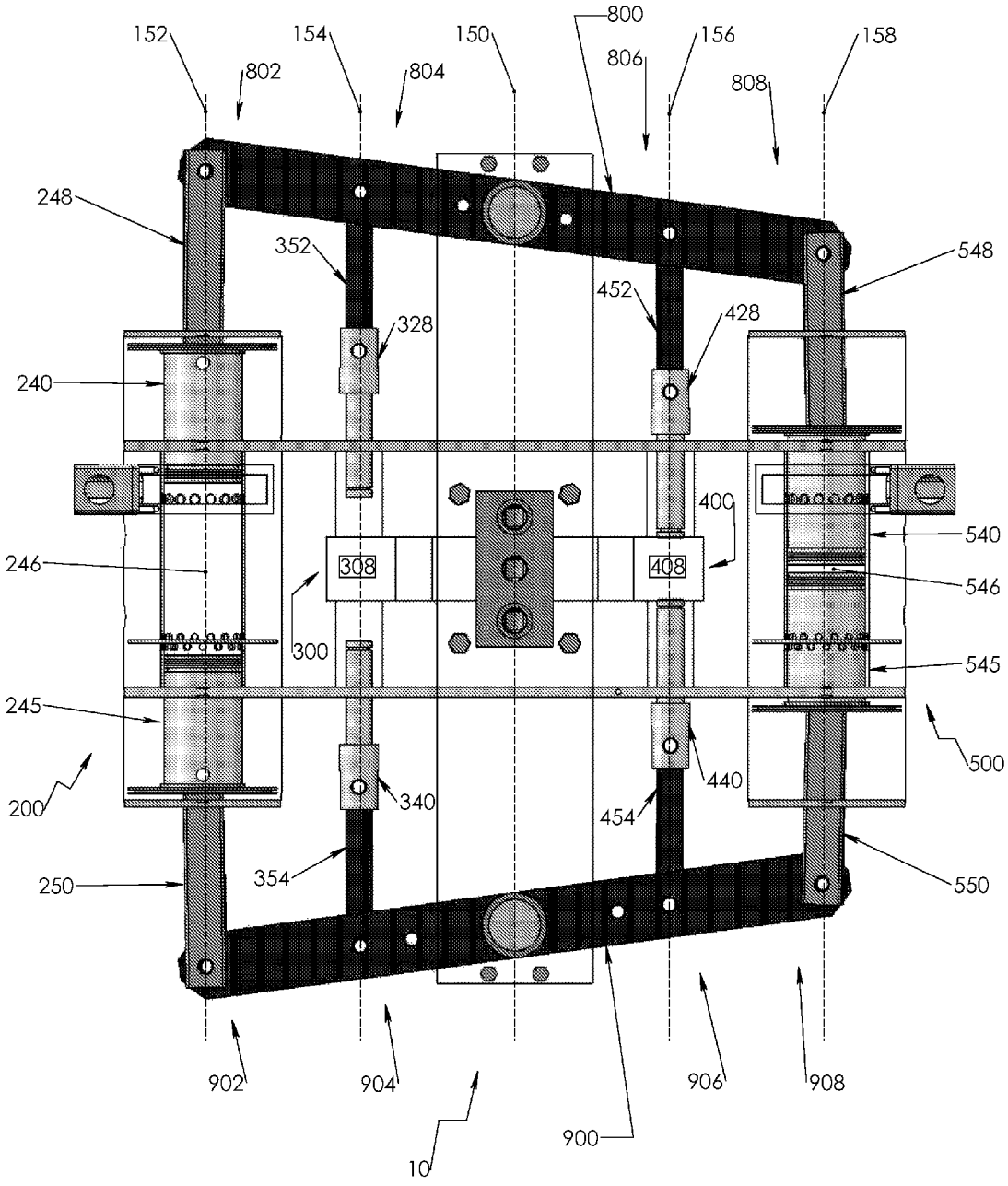

FIGURE 8D. DOUBLE SYNCHRONIZER
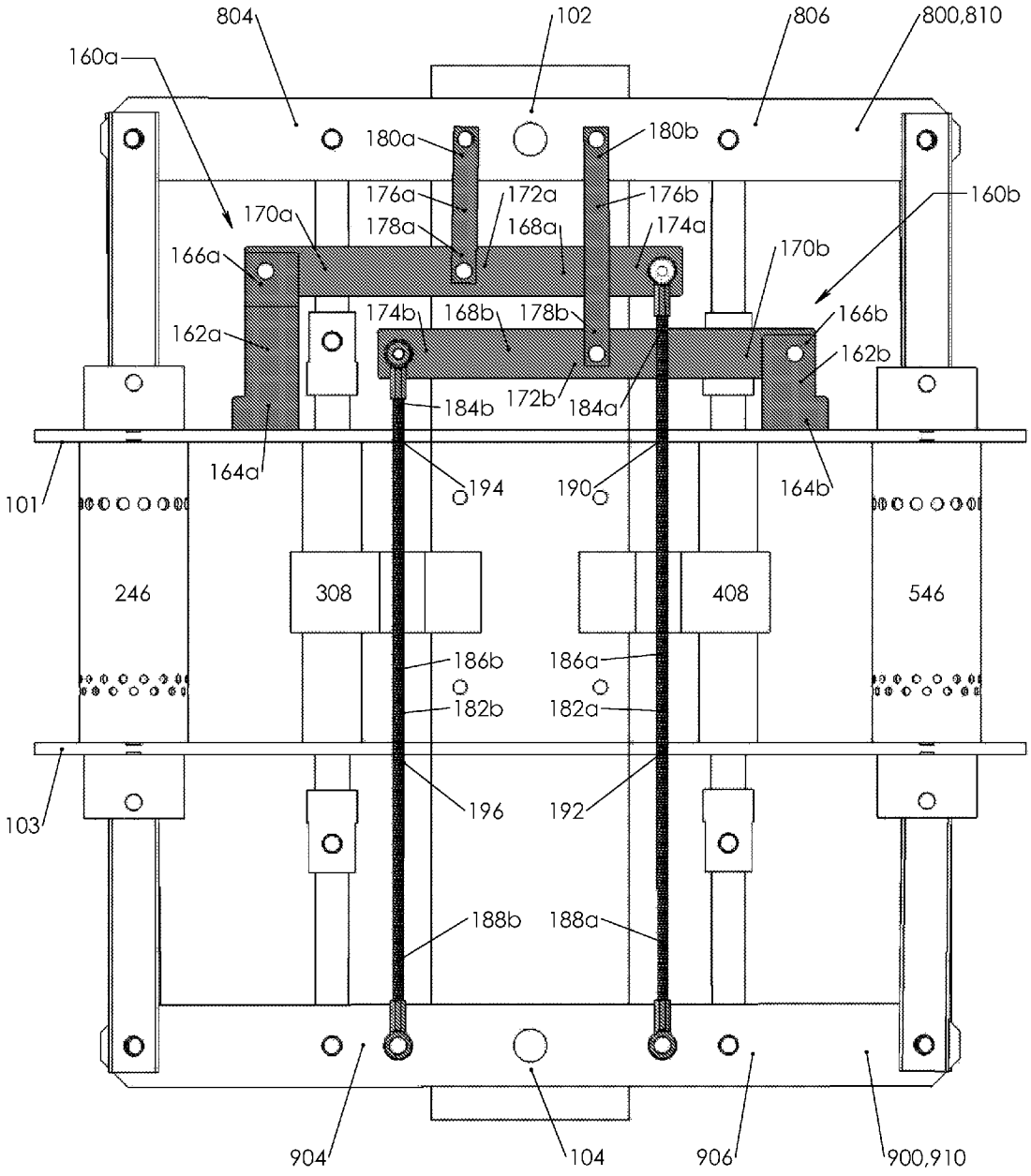

FIGURE 9A. SELECTIVE HYDRAULIC FLUID COMMUNICATION ASSEMBLY
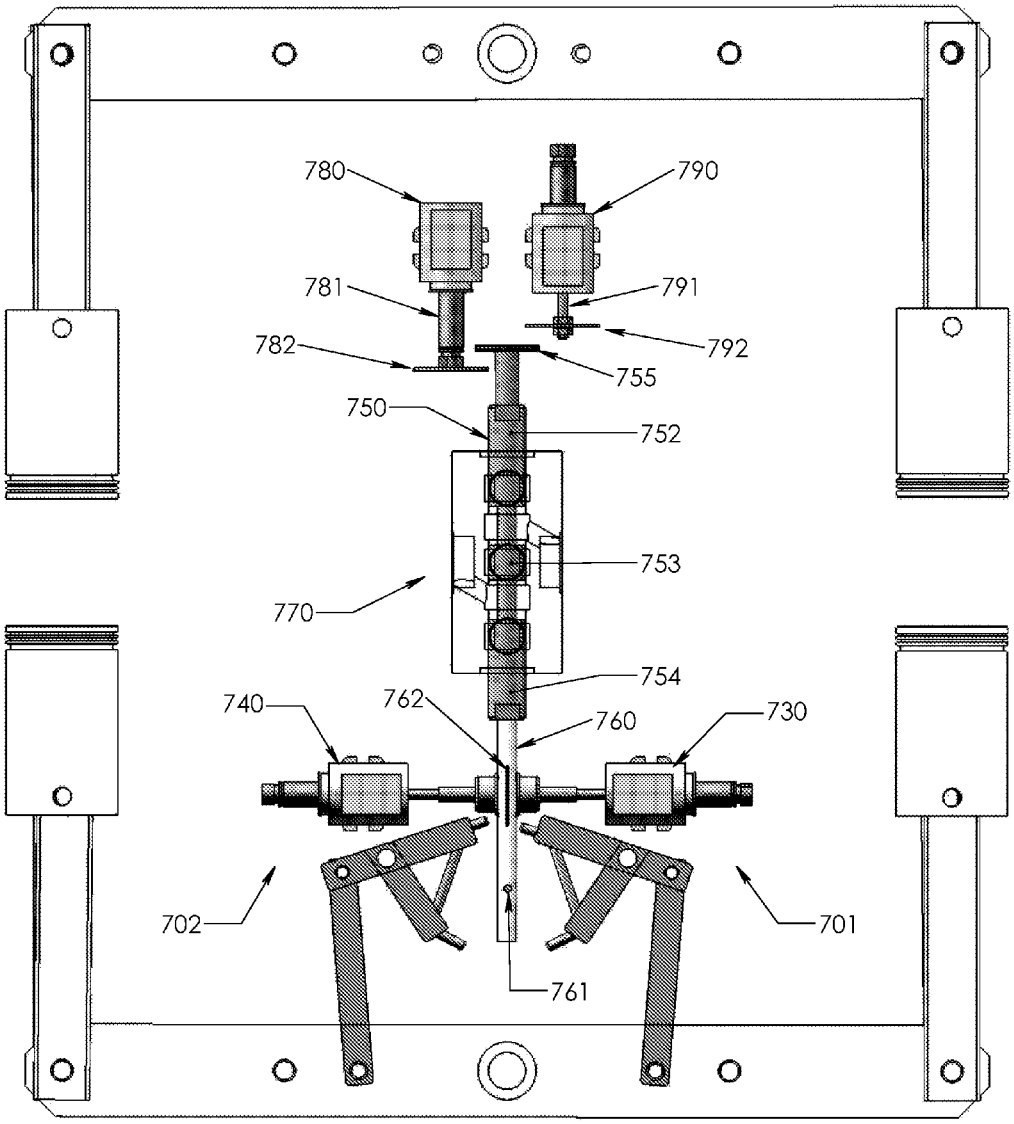

FIGURE 9B. SPOOL - TOP VIEW
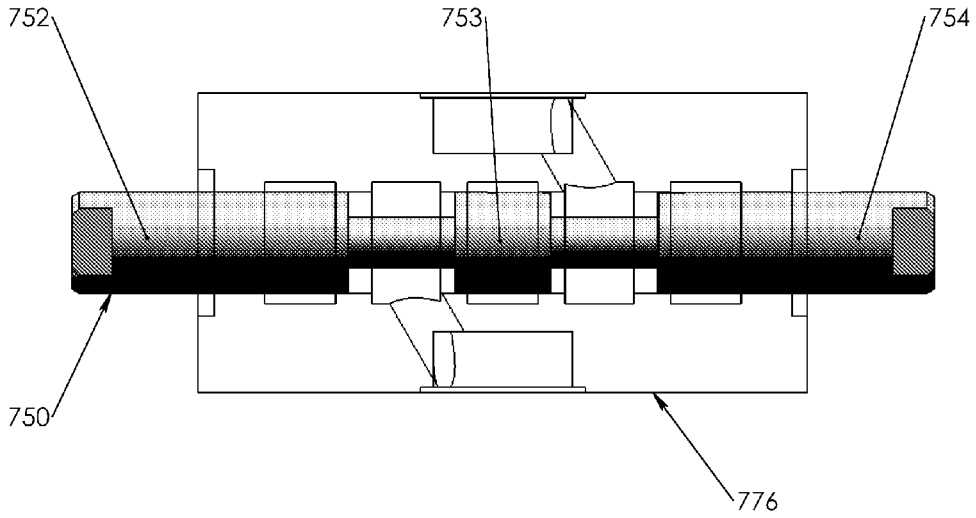
FIGURE 9C. SPOOL - SIDE VIEW
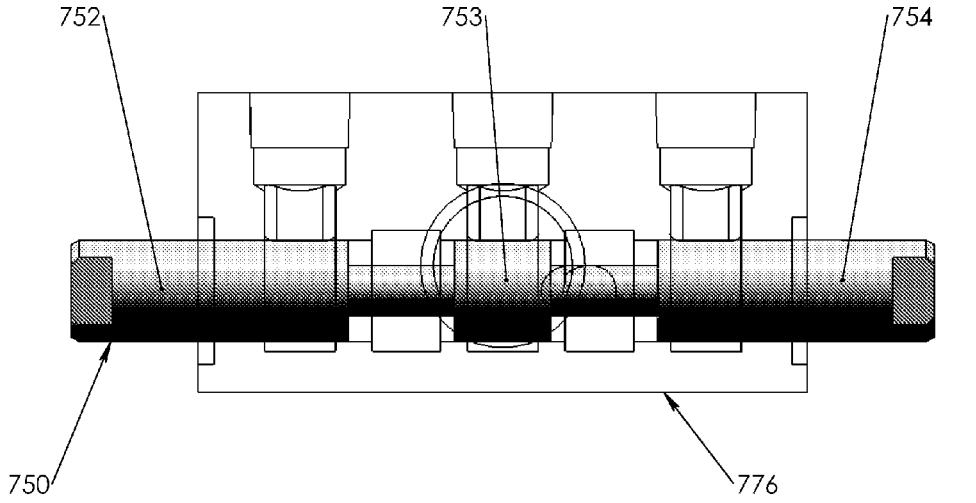

FIGURE 10. VALVE ASSEMBLY 770
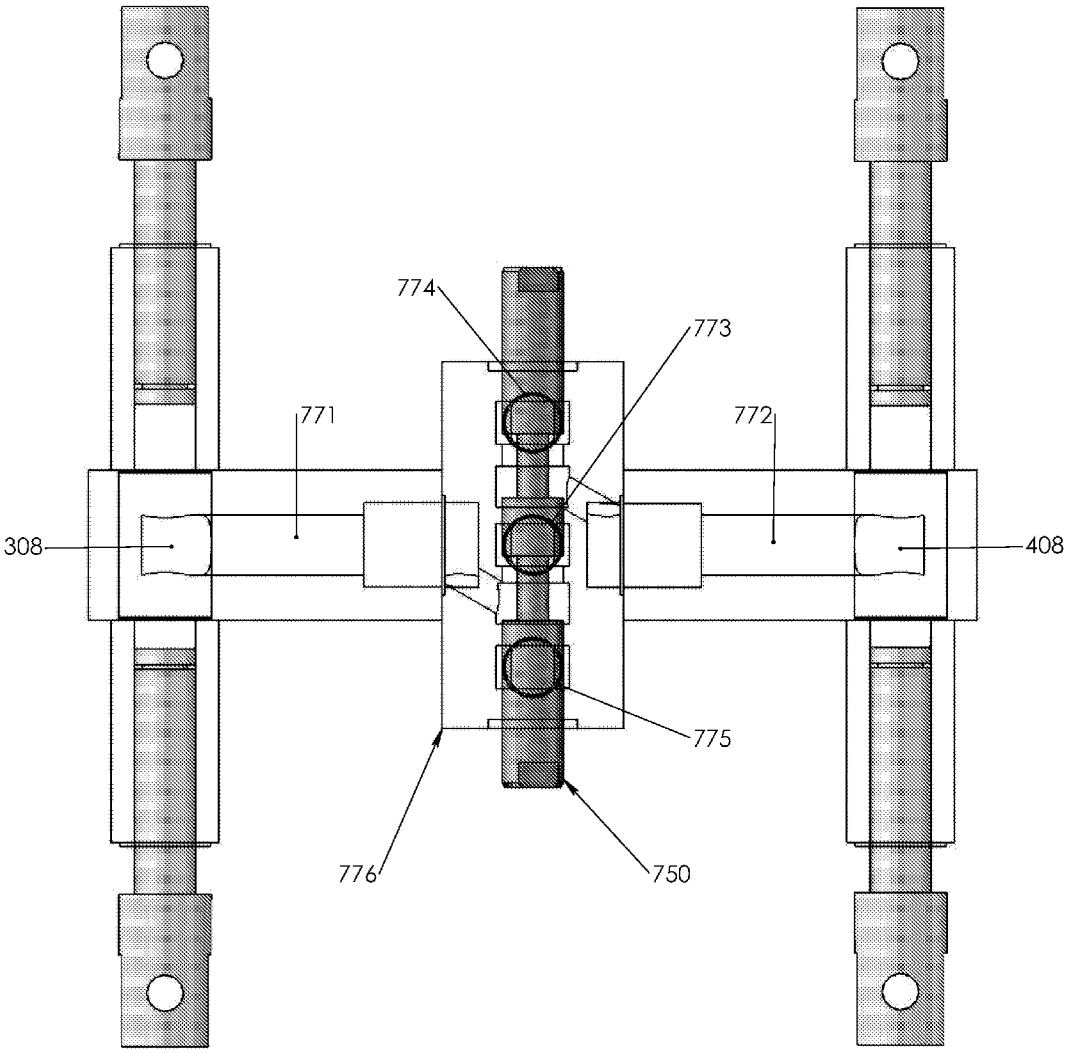

FIGURE 11A. START MODE - B-SIDE COMPRESSION
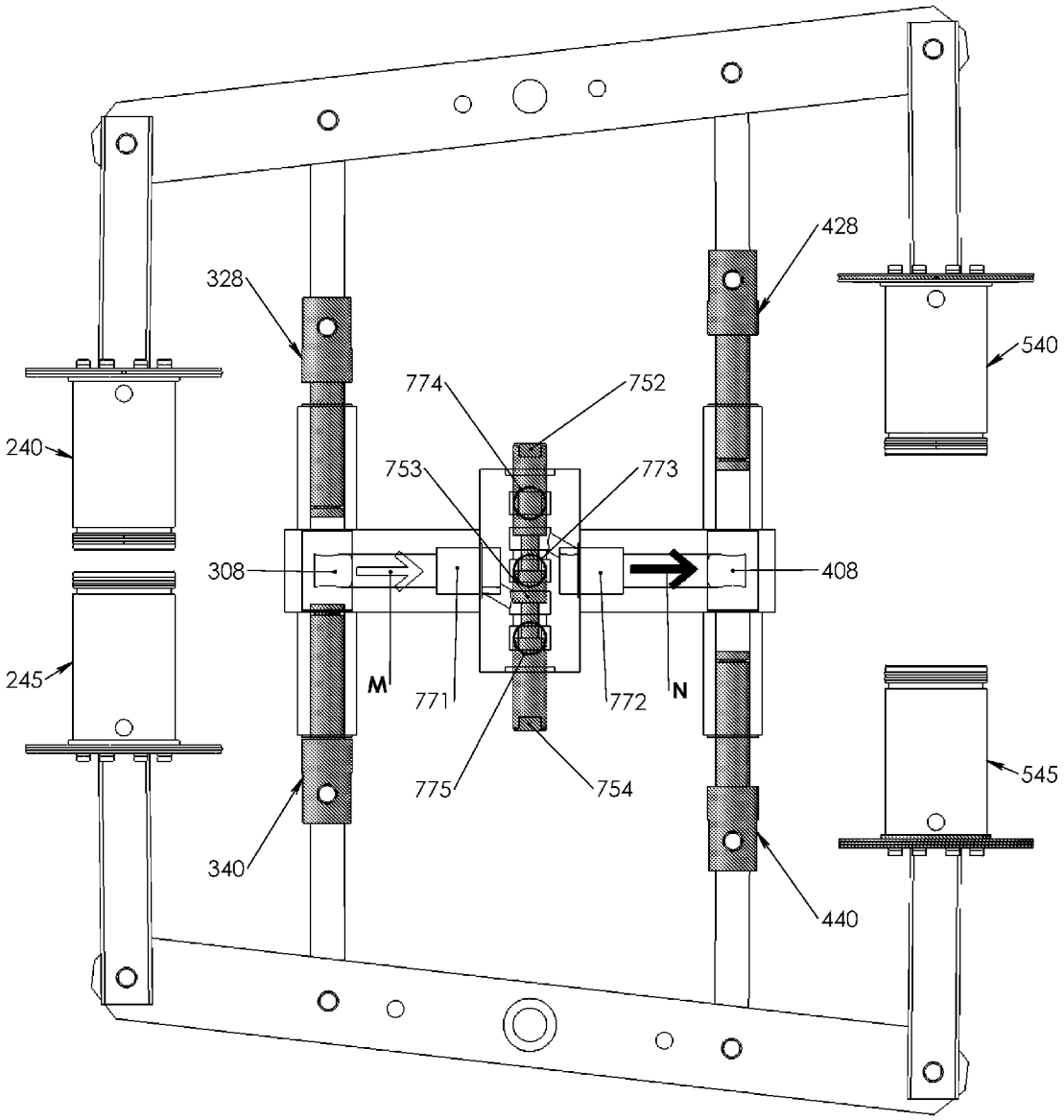

FIGURE 11B. START MODE - A-SIDE COMPRESSION
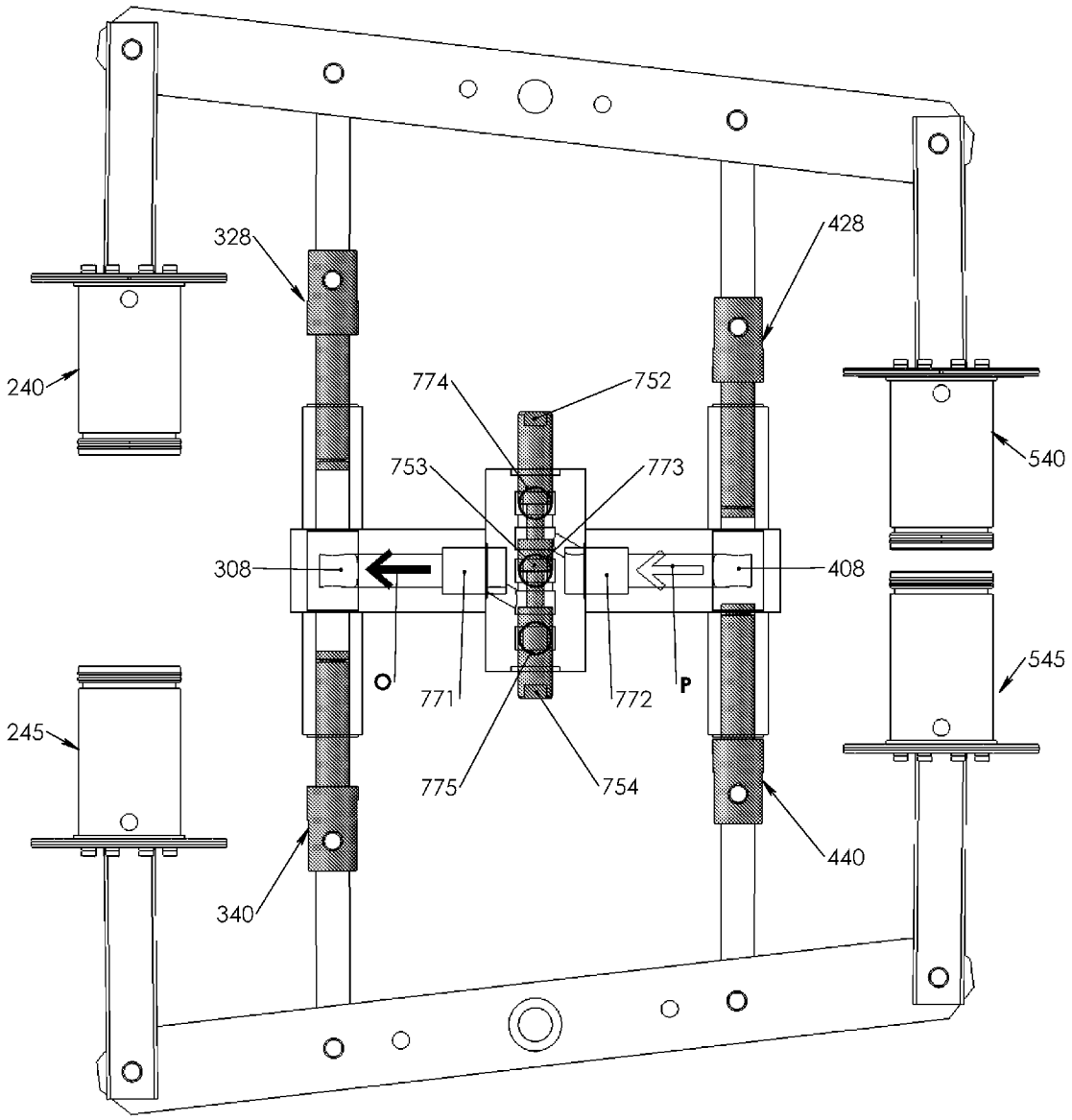

FIGURE 11C. RUN MODE - B-SIDE FIRING
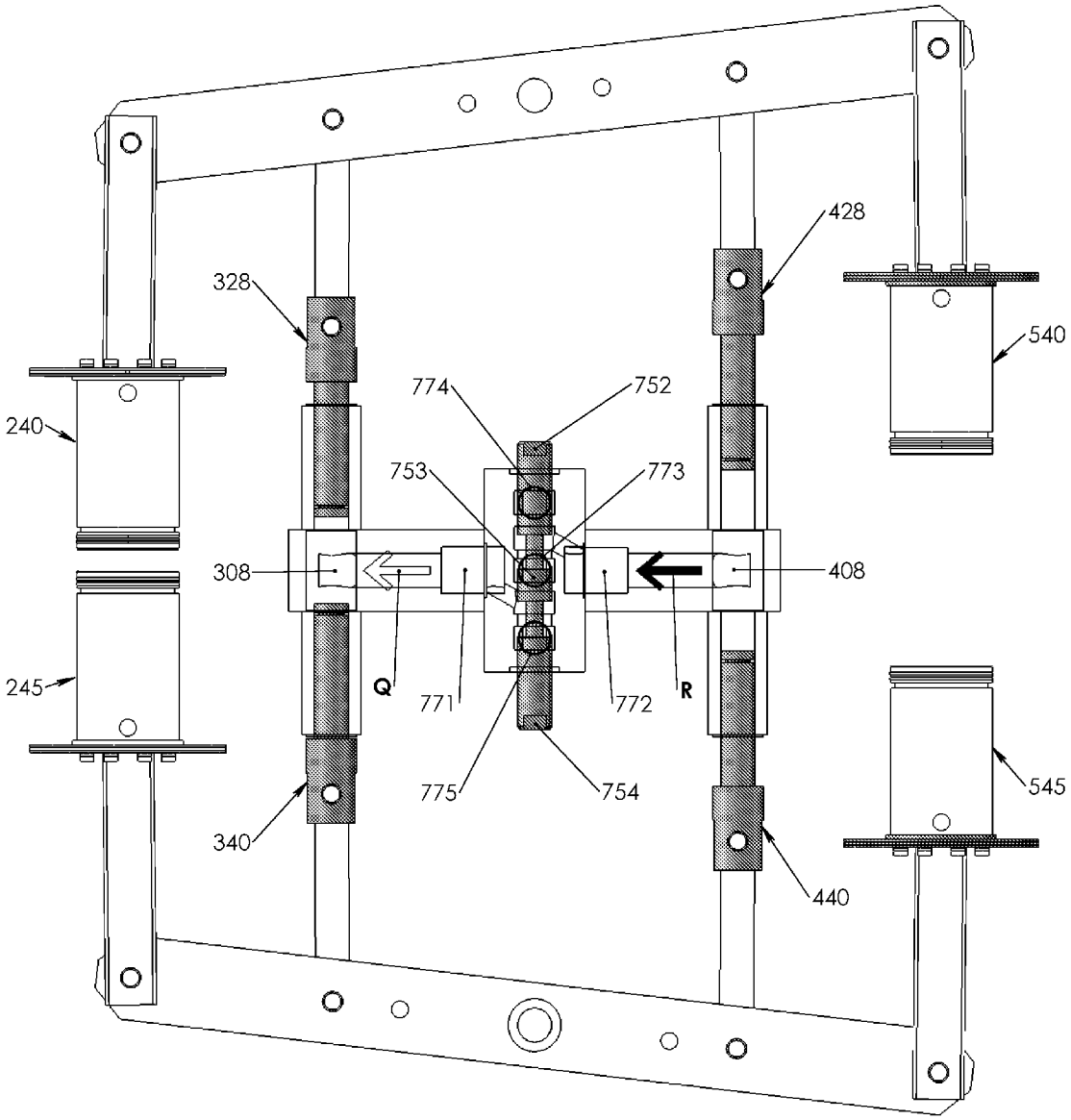

FIGURE 11D. RUN MODE - A-SIDE FIRING
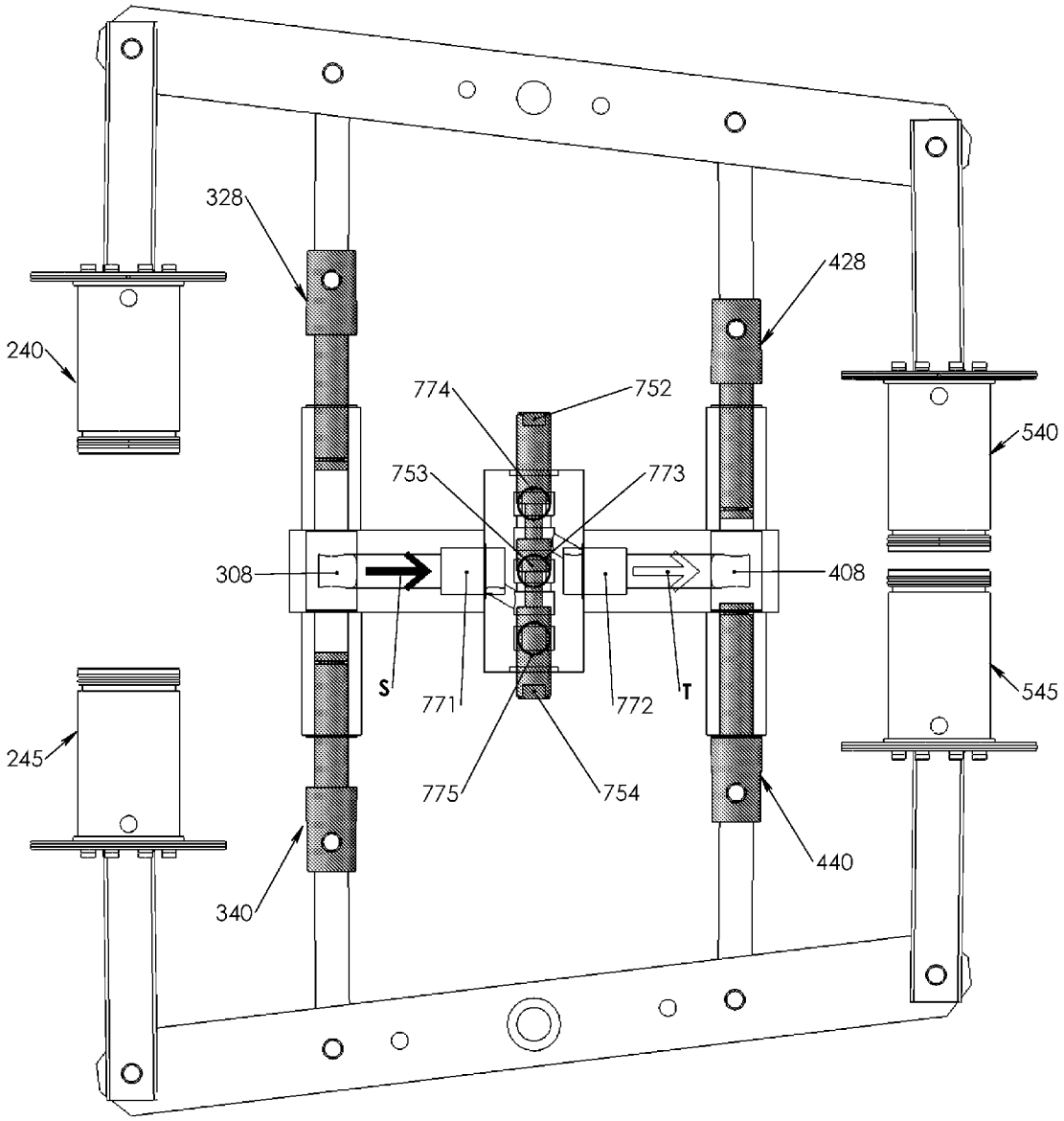

FIGURE 12A. A-SIDE ACTUATOR ASSEMBLY
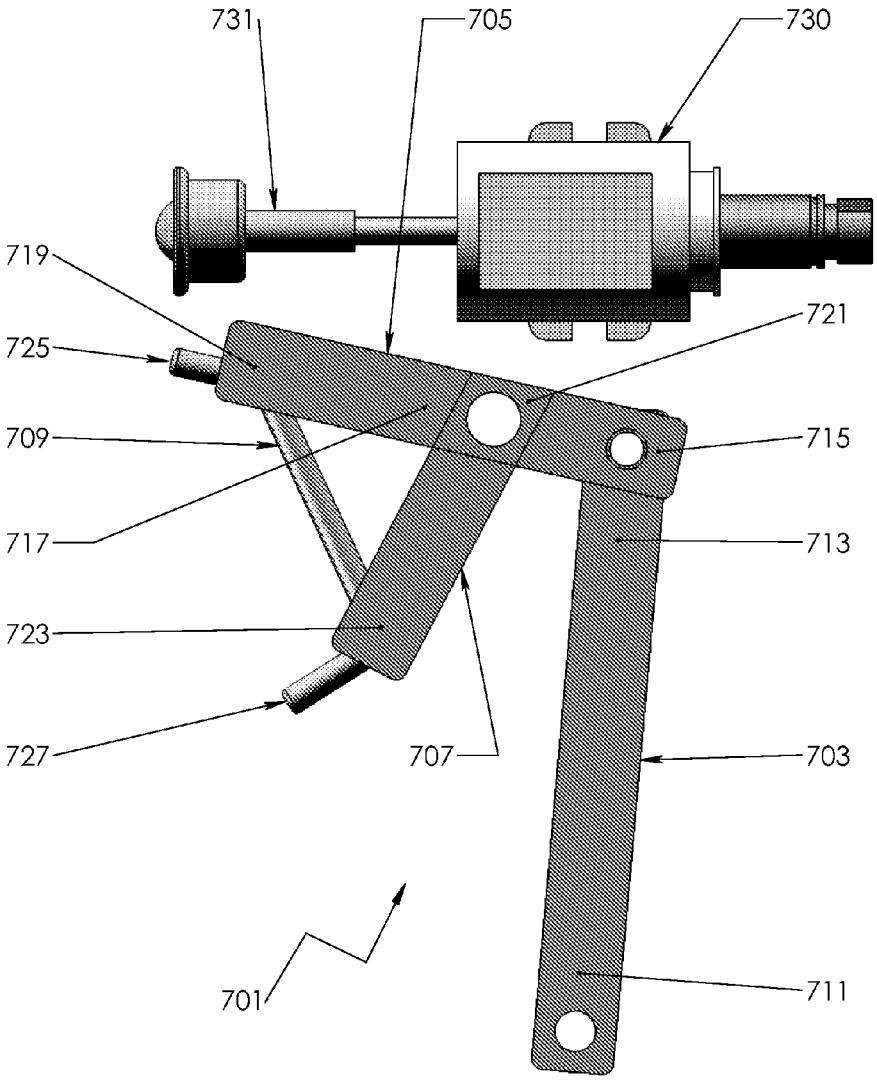

FIGURE 12B. B-SIDE ACTUATOR ASSEMBLY
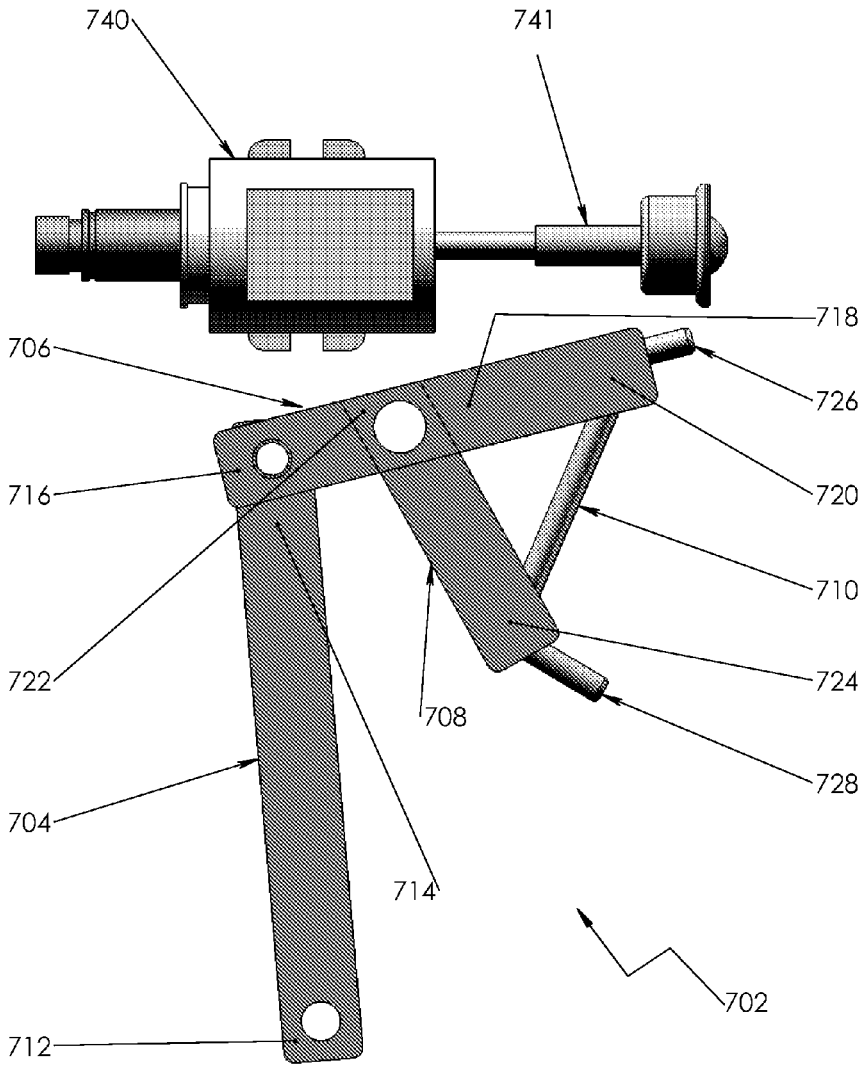

FIGURE 13A. START MODE - B-SIDE COMPRESSION (TOP VIEW)
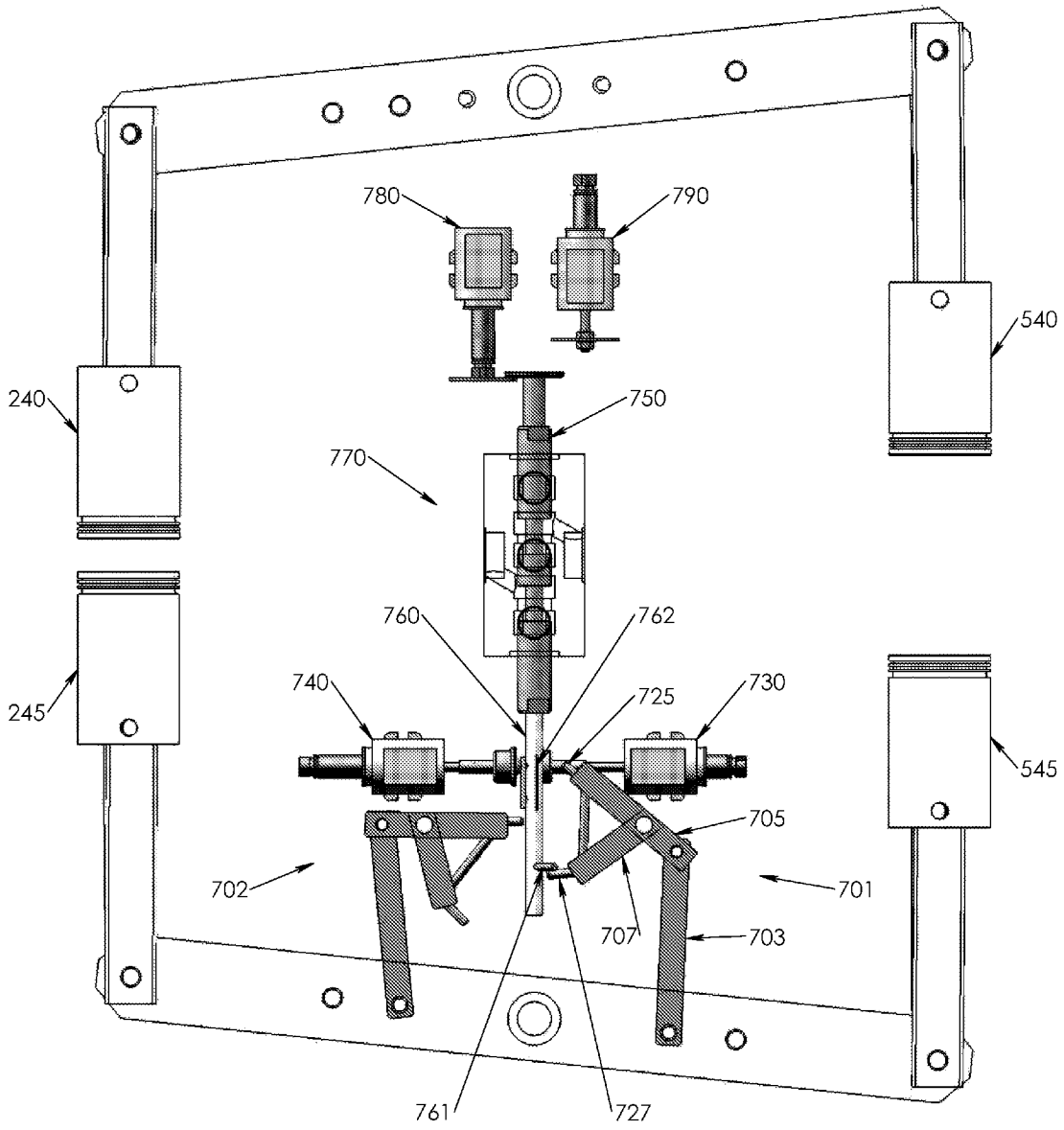

FIGURE 13B. START MODE - B-SIDE COMPRESSION (FRONT VIEW)
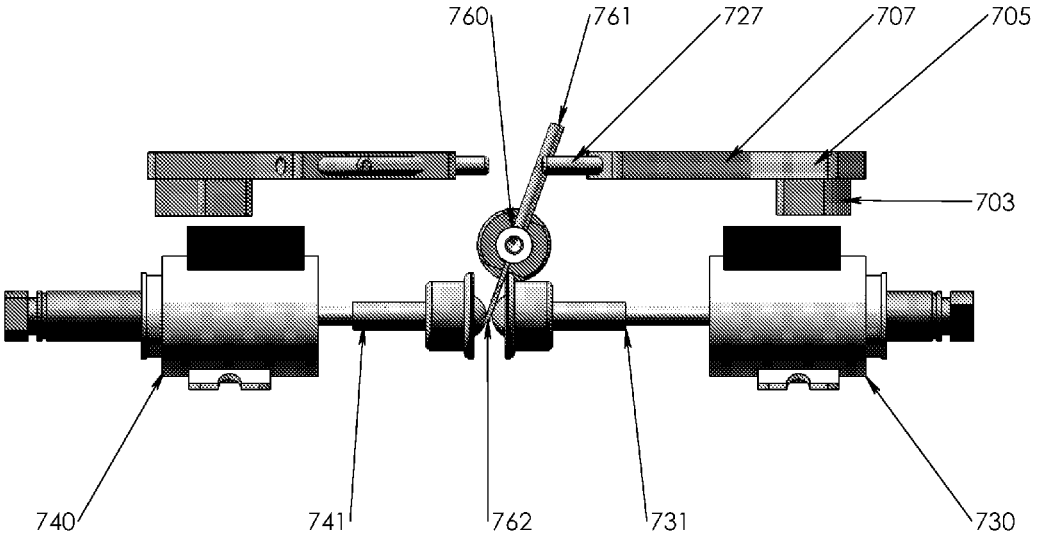

FIGURE 13C. START MODE - A-SIDE COMPRESSION (TOP VIEW)
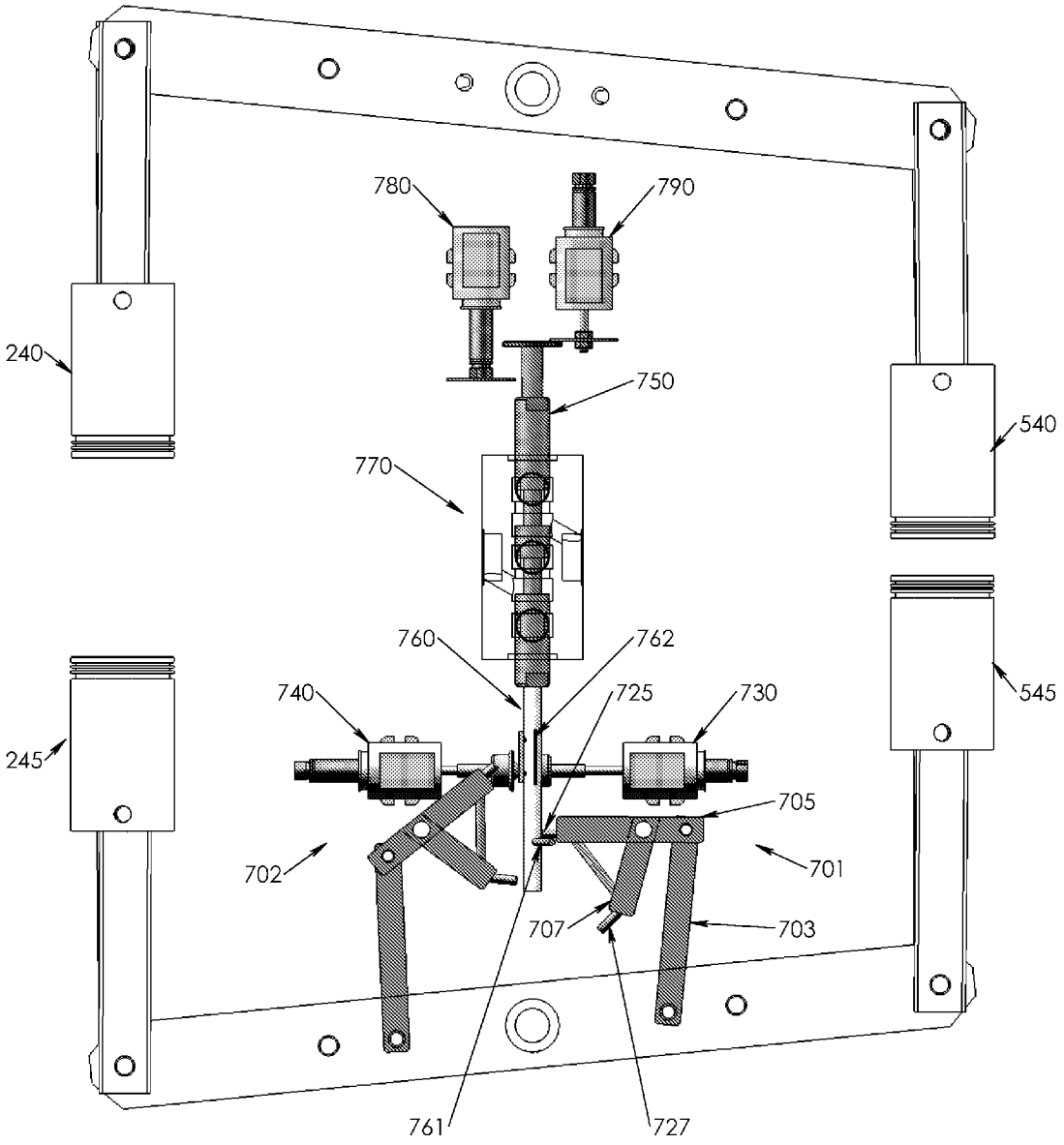

FIGURE 13D. START MODE - A-SIDE COMPRESSION (FRONT VIEW)
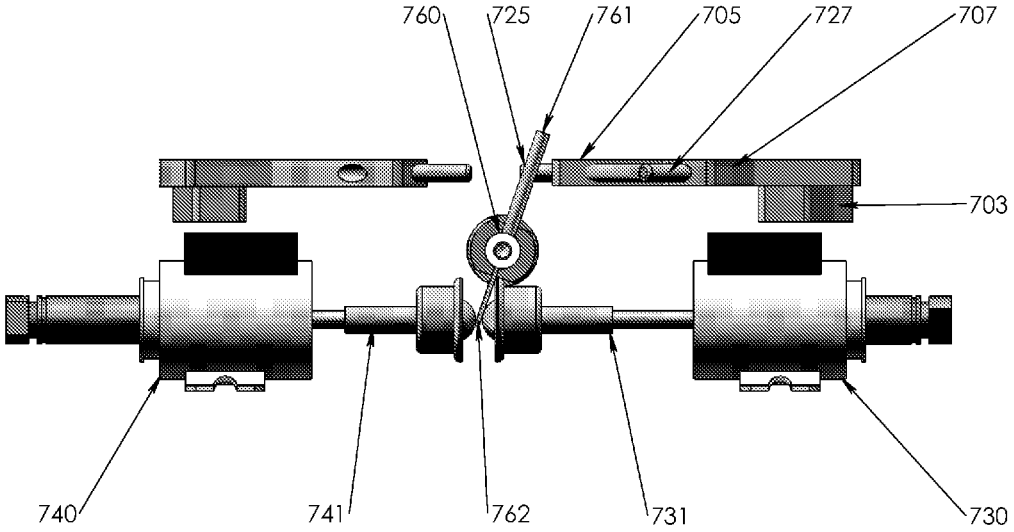

FIGURE 13E. RUN MODE - B-SIDE FIRING (TOP VIEW)
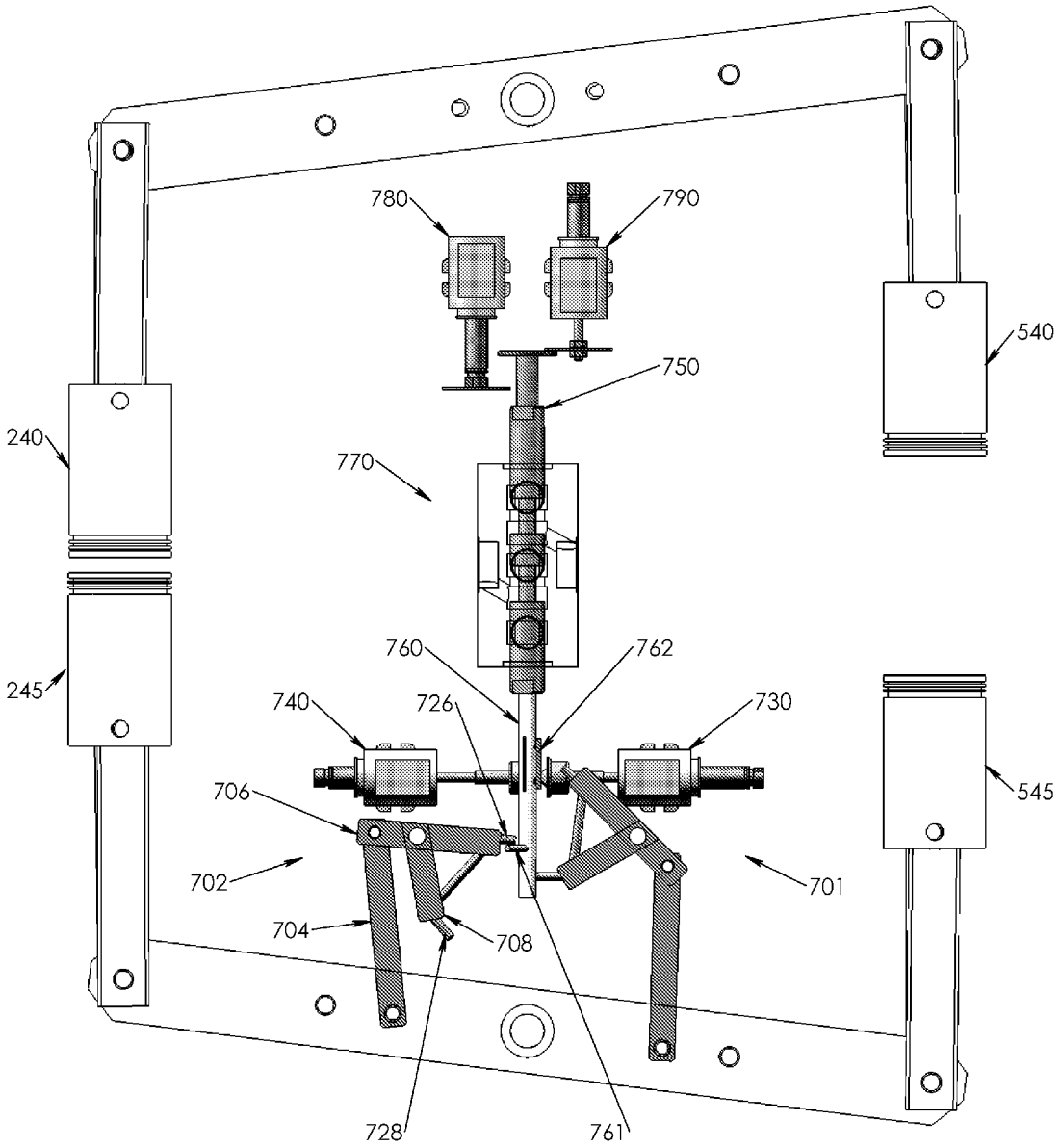

FIGURE 13F. RUN MODE - B-SIDE FIRING (FRONT VIEW)
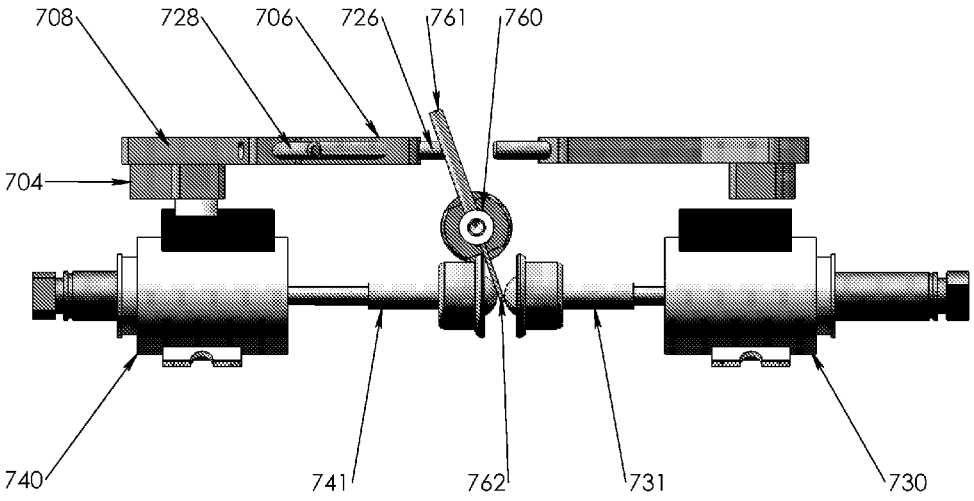

FIGURE 13G. RUN MODE - A-SIDE FIRING (TOP VIEW)
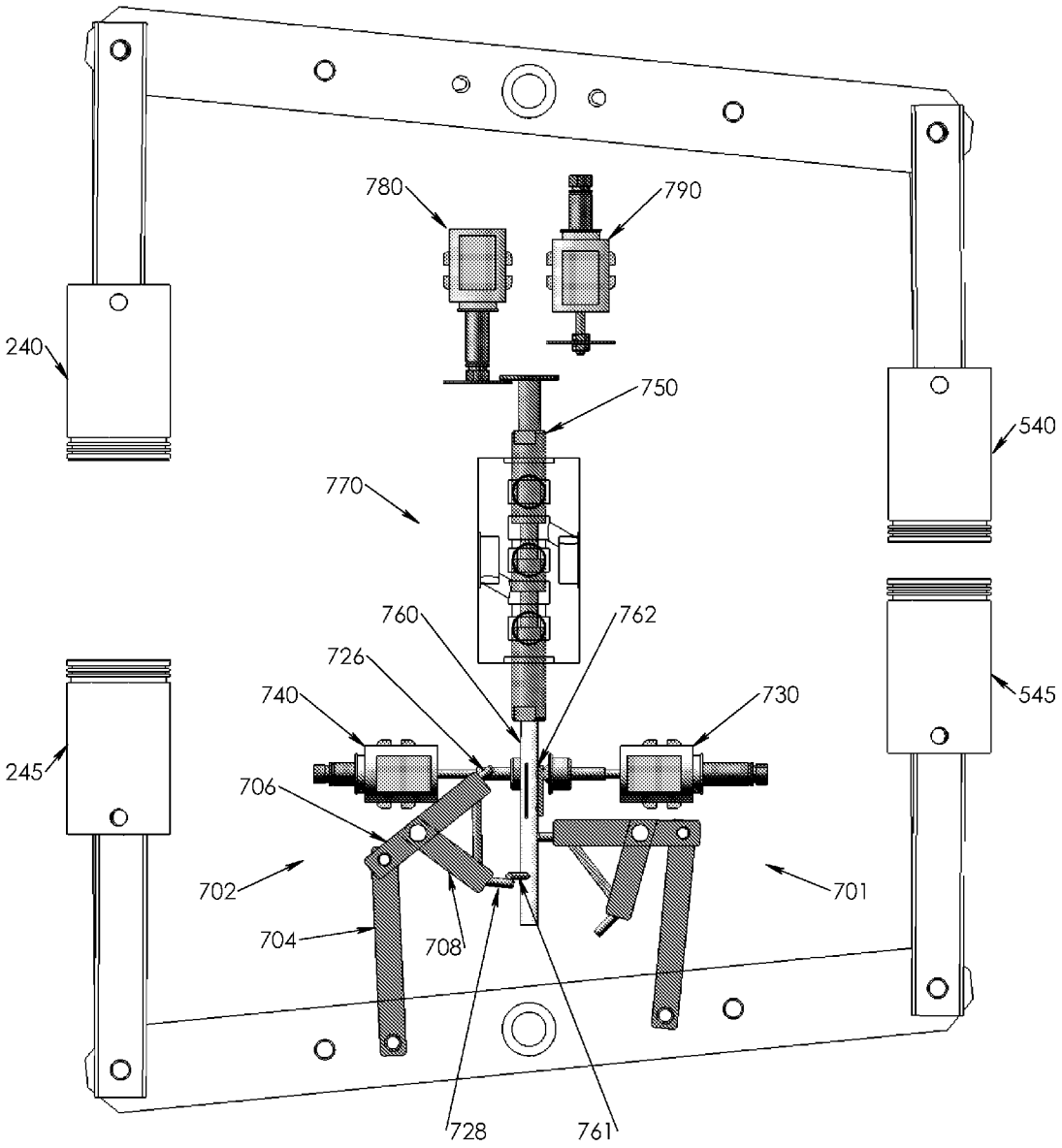

FIGURE 13H. RUN MODE - A-SIDE FIRING (FRONT VIEW)
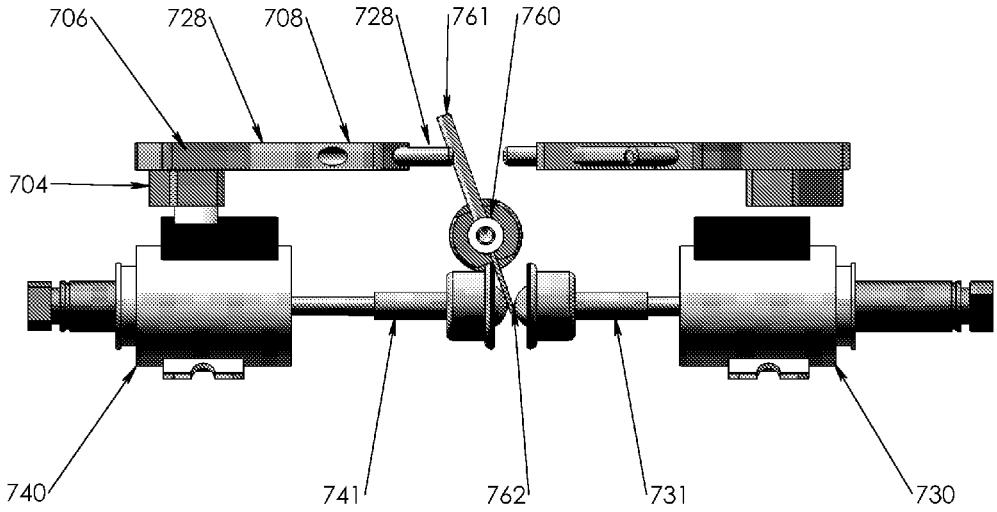

FIGURE 14A. SIDE, CROSS-SECTIONAL VIEW OF COMBUSTION ASSEMBLY DETAILING FIRST AIR PUMP SECTION
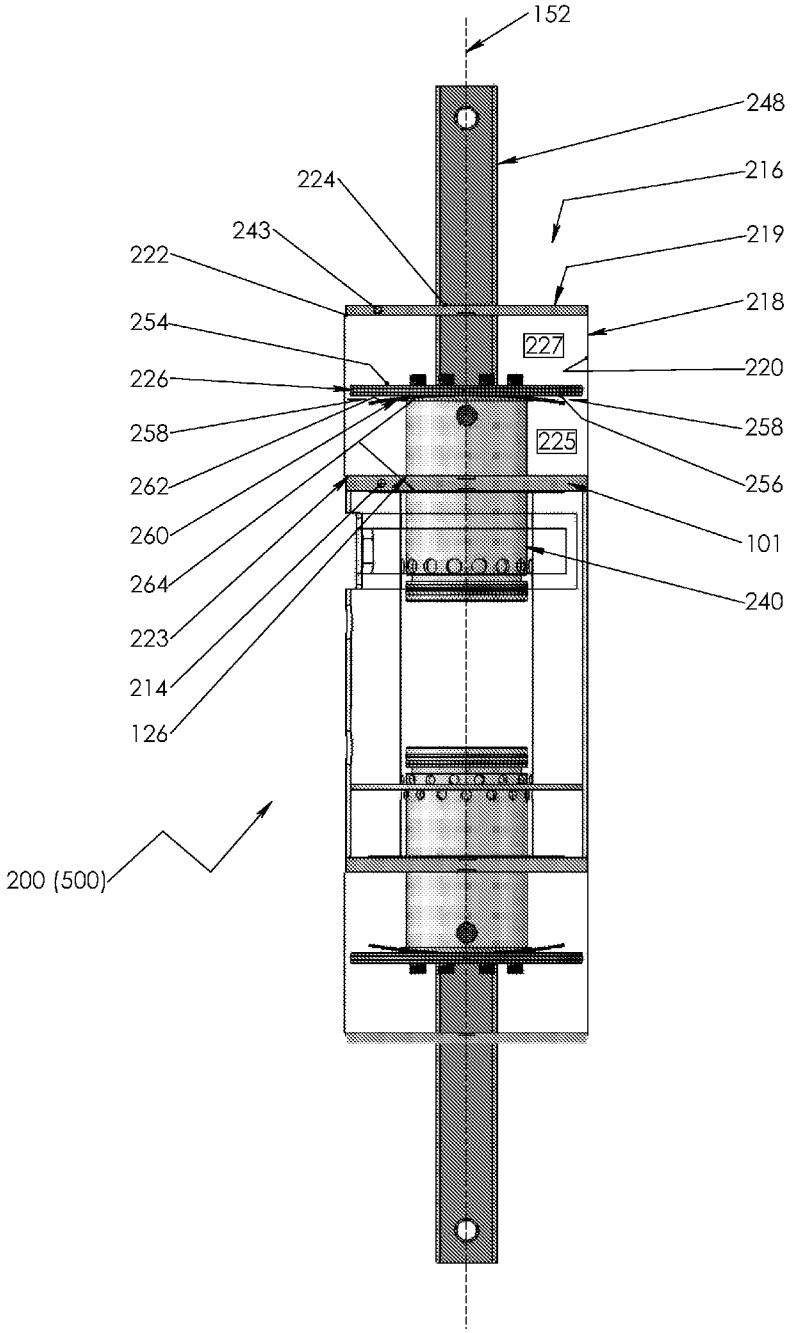

FIGURE 14B. SIDE, CROSS-SECTIONAL VIEW OF COMBUSTION ASSEMBLY DETAILING SECOND AIR PUMP SECTION
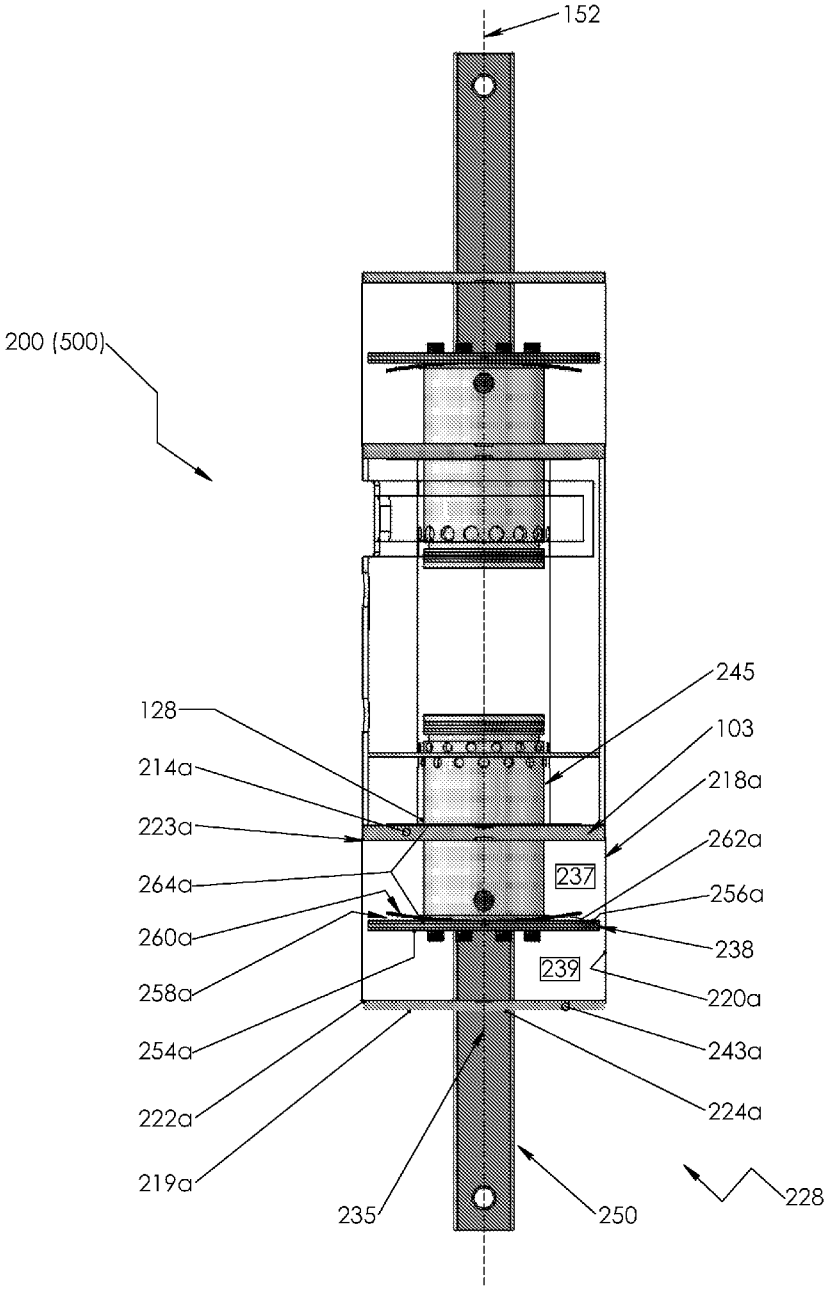

FIGURE 14C. SIDE, CROSS-SECTIONAL VIEW OF COMBUSTION ASSEMBLY DETAILING COMBUSTION SECTION
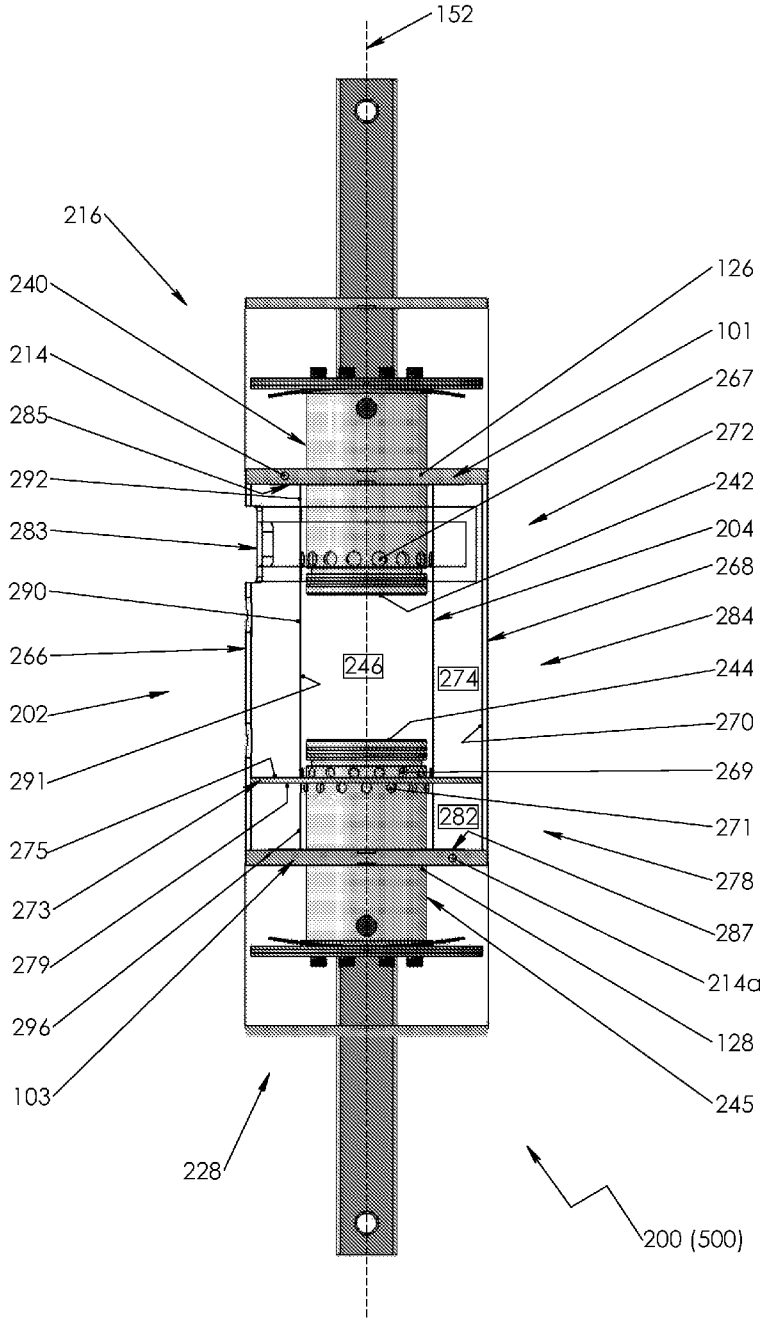

FIGURE 15A. SIDE, CROSS-SECTIONAL VIEW OF COMBUSTION ASSEMBLY DURING ENGINE CYCLE
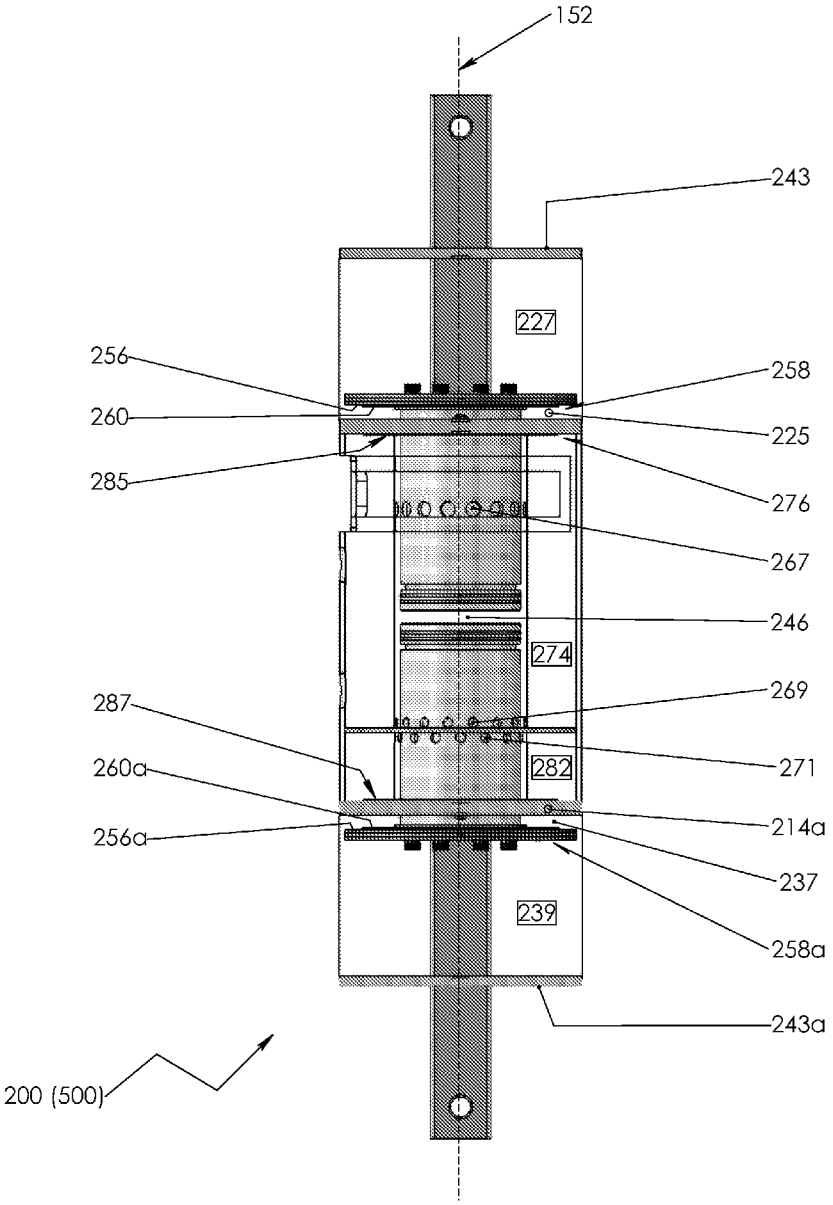

FIGURE 15B. SIDE, CROSS-SECTIONAL VIEW OF COMBUSTION ASSEMBLY DURING ENGINE CYCLE
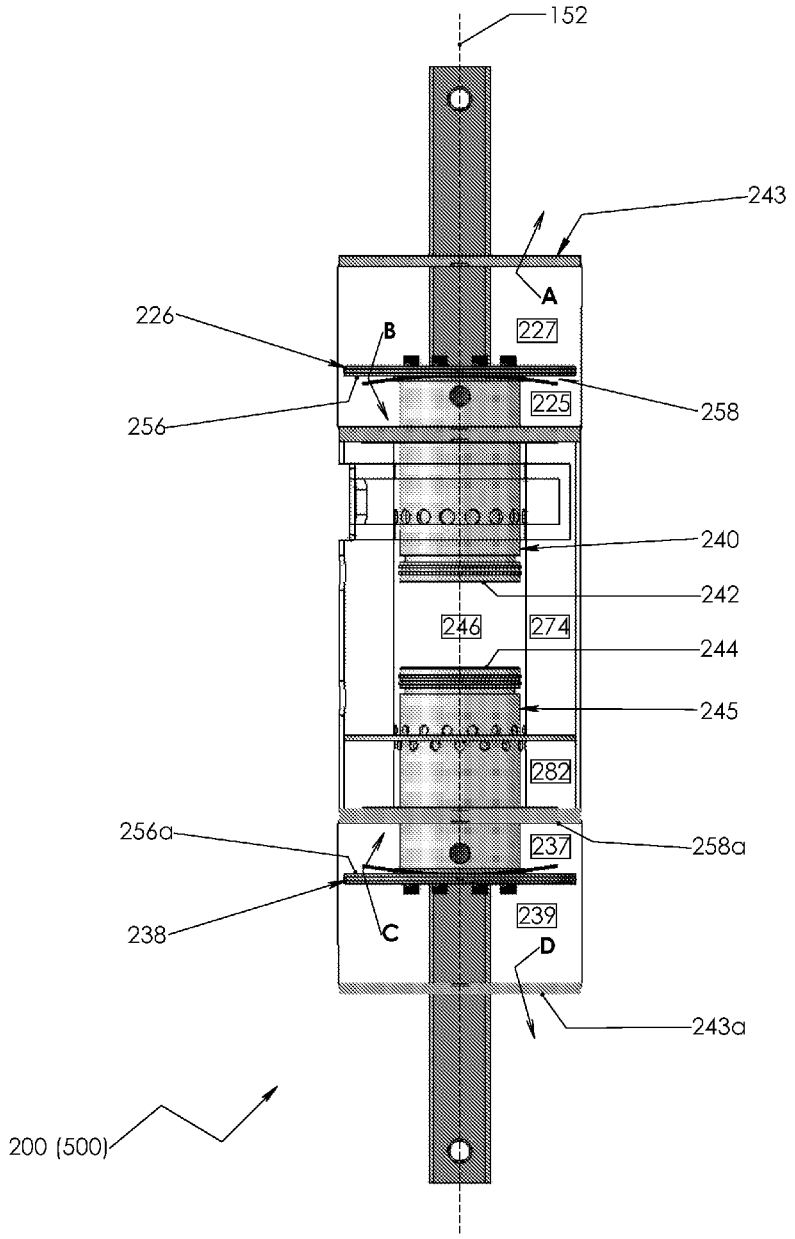

FIGURE 15C. SIDE, CROSS-SECTIONAL VIEW OF COMBUSTION ASSEMBLY DURING ENGINE CYCLE
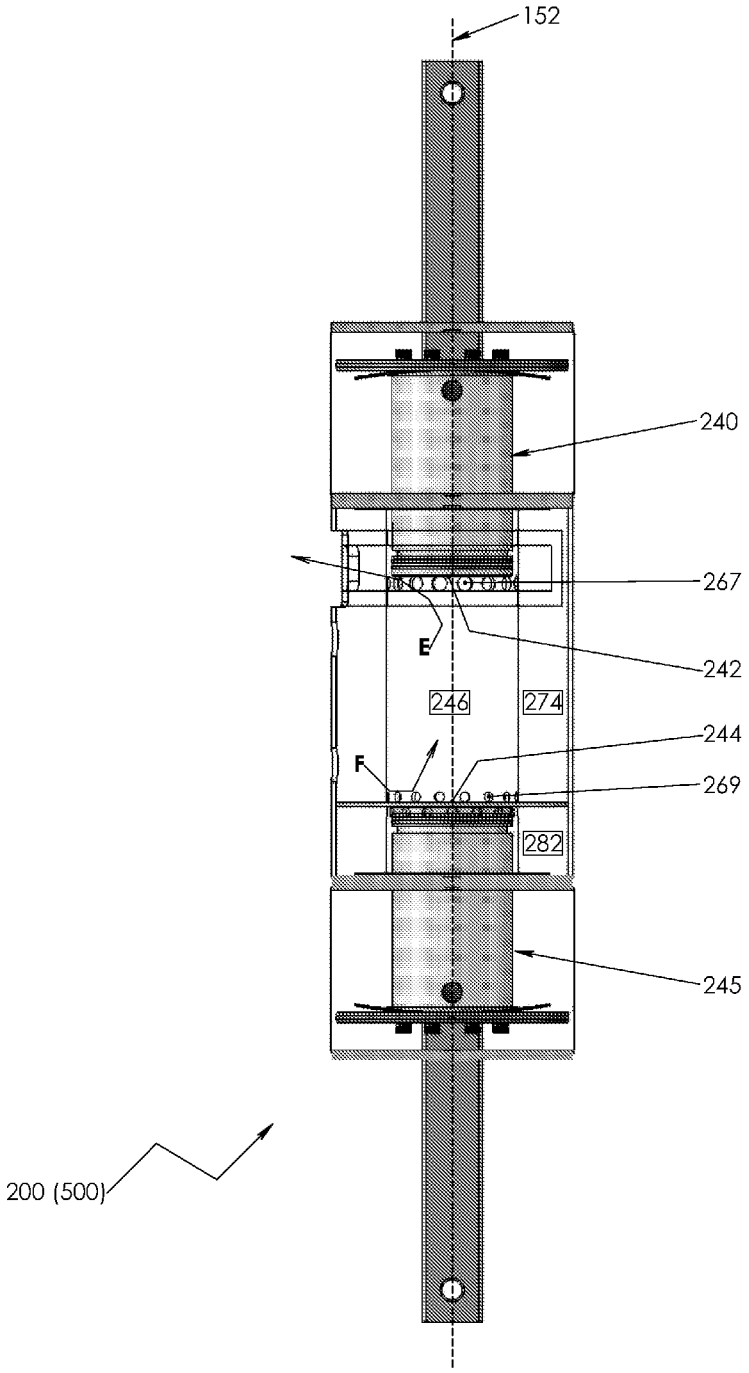

FIGURE 15D. SIDE, CROSS-SECTIONAL VIEW OF COMBUSTION ASSEMBLY DURING ENGINE CYCLE
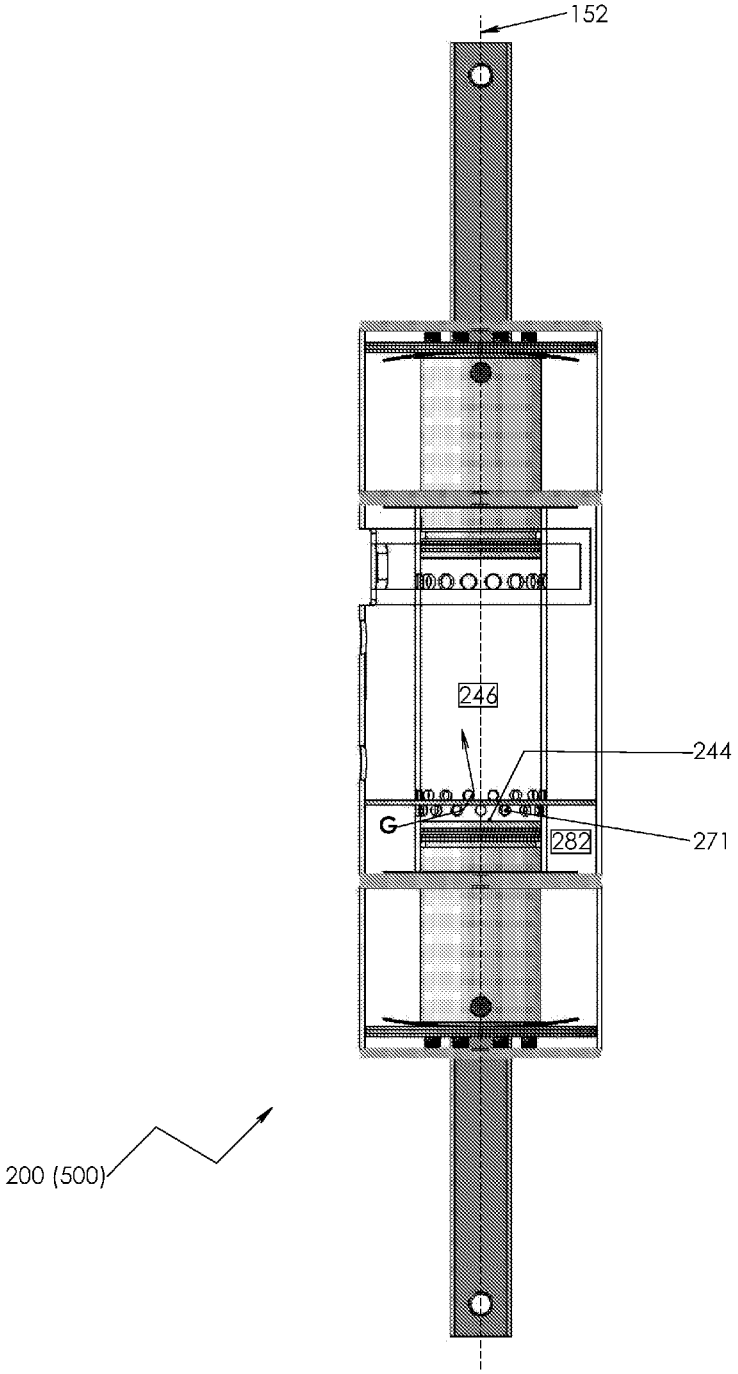

FIGURE 15E. SIDE, CROSS-SECTIONAL VIEW OF COMBUSTION ASSEMBLY DURING ENGINE CYCLE
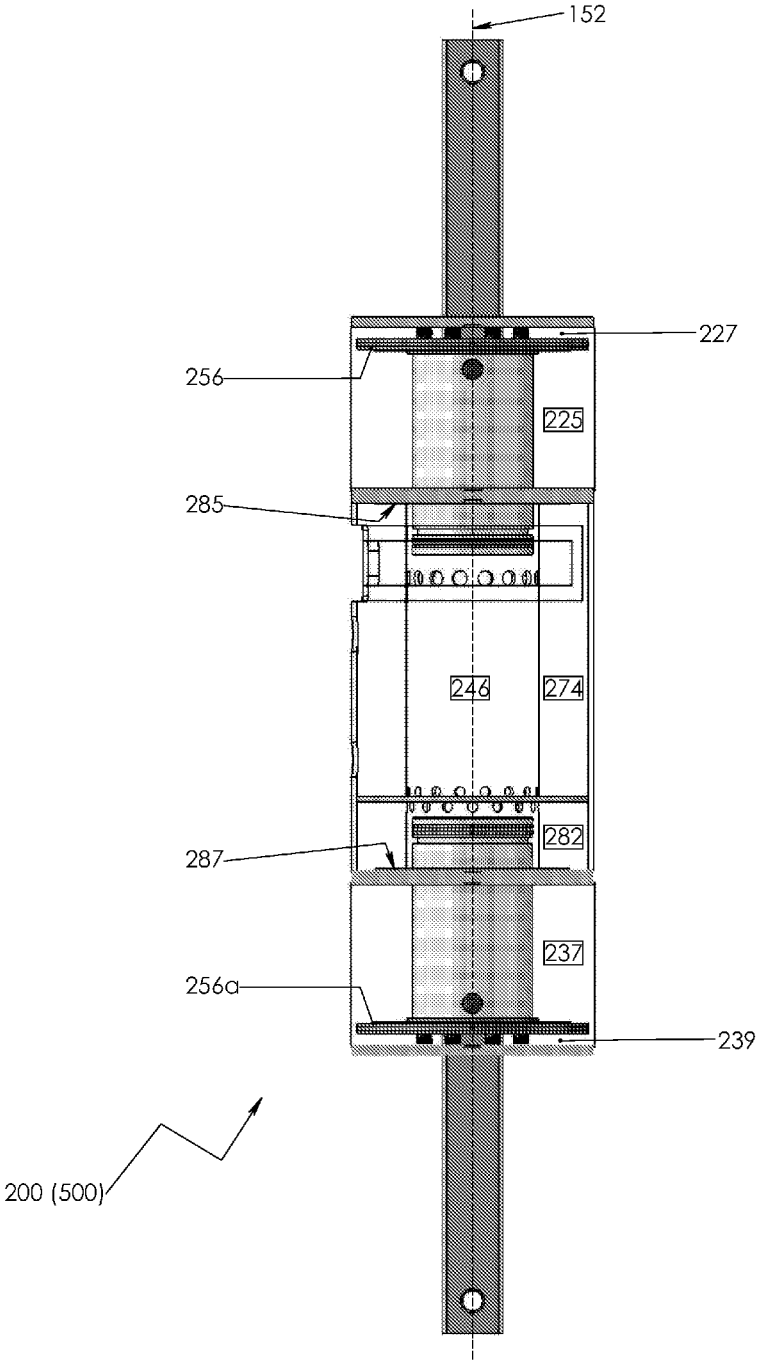

FIGURE 15F. SIDE, CROSS-SECTIONAL VIEW OF COMBUSTION ASSEMBLY DURING ENGINE CYCLE
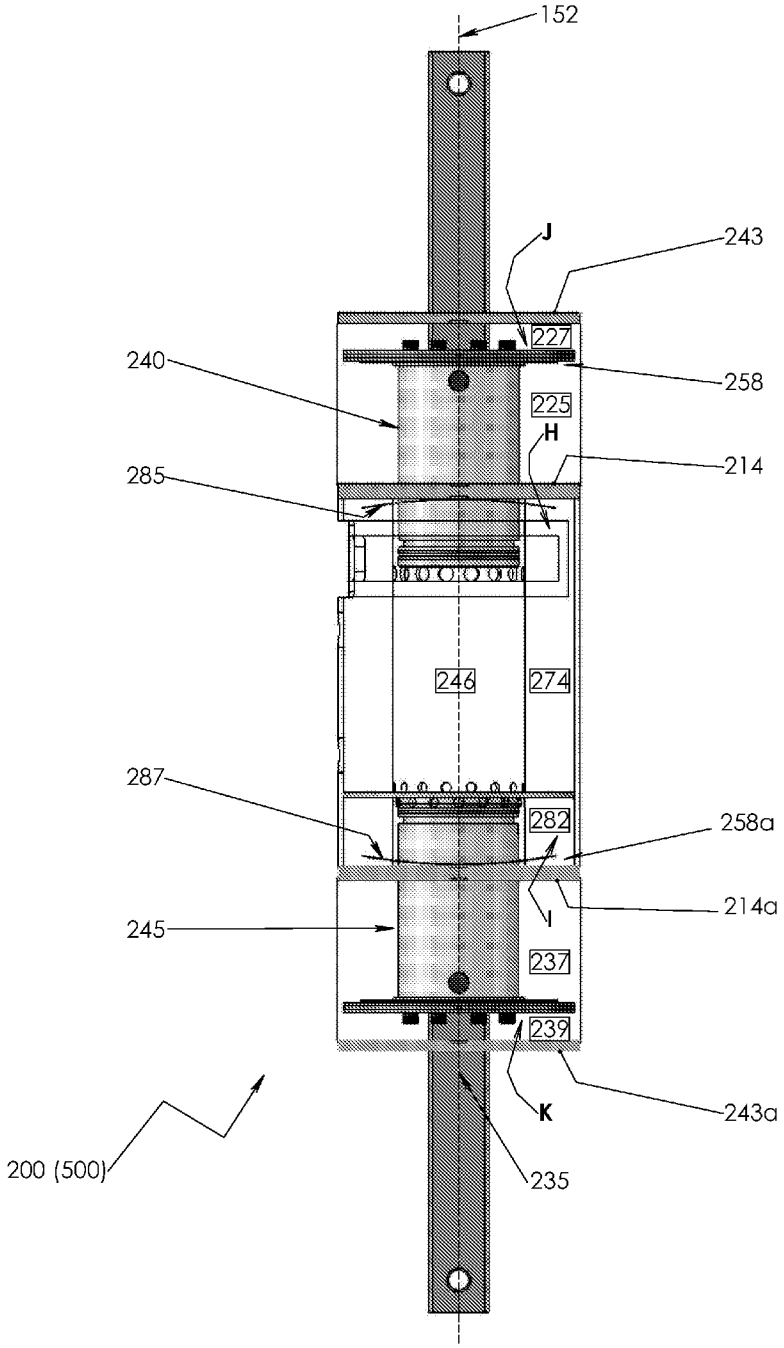

FIGURE 15G. SIDE, CROSS-SECTIONAL VIEW OF COMBUSTION ASSEMBLY DURING ENGINE CYCLE
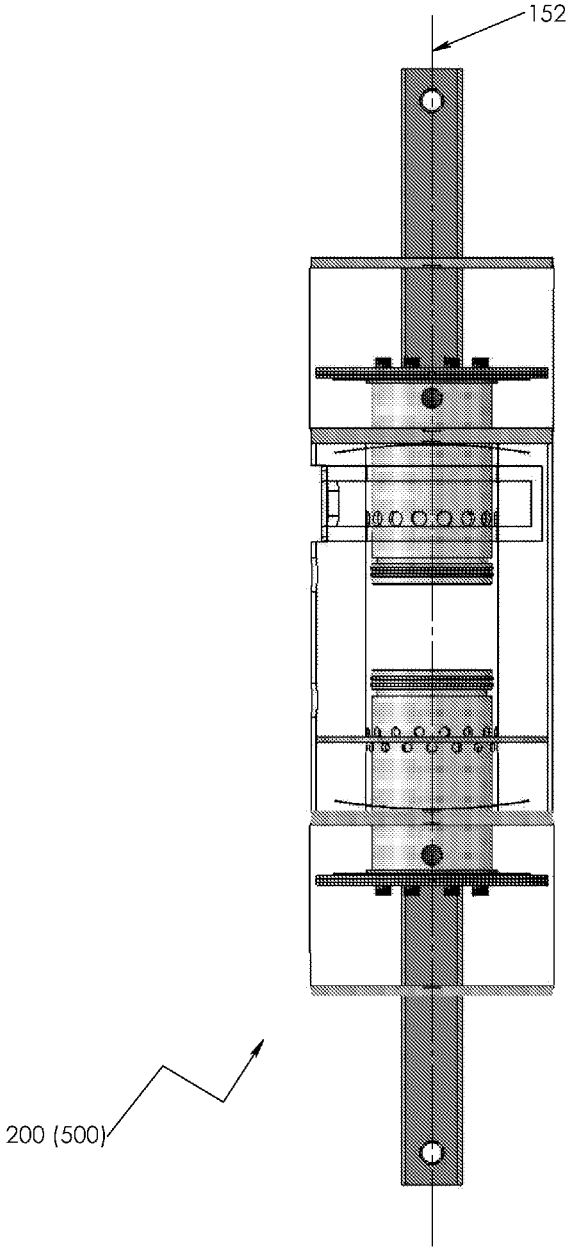

OPPOSED PISTON INTERNAL COMBUSTION ENGINE AND METHOD OF OPERATION THEREOF

REFERENCE TO RELATED APPLICATION

This application claims the benefit of U.S. Provisional Application Ser. No. 61/349,248 filed May 28, 2010, which is incorporated herein in its entirety.

FIELD OF THE INVENTION

The present invention relates to internal combustion engines for producing pressurized hydraulic fluid and methods of using such engines and more particularly to engines having opposed piston combustion assemblies and opposed piston hydraulic assemblies mechanically communicative through levers mounted to a common frame.

BACKGROUND INFORMATION

Hydraulic engines are widely used today to transform mechanical energy into usable motion. In some commonly known conventional internal combustion engines, reciprocating combustion pistons are mechanically connected to reciprocating hydraulic pistons. Expanding combustion gases drive the reciprocating combustion pistons causing reciprocating hydraulic pistons to squeeze hydraulic fluid thereby producing a supply of pressurized hydraulic fluid. One such prior art hydraulic engine is shown in U.S. Pat. No. 5,167,292 to Moiroux et al. Moiroux's engine includes a pair of combustion pistons linked through connecting rods to a pivoted lever arm. The lever arm in turn attaches to a pair of hydraulic pistons so that the reciprocation of the combustion pistons reciprocates the hydraulic pistons thereby producing a supply of pressurized hydraulic fluid.

One of the drawbacks of this type of prior art hydraulic engine is large size, which makes it unsuitable for applications such as powering a vehicle. Accordingly, there is a need for a hydraulic engine of compact size and one that does not require the costly, complex transmissions of conventional internal combustion engines.

Another drawback of prior art engines is the problem posed by crank angle. Typically, an internal combustion engine uses a crankshaft to convert lateral piston movement to axial rotation. In conventional engines, this conversion is performed by a crankshaft. However, because of the crank angle, only a portion of the force generated at the piston face is applied to the crankshaft, the remainder being applied to the cylinder wall. The effect of "piston slap", as it is known, is undesirable.

It is an object of the present invention to overcome one or more of the above-described drawbacks and/or disadvantages of the prior art.

SUMMARY OF THE INVENTION

In accordance with a first aspect, the present invention is directed to an opposed piston internal combustion hydraulic engine adapted to produce a supply of pressurized hydraulic fluid. The apparatus comprises (i) a frame fixedly engaging two pivot pins, the pins defining a pivot pin axis; (ii) a first lever and a second lever each pivotally connected to a pivot pin in its middle, the pivot pin axis dividing each lever into a first side and a second side; (iii) a first combustion assembly having a combustion chamber movably bounded by opposed combustion pistons, the first piston drivingly engaged to the first lever first side and the second piston drivingly engaged to the second lever first side, the assembly defining a first combustion assembly axis parallel to the pivot pin axis; (iv) a first hydraulic assembly having a hydraulic chamber movably bounded by opposed hydraulic pistons, the first piston drivingly engaged to the first lever first side and the second piston drivingly engaged to the second lever first side, the assembly defining a first hydraulic assembly axis parallel to the pivot pin axis; (v) a second hydraulic assembly having a hydraulic chamber movably bounded by opposed hydraulic pistons, the first piston drivingly engaged to the first lever second side and the second piston drivingly engaged to the second lever second side, the assembly defining a second hydraulic assembly axis parallel to the pivot pin axis; and (vi) a second combustion assembly having a combustion chamber movably bounded by opposed combustion pistons, the first piston drivingly engaged to the first lever second side and the second piston drivingly engaged to the second lever second side, the assembly defining a second combustion assembly axis parallel to the pivot pin axis. In accordance with one aspect, each of the assemblies is mechanically communicative with the other three another through the levers, whereby expansion of one combustion chamber contracts the other combustion chamber. In accordance with another aspect, expansion of one combustion chamber contracts one hydraulic chamber and expands the other hydraulic chamber. In accordance with yet another aspect of the present invention, contraction of a hydraulic chamber produces a supply of pressurized hydraulic fluid.

In one embodiment of the present invention, the combustion assembly further includes a combustion case having therein a combustion cylinder. The case includes a first end, a mid-section having an aperture, and a second end, each of the first and second ends having an aperture and an inlet. The cylinder includes an outer surface, an inner surface, at least one port extending therethrough, a first inlet extending therethrough, and a second inlet therethrough, said cylinder containing within it the first and second combustion pistons described above slideably and sealably engaged to the combustion cylinder inner surface, defining the combustion chamber referred to above. The combustion assembly also has a first connecting rod and a second connecting rod, each connecting rod having a proximal end, a mid-section, and a distal end. The first combustion piston is attached to the first connecting rod at the connecting rod proximal end. The first connecting rod mid-section slideably and sealably extends through the case first aperture, while the first connecting rod distal end is attached to the first lever. The second piston is attached to the second connecting rod at the connecting rod proximal end. The second connecting rod mid-section slideably and sealably extends through the case second aperture, while the second connecting rod distal end is attached to the second lever. The case further includes an inner surface; a divider having a first surface and a second surface and sealably extending from the combustion cylinder outer surface to the case inner surface. The divider separates the case into a first and second case chamber. The first case chamber is defined by the case inner surface, the cylinder outer surface and the divider first surface, including the cylinder first inlet and including a case inlet, the first case chamber thereby being pneumatically communicative with the environment external to the combustion case. The second case chamber is defined by the case inner surface, the combustion cylinder outer surface, and the divider second surface, including the cylinder second inlet and including the other case inlet, the second case chamber thereby being pneumatically communicative with the environment external to the combustion case. In this embodiment an exhaust manifold further sealably envelopes a portion of the combustion cylinder including the combustion cylinder ports, and sealably extends through the combustion case mid-section aperture to pneumatically link the combustion chamber with the outside environment when the port is not occluded by a combustion piston. In this embodiment the first and second case chambers are each selectively pneumatically communicative with the outside environment through an inlet occlusion means, and are each selectively pneumatically communicative with the combustion chamber through the respective cylinder inlet, depending on the position of the second piston within the combustion chamber.

In another embodiment of the present invention, the occlusion means in a one-way valve. In still another embodiment of the present invention, the occlusion means is a flexible member over the inlet opening or closing responsive to air pressure differential on its top or bottom surface.

In one embodiment of the present invention, the combustion assembly includes at least one air pump fixed to each of the first and second ends of the combustion case. Each air pump includes a housing having an inner surface, an outer surface, a first end having an aperture and an inlet, a second end having an aperture and an outlet, an air piston having a top surface, a bottom surface, an air channel therethrough, and means for selective occlusion of said air channel. In this embodiment the air pump housing has a first chamber defined by the housing inner surface and the air piston top surface and a second chamber defined by the housing inner surface and the air piston bottom surface. The first air pump is attached to the combustion case first end so that the air pump second end aperture and the air pump second end outlet each align respectively with the case first end aperture and case first end inlet, and the case first end aperture further aligns with the air pump first end aperture, so that the combustion assembly first connecting rod slidedly and sealably extends through the second end aperture, is attached to the air piston, and slidedly and sealably extends through the air pump housing first end aperture to attach to the respective lever. In a mirror image fashion, the second air pump is attached to the combustion case second end so that the air pump second end aperture and air pump second end outlet align respectively with the case second end aperture and inlet, and the case second end aperture further aligns with the air pump second end aperture, so that the combustion assembly second connecting rod slidedly and sealably extends through the second end aperture, is attached to the air piston, and slidedly and sealably extends through the air pump housing first end aperture to attach to the respective lever.

In accordance with another aspect, the present invention is directed to a method for providing a supply of pressurized hydraulic fluid with an opposed piston engine comprising the steps of:

(1) providing a hydraulic engine including a frame; a first and second pivot pin defining a pivot pin axis; a first and second lever; a first combustion assembly and a first hydraulic assembly attached to the levers, said combustion assembly and said hydraulic assembly both being located on a first side of the pivot pin axis, and each assembly defining an axis parallel to the pivot pin axis; and a second combustion assembly and a second hydraulic assembly attached to the levers, said combustion assembly and said hydraulic assembly both being located on a second side of the pivot pin axis, and each assembly also defining an axis parallel to the pivot pin axis;

(2) providing a combustion chamber within each of the combustion assemblies and a hydraulic chamber within each of the hydraulic assemblies, the chambers being in mechanical communication through the levers;

(3) charging one of the hydraulic chambers with hydraulic fluid;

(4) causing the combustion chamber located on the opposite side of the pivot pin axis from the charged hydraulic chamber to expand, thereby compressing the fluid in said hydraulic chamber through the mechanical communication of the hydraulic and combustion assemblies through the levers, and making the fluid therein available as a supply of pressurized hydraulic fluid.

In one embodiment of the present invention, the method further comprises the steps of (i) introducing a fuel-air mixture into the combustion chamber described above, (ii) axially driving the combustion pistons of said chamber toward one another, thereby contracting the combustion chamber and compressing the mixture therein, and (iii) detonating the mixture, thereby expanding the combustion chamber, driving the combustion pistons apart, and contracting the hydraulic chamber and combustion chamber on the opposite side of the pivot pin axis from the expanding combustion chamber through the mechanical communication between assemblies.

In one embodiment of the present invention, the method further comprises the steps of (i) providing in the combustion assembly described above a case first chamber and a case second chamber each selectively pneumatically communicative with the combustion chamber; (ii) charging the first chamber with pressurized air, (iii) charging the second chamber with a pressurized fuel-air mixture; (iii) selectively connecting the combustion chamber with the environment external to the combustion assembly thereby effecting pneumatic communication and allowing a first portion of the contents to move out of the combustion assembly to the environment external to the combustion assembly; (iv) selectively connecting the case first chamber to the combustion chamber thereby displacing a second portion of the gases therein to the environment external to the combustion assembly; (v) selectively connecting the combustion chamber with the case second chamber thereby displacing a third portion of the gases therein to the environment external to the combustion assembly.

One advantage of the engine and method of operation in the present invention is that the engine is compact because the assembly axes are parallel with a common midpoint instead of serial with offset centers. Another advantage is that the combustion assembly connecting rod does not rotate about a crankshaft, but rather angularly displaces a lever through a comparatively small range of movement.

Other advantages of the apparatus and method of the present invention will become readily apparent in view of the following detailed description and accompanying drawings.

BRIEF DESCRIPTION OF THE DRAWINGS

FIG. 1 is a side elevation view of a hydraulic engine embodying the present invention including opposed pistons, combustion cylinders and hydraulic cylinders;

FIG. 2 is a side elevation view of the frame of the engine of FIG. 1;

FIG. 3 is an elevation view of the lever arm of the engine apparatus of FIG. 1;

FIG. 4 is front, top view of a hydraulic assembly of the engine of FIG. 1;

FIG. 5 is a front, top view of a hydraulic piston assembly forming a translatable unit within the hydraulic assembly of FIG. 4;

FIG. 6 is a side, cross-sectional view of a combustion assembly of the engine of FIG. 1;

FIG. 7 is a front, top view of a combustion piston assembly forming a translatable unit within the combustion assembly of FIG. 6;

FIG. 8A, FIG. 8B, and FIG. 8C are front perspective, partially cross-sectional views of the engine of FIG. 1 sequentially showing the operation of the engine;

FIG. 8D is a top view of a portion of the engine showing the double synchronizing means employed in one embodiment of the present invention;

FIG. 9A is a top view of the selective hydraulic fluid communication assembly;

FIG. 9B is a top view of the spool in the valve block;

FIG. 9C is a side view of the spool of the selective hydraulic fluid communication assembly of FIG. 9A;

FIG. 10 is a top view of the valve assembly;

FIG. 11A is a schematic view of 'start mode'-B-side compression;

FIG. 11B is a schematic view of 'start mode'-A-side compression;

FIG. 11C is a schematic view of 'run mode'-B-side firing;

FIG. 11D is a schematic view of 'run mode'-A-side firing;

FIG. 12A is a front view of the A-side actuator assembly;

FIG. 12B is a front view of the B-side actuator assembly;

FIG. 13A is a top view of 'start mode'-B-side compression;

FIG. 13B is a front view of 'start mode'-B-side compression;

FIG. 13C is a top view of 'start mode'-A-side compression;

FIG. 13D is a front view of 'start mode'-A-side compression;

FIG. 13E is a top view of 'run mode'-B-side firing;

FIG. 13F is a front view of 'run mode'-B-side firing;

FIG. 13G is a top view of 'run mode'-A-side firing;

FIG. 13H is a front view of 'run mode'-A-side firing;

FIG. 14A, FIG. 14B, and FIG. 14C are side, cross-sectional views of the combustion assembly of FIG. 6 respectively detailing the first air pump section, second air pump section and combustion section; and FIG. 15A through FIG. 15G are side, cross-sectional views of the combustion assembly of FIG. 6 showing the operation of the combustion assembly during a cycle.

DETAILED DESCRIPTION OF THE DRAWINGS

Table 1 identifies each element discussed the detailed description of the drawings section of the specification ordered by element number.

TABLE 1

| Element | Reference Numeral |
|---|---|
| Hydraulic Engine | 10 |
| Frame | 100 |
| First Assembly Bridge | 101 |
| First Pivot Pin | 102 |
| Second Assembly Bridge | 103 |
| Second Pivot Pin | 104 |
| First Pivot Pin Bridge | 106 |
| Second Pivot Pin Bridge | 108 |
| First Pivot Pin Bridge, First Pivot Pin Aperture | 110 |
| Second Pivot Pin Bridge, First Pivot Pin Aperture | 112 |
| First Pivot Pin Bridge, Second Pivot Pin Aperture | 114 |
| Second Pivot Pin Bridge, Second Pivot Pin Aperture | 116 |
| First Assembly Bridge, Second Combustion Assembly Aperture | 118 |

TABLE 1-continued

| Element | Reference Numeral |
|---|---|
| Second Assembly Bridge, Second Combustion Assembly Aperture | 120 |
| First Assembly Bridge, Second Hydraulic Assembly Aperture | 122 |
| Second Assembly Bridge, Second Hydraulic Assembly Aperture | 124 |
| First Assembly Bridge, First Combustion Assembly Aperture | 126 |
| Second Assembly Bridge, First Combustion Assembly Aperture | 128 |
| First Assembly Bridge, First Hydraulic Assembly Aperture | 130 |
| Second Assembly Bridge, First Hydraulic Assembly Aperture | 132 |
| First Pivot Pin Bridge Fastener Apertures | 134 |
| Second Pivot Pin Bridge Fastener Apertures | 136 |
| Pivot Pin Axis | 150 |
| Engine First Side | 151 |
| First Combustion Assembly Axis | 152 |
| Engine Second Side | 153 |
| First Hydraulic Assembly Axis | 154 |
| Second Hydraulic Assembly Axis | 156 |
| Second Combustion Assembly Axis | 158 |
| First Synchronizer | 160a |
| Second Synchronizer | 160b |
| First Synchronizer Fulcrum | 162a |
| Second Synchronizer Fulcrum | 162b |
| First Synchronizer Fulcrum First End | 164a |
| Second Synchronizer Fulcrum First End | 164b |
| First Synchronizer Fulcrum Second End | 166a |
| Second Synchronizer Fulcrum Second End | 166b |
| First Synchronizer Lever | 168a |
| Second Synchronizer Lever | 168b |
| First Synchronizer Lever First End | 170a |
| Second Synchronizer Lever First End | 170b |
| First Synchronizer Lever Mid-Section | 172a |
| Second Synchronizer Lever Mid-Section | 172b |
| First Synchronizer Lever Second End | 174a |
| Second Synchronizer Lever Second End | 174b |
| First Synchronizer First Arm Link | 176a |
| Second Synchronizer First Arm Link | 176b |
| First Synchronizer First Arm Link First End | 178a |
| Second Synchronizer First Arm Link First End | 178b |
| First Synchronizer First Arm Link Second End | 180a |
| Second Synchronizer First Arm Link Second End | 180b |
| First Synchronizer Second Arm Link | 182a |
| Second Synchronizer Second Arm Link | 182b |
| First Synchronizer Second Arm Link First End | 184a |
| Second Synchronizer Second Arm Link First End | 184b |
| First Synchronizer Second Arm Link Mid-Section | 186a |
| Second Synchronizer Second Arm Link Mid-Section | 186b |
| First Synchronizer Second Arm Link Second End | 188a |
| Second Synchronizer Second Arm Link Second End | 188b |
| First Combustion Assembly | 200 |
| First Combustion Case | 202 |
| First Combustion Cylinder | 204 |
| First Combustion Cylinder Inner Surface | 206 |
| First Combustion Case First End | 208 |
| First Combustion Case Second End | 212 |
| First Air Pump Outlet | 214 |
| First Air Pump | 216 |
| First Air Pump Housing | 218 |
| First Air Pump Housing Outer Surface | 219 |
| First Air Pump Housing Inner Surface | 220 |
| First Air Pump Distal End | 222 |
| First Air Pump Proximal End | 223 |
| First Air Pump Distal Aperture | 224 |
| First Air Pump Proximal Chamber | 225 |

TABLE 1-continued

| Element | Reference Numeral |
|---|---|
| First Air Pump Piston | 226 |
| Second Air Pump Piston | 238 |
| First Air Pump Distal Chamber | 227 |
| Second Air Pump | 228 |
| Fuel Inlet | 235 |
| Second Air Pump Proximal Chamber | 237 |
| Second Air Pump Distal Chamber | 239 |
| First Combustion Piston | 240 |
| First Combustion Piston Face | 242 |
| First Air Pump Inlet | 243 |
| Second Combustion Piston Face | 244 |
| Second Combustion Piston | 245 |
| First Combustion Chamber | 246 |
| First Connecting Rod | 248 |
| First Translatable Combustion Member | 249 |
| Second Connecting Rod | 250 |
| Second Translatable Combustion Member | 253 |
| First Air Pump Piston Distal Surface | 254 |
| First Air Pump Piston Proximal Surface | 256 |
| First Air Pump Piston Air Channel | 258 |
| First Air Pump Reed Valve | 260 |
| First Air Pump Reed Valve Contact Surface | 262 |
| First Air Pump Reed Valve Fixation Means | 264 |
| Case Housing | 266 |
| Exhaust Ports | 267 |
| Case Housing External Surface | 268 |
| Combustion Cylinder Proximal Inlets | 269 |
| Case Housing Internal Surface | 270 |
| Combustion Cylinder Distal Inlets | 271 |
| Case First End | 272 |
| Case Divider | 273 |
| Case First Chamber | 274 |
| Case Divider Proximal Surface | 275 |
| Assembly Bridge Air Channel | 276 |
| Case Second End | 278 |
| Case Divider Distal Surface | 279 |
| Case Second Chamber | 282 |
| Exhaust Manifold | 283 |
| Case First Chamber Reed Valve | 285 |
| Case Mid-Section | 284 |
| Case Second Chamber Reed Valve | 287 |
| Combustion Cylinder Outer Surface | 290 |
| Combustion Cylinder Inner Surface | 291 |
| Combustion Cylinder First End | 292 |
| Combustion Cylinder Second End | 296 |
| Second Air Pump Outlet | 214a |
| Second Air Pump Housing | 218a |
| Second Air Pump Outer Surface | 219a |
| Second Air Pump Housing Inner Surface | 220a |
| Second Air Pump Distal End | 222a |
| Second Air Pump Proximal End | 223a |
| Second Air Pump Distal Aperture | 224a |
| Second Air Pump Inlet | 243a |
| Second Air Pump Piston Distal Surface | 254a |
| Second Air Pump Piston Proximal Surface | 256a |
| Second Air Pump Piston Air Channel | 258a |
| Second Air Pump Reed Valve | 260a |
| Second Air Pump Reed Valve Contact Surface | 262a |
| Second Air Pump Reed Valve Fixation Means | 264a |
| First Hydraulic Assembly | 300 |
| First Hydraulic Chamber | 308 |
| First Hydraulic Cylinder First End | 310 |
| First Hydraulic Cylinder First End Aperture | 312 |
| First Hydraulic Cylinder Second End | 314 |
| First Hydraulic Cylinder Second End Aperture | 316 |
| First Hydraulic Cylinder Inner Surface | 318 |
| First Hydraulic Piston Connection Point | 324 |
| First Hydraulic Piston Connection Pin | 326 |
| First Hydraulic Piston | 328 |
| First Hydraulic Cylinder | 330 |

TABLE 1-continued

| Element | Reference Numeral |
|---|---|
| First Hydraulic Piston Face | 332 |
| Second Hydraulic Piston Connection Point | 334 |
| Second Hydraulic Piston Connection Pin | 336 |
| Second Hydraulic Piston | 340 |
| Second Hydraulic Piston Face | 342 |
| First Hydraulic Chamber Inlet | 344 |
| First Hydraulic Connecting Rod | 352 |
| First Translatable Hydraulic Member | 353 |
| Second Hydraulic Connecting Rod | 354 |
| First Hydraulic Connecting Rod Connection Point | 356 |
| Second Hydraulic Connecting Rod Connection Point | 358 |
| Second Translatable Hydraulic Member | 360 |
| Second Hydraulic Assembly | 400 |
| Second Hydraulic Chamber | 408 |
| Second Hydraulic Assembly First Hydraulic Piston | 428 |
| Second Hydraulic Assembly Second Hydraulic Piston | 440 |
| Second Hydraulic Assembly First Connecting Rod | 452 |
| Second Hydraulic Assembly Second Connecting Rod | 454 |
| Second Combustion Assembly | 500 |
| Second Combustion Chamber | 546 |
| Second Combustion Assembly First Connecting Rod | 548 |
| Second Combustion Assembly Second Connecting Rod | 550 |
| A-Side Actuator | 701 |
| A-Side Actuator Control Rod | 703 |
| A-Side Actuator First Impact Arm | 705 |
| A-Side Actuator Second Impact Arm | 707 |
| A-Side Actuator Connecting Bolt | 709 |
| A-Side Actuator Control Rod Distal End | 711 |
| A-Side Actuator Control Rod Proximal End | 713 |
| A-Side Actuator First Impact Arm First End | 715 |
| A-Side Actuator First Impact Arm Mid-Section | 717 |
| A-Side Actuator First Impact Arm Second End | 719 |
| A-Side Actuator Second Impact Arm First End | 721 |
| A-Side Actuator Second Impact Arm Second End | 723 |
| A-Side Actuator First Impact Arm Second End Control Pivot Pin | 725 |
| A-Side Actuator Second Impact Arm Second End Control Pivot Pin | 727 |
| B-Side Actuator | 702 |
| B-Side Actuator Control Rod | 704 |
| B-Side Actuator First Impact Arm | 706 |
| B-Side Actuator Second Impact Arm | 708 |
| B-Side Actuator Connecting Bolt | 710 |
| B-Side Actuator Control Rod Distal End | 712 |
| B-Side Actuator Control Rod Proximal End | 714 |
| B-Side Actuator First Impact Arm First End | 716 |
| B-Side Actuator First Impact Arm Mid-Section | 718 |
| B-Side Actuator First Impact Arm Second End | 720 |
| B-Side Actuator Second Impact Arm First End | 722 |
| B-Side Actuator Second Impact Arm Second End | 724 |
| B-Side Actuator First Impact Arm Second End Control Pivot Pin | 726 |
| B-Side Actuator Second Impact Arm Second End Control Pivot Pin | 728 |
| Start Solenoid | 730 |
| Start Solenoid Pusher Rod | 731 |
| Run Solenoid | 740 |
| Run Solenoid Pusher Rod | 741 |
| Spool | 750 |
| Spool First End | 752 |
| Spool Mid-Section | 753 |
| Spool Second End | 754 |
| Spool Cap | 755 |
| Spool Extension | 760 |
| Spool Control Pin | 761 |
| Spool Start to Run Lever | 762 |
| Valve Assembly | 770 |

TABLE 1-continued

| Element | Reference Numeral |
|---|---|
| Valve First Port | 771 |
| Valve Second Port | 772 |
| Valve Third Port | 773 |
| Valve Forth Port | 774 |
| Valve Fifth Port | 775 |
| Valve Block | 776 |
| A-Pulse Solenoid | 780 |
| A-Pulse Solenoid Pusher Rod | 781 |
| A-Pulse Solenoid Plate | 782 |
| B-Pulse Solenoid | 790 |
| B-Pulse Solenoid Pusher Rod | 791 |
| B-Pulse Solenoid Plate | 792 |
| First Lever | 800 |
| First Lever First Segment | 802 |
| First Lever Second Segment | 804 |
| First Lever Third Segment | 806 |
| First Lever Fourth Segment | 808 |
| First Lever First Arm | 810 |
| First Lever Second Arm | 812 |
| First Lever Spacer | 814 |
| First Lever First Arm Spacer | 816 |
| First Lever Second Arm Spacer | 817 |
| First Lever First Connection Point | 818 |
| First Lever Second Connection Point | 820 |
| First Lever Third Connection Point | 822 |
| First Lever Fourth Connection Point | 824 |
| First Lever First Side | 826 |
| First Lever Second Side | 828 |
| Second Lever | 900 |
| Second Lever First Segment | 902 |
| Second Lever Second Segment | 904 |
| Second Lever Third Segment | 906 |
| Second Lever Fourth Segment | 908 |
| Second Lever First Arm | 910 |
| Second Lever Second Arm | 912 |
| Second Lever First Side | 926 |
| Second Lever Second Side | 928 |
| Air Flow from First Air Pump Distal Chamber 227 to External Environment | Flow Arrow A |
| Air Flow from First Air Pump Distal Chamber 227 to First Air Pump Proximal Chamber 225 | Flow Arrow B |
| Air Flow from First Air Pump Distal Chamber 239 to First Air Pump Proximal Chamber 237 | Flow Arrow C |
| Air Flow from Second Air Pump Distal Chamber 239 to External Environment | Flow Arrow D |
| Combustion Gas Exhaust Flow from First Combustion Chamber 246 to External Environment | Flow Arrow E |
| Air Flow from First Combustion Case Chamber 274 to First Combustion Chamber 246 | Flow Arrow F |
| Fuel-Air Mixture Flow from Second Air Pump Proximal Chamber 237 to Combustion Case Second Chamber 282 | Flow Arrow G |
| Air Flow from First Air Pump Proximal Chamber 225 to Combustion Case First Chamber 274 | Flow Arrow H |
| Fuel-Air Mixture flow from Second Air Pump Proximal Chamber 237 into Combustion Case Second Chamber 282 | Flow Arrow I |
| Air Flow from External Environment into First Air Pump Distal Chamber 227 | Flow Arrow J |
| Air Flow from External Environment into Second Air Pump Distal Chamber 239 | Flow Arrow K |
| Fuel Flow into Second Air Pump Distal Chamber 239 | Flow Arrow L |
| Low Pressure Fluid Flow through First Port 771 from Hydraulic Chamber 308 to Fifth Port 775 | Flow Arrow M |
| High Pressure Fluid Flow through Second Port 772 from Third Port 773 to Hydraulic Chamber 408 | Flow Arrow N |
| High Pressure Fluid Flow through First Port 771 from Third Port 773 to Hydraulic Chamber 308 | Flow Arrow O |

TABLE 1-continued

| Element | Reference Numeral |
|---|---|
| Low Pressure Fluid Flow through Second Port 772 from Hydraulic Chamber 408 to Forth Port 774 | Flow Arrow P |
| Low Pressure Fluid Flow through First Port 771 from Fifth Port 775 to Hydraulic Chamber 308 | Flow Arrow Q |
| High Pressure Fluid Flow through Second Port 772 from Hydraulic Chamber 408 to Third Port 773 | Flow Arrow R |
| High Pressure Fluid Flow through First Port 771 from Hydraulic Chamber 308 to Third Port 773 | Flow Arrow S |
| Low Pressure Fluid Flow through Second Port 772 from Forth Port 774 to Hydraulic Chamber 408 | Flow Arrow T |

FIG. 1 shows an opposed piston internal combustion hydraulic engine embodying the present invention, generally indicated by the reference numeral 10. The engine 10 includes a frame 100 having a first pivot pin 102 and a second pivot pin 104. A first lever 800 is pivotally attached to the frame 100 by the first pivot pin 102. The second lever 900 is pivotally attached to the frame 100 by the second pivot pin 104. Both the first pivot pin 102 and the second pivot pin 104 lie on and define a pivot pin axis 150. The pivot pin axis 150 divides the engine into an engine first side 151 and an engine second side 153. The engine 10 further includes a first combustion assembly 200, a first hydraulic assembly 300, a second hydraulic assembly 400, and a second combustion assembly 500, each fixed to the frame 100, attached to each lever (800, 900), and in mechanical communication with each other through the levers.

FIG. 1 also shows the engagement of the combustion assemblies and the hydraulic assemblies (200, 300, 400, 500) with the levers (800, 900). The first lever 800 includes a first segment 802, a second segment 804, a third segment 806, and a fourth segment 808. The first lever first and second segments (802, 804) together define a first lever first side 826 shown in FIG. 3, and the third and fourth segments (806, 808) together define a first lever second side 828 shown in FIG. 3, the first lever first side 826 and the first lever second side 828 lying on opposite sides of the pivot pin axis 150. Similarly arranged, the second lever 900 includes a first segment 902, a second segment 904, a third segment 906, and a fourth segment 908. The second lever first and second segments (902, 904) together define a second lever first side 926 (not shown), and the third and fourth segments (906, 908) together define a second lever second side 928 (not shown), the second lever first side and the second lever second side lying on opposite sides of the pivot pin axis 150.

As further shown in FIG. 1, each side of the combustion engine (151, 153) has one combustion assembly and one hydraulic assembly. In one embodiment of the present invention, the arrangement of the assemblies on the engine first side 151 mirrors that of the arrangement of the assemblies on the engine second side 153. In that embodiment, on one side, the first combustion assembly 200 pivotally engages each of the first segment 802 and the first segment 902 of the levers (800, 900) and the first hydraulic assembly 300 pivotally engages each of the second segment 804 and the second segment 904 of the levers. Mirroring this configuration on the remote side, the second hydraulic assembly 400 pivotally engages each of the third segment 806 the third segment 906 of the levers (800, 900), and the second combustion assembly 500 pivotally engages each of the fourth segment 808 and the fourth segment 908 of the levers. Finally, in that embodiment axes extending the length of each assembly (152, 154, 156, 158) are substantially parallel to the pivot pin axis 150, each axis offset a fixed distance to one side or the other side of the pivot pin axis 150. In another embodiment of the present invention the offset of the assemblies with respect to the pivot pin axis 150 is adjustable.

FIG. 2 shows the engine frame, generally referred to by reference numeral 100. In one embodiment of the present invention, the frame 100 includes a first pivot pin bridge 106 having a first pivot pin aperture 110, a plurality of bridge fastener apertures 134, and a second pivot pin aperture 114. The frame 100 also includes a first assembly bridge 101 attached substantially orthogonally to the first pivot pin bridge 106 across its width and having a first combustion assembly aperture 126, a first hydraulic assembly aperture 132, a second hydraulic assembly aperture 122, and a second combustion assembly aperture 118. The frame 100 further includes a second assembly bridge 103 attached substantially orthogonally to the first pivot pin bridge 106 across its width and having a first hydraulic assembly aperture 128, a first hydraulic assembly aperture 130, a second hydraulic assembly aperture 124, and a second combustion assembly aperture 120. Finally, the frame 100 includes a second pivot pin bridge 108 attached orthogonally across its width to each of the first assembly bridge 101 and the second assembly bridge 103 and having a first pivot pin aperture 112 and a second pivot pin aperture 116. The second pivot pin bridge 108 also includes a plurality of bridge fastener apertures 136 each of which is axially aligned with one of the first pivot pin bridge fastener apertures 134 to receive a plurality of fasteners (not shown in FIG. 2, shown in FIG. 1) fixing the pivot pin bridges (106, 108) and the assembly bridges (101, 103) together into a single assembly.

With reference to both FIG. 1 and FIG. 2, the first combustion assembly 200 extends through each of the first combustion assembly apertures (126, 128), the assembly bridges (101, 103) attaching to it and fixing the assembly to the frame 100. Similarly, the first hydraulic assembly 300 extends through each of the first hydraulic assembly apertures (130, 132), the assembly bridges (101, 103) attaching to it and fixing the assembly to the frame 100. Mirroring the attachment of the first hydraulic assembly 300 to the frame 100, the second hydraulic assembly 400 extends through each of the second hydraulic assembly apertures (122, 124), the assembly bridges (101, 103) attaching to it and fixing the assembly to the frame 100. Finally, mirroring the attachment of the first combustion assembly 200 to the frame 100, the second combustion assembly 500 extends through each of the second combustion assembly apertures (118, 120), the assembly bridges (101, 103) also attaching to it and fixing the assembly to the frame 100.

As further shown in FIG. 1 and FIG. 2, the pivot pins (102, 104) pivotally attach the levers (800, 900) to the frame 100. The first pivot pin 102 extends through the first pivot pin bridge, the first pivot pin aperture 110, the first lever 800, and the second pivot pin bridge, the first pivot pin aperture 112 to pivotally attach the first lever 800 to the frame 100. In an analogous arrangement, the second pivot pin 104 extends through the first pivot pin bridge, the second pivot pin aperture 114, the second lever 900, and the second pivot pin bridge, the second pivot pin aperture 116 to pivotally attach the second lever 900 to the frame 100. In one embodiment of the present invention, the pivot pins (102, 104) extend orthogonally with respect to the pivot pin bridges (106, 108) on parallel axes. Each lever (800, 900) may pivot up to about 7.5 degrees in either direction with respect to the pivot pin axis 150, although the extent of pivoting is not critical.

FIG. 3 shows the first lever 800 of one embodiment of the present invention. In that embodiment, the first lever 800 is of a similar construction to the second lever 900, as indicated with general reference numerals "(800, 900)" in FIG. 3. Accordingly, an element occurring in the first lever 800 has a number starting with an "8", while the similar element occurring within the second lever 900 has a similar number but starting with a "9". As shown in FIG. 1, the first lever 800 is analogously positioned with respect to the second lever 900, "analogous positioning" referring here and in subsequent description to positioning of similarly constructed elements on the opposite ends of the engine.

As shown in FIG. 3, the first lever 800 includes a first arm 810, a second arm 812, and a first lever spacer 814, each adapted to attach at their center to the pivot pin 102. The first lever 800 further includes a first lever first arm spacer 816 seated on the first pivot pin 102 adjacent to the first arm 810. The first lever 800 additionally includes a first lever second arm spacer 817 (not shown) also seated on the first pivot pin 102 adjacent to the second arm 812. In operation, the arm spacers (816, 817) cooperate with the pivot pin 102 allowing the lever 800 to pivot in a plane substantially parallel to the plane defined by the first pivot pin bridge 106 and the second pivot pin bridge 108.

As additionally shown in FIG. 3, the first arm 810 has a first connection point 818 on the first segment 802, a second connection point 820 on the second segment 804, a third connection point 822 on the third segment 806, and a fourth connection point 824 on the fourth segment 808. Each connection point comprises (i) a hole in the first arm 810 having a center and receiving therein a bushing, and (ii) a hole in the second arm 812 having its center aligned with the first hole center and also having a bushing. Each bushing allows for the connecting point to rotatably receive a connecting pin (not shown), the pin further being angularly displaceable about its axis with respect to the lever.

FIG. 4 shows the construction of the first hydraulic assembly generally referred to with a reference numeral 300. In one embodiment of the present invention, the second hydraulic assembly 400 is of a similar construction to the first hydraulic assembly 300. Accordingly, an element occurring in the first hydraulic assembly 300 has a number starting with a "3", while the similar element occurring within the second hydraulic assembly 400 has a similar number but starting with a "4". As will be the convention hereafter, parts and movements are described with respect to an assembly's chamber, the chamber being either a combustion chamber or a hydraulic chamber. Elements positioned comparatively closely to the chamber are described as "proximal"; elements positioned comparatively further from the chamber will be described as "distal". Similarly, when the elements change position, "proximal" movement indicates motion toward the assembly's chamber; "distal" movement indicates motion away from the assembly's chamber.

As shown in FIG. 4, the hydraulic assembly 300 includes a hydraulic cylinder 330 having a first end 310 with an aperture 312, a second end 314 with an aperture 316, an inner surface 318, a first hydraulic piston 328, and a second hydraulic piston 340. The first hydraulic piston 328 has a connection point 324, with a connection pin 326 extending therethrough and a face 332. Analogously, the second hydraulic piston 340 also has a connection point 334, with a connection pin 336 extending therethrough and a face 342. Each of the hydraulic pistons (328, 340) passes through the cylinder aperture (312, 316), extends into the first hydraulic cylinder 330 and slideably and sealably engages the first hydraulic cylinder inner surface 318. The inner surface 318 and the piston faces (332, 342) therein define a variable volume hydraulic chamber 308. Finally, the hydraulic chamber 308 additionally includes an inlet 344 in a selective hydraulic communication with either a hydraulic storage chamber or a hydraulic powered apparatus (neither shown).

As shown in FIG. 5, the first hydraulic connecting rod 352 and an attached first hydraulic piston 328 form a first translatable hydraulic member 353. Likewise, the second hydraulic connecting rod (not shown) and an attached second hydraulic piston (also not shown) form a second translatable hydraulic member (also not shown).

Operationally, the hydraulic chamber 308, the hydraulic pistons (328, 340), and the hydraulic connecting rods (352, 354) lie on the first hydraulic assembly axis 154 substantially parallel to the pivot pin axis 150 (FIG. 1). Axial translation along the first hydraulic assembly axis 154 by the translatable hydraulic members (353, 360) causes a volume change in the hydraulic chamber 308. With reference to both FIG. 4 and FIG. 1, each hydraulic piston (328, 340) is attached to a hydraulic connecting rod (352, 354). The hydraulic connecting rod 352 in turn has a connection point 356 having a pin (not shown), the first hydraulic piston 328 thereby being attached to the first lever second segment 804. Analogously, the hydraulic connecting rod 354 in turn defines a connection point 358 having a pin (not shown), the second hydraulic piston 340 thereby being attached to the second lever second section 904. When the hydraulic pistons (328, 340) translate substantially along the first hydraulic assembly axis 154, each hydraulic connecting rod (352, 354) angularly displaces with respect to the first hydraulic assembly axis 154, thereby allowing the connection points (356, 358) and pins (not shown) to each move on an arc intersecting the first hydraulic assembly axis 154, thereby converting the pivoting of the levers (800, 900) to a translatable member (353, 360) translation along the first hydraulic assembly axis 154. Similarly for the second hydraulic assembly (not shown), axial translation along the second hydraulic assembly axis 156 by the similarly constructed second hydraulic assembly translatable hydraulic members (neither shown) causes a volume change in the second hydraulic chamber (also not shown).

In one embodiment of the present invention (not shown) the engine includes a variable volume hydraulic fluid displacement feature. In this embodiment, the engine includes a plurality of controllable actuators that individually attach to each of the hydraulic connecting rods (352, 354, 452, 454) on an axis substantially orthogonal to the pivot pin axis 150. Each actuator in turn changeably drives the angular offset of its hydraulic connecting rod with respect to its hydraulic axis. When the actuator induces comparatively large angular offsets between the hydraulic connecting and its respective hydraulic axis, the volumetric change in the respective hydraulic cylinder during operation is smaller and smaller amounts of pressurized hydraulic fluid are produced. When the actuator induces comparatively small angular offsets between the hydraulic connecting and its respective hydraulic axis, the volumetric change in the respective hydraulic cylinder during operation is larger and greater amounts of pressurized hydraulic fluid are produced. Such actuators may take the form of a motor driven power screw, a hydraulic cylinder servo combination, or any device now known or that becomes known in the art in view of the teachings herein.

FIG. 6 shows the first combustion assembly partially in cross-section with a general reference number 200. In one embodiment of the present invention, the second combustion assembly 500 is of a similar construction to the first combustion assembly 200. Accordingly, a similar element occurring in the first combustion assembly 200 has a number starting with a "2", while the similar element occurring within the second combustion assembly 500 has a similar number but starting with a "5". As will be the convention hereafter, parts and movements are described with respect to an assembly's chamber. Elements positioned comparatively closely to the chamber are described as "proximal"; elements positioned comparatively further from the chamber will be described as "distal". Similarly, where the elements change position, "proximal" movement indicates motion toward the assembly's chamber; "distal" movement indicates motion away from the assembly's chamber.

As shown in FIG. 6, the first combustion assembly 200 includes a combustion case 202 having therein a first combustion cylinder 204 with an inner surface 206, a first end 208 and a second end 212. The assembly further includes a first air pump 216 including a first air pump housing 218 with an inner surface 220, a distal end 222 with an aperture 224, and receiving therein a first air pump piston 226 slideably and sealably engaged with the inner surface 220. The first air pump piston 226 divides the first air pump 216 into a distal chamber 227 and a proximal chamber 225. The assembly analogously includes a second air pump 228 including a second air pump housing **218*a* with an inner surface 220*a*, a distal end 222*a* with an aperture 224*a*, and receiving therein a second air pump piston 238 slideably and sealably engaged with the inner surface 220*a*. The second air pump piston 238 divides the second air pump 228 into a distal chamber 239 and a proximal chamber 237**.

As further shown in FIG. 6, a first combustion piston 240 having a face 242 slideably and sealably extends through the first assembly bridge first combustion assembly aperture 126 (FIG. 14A) to slideably and sealably engage the first combustion cylinder inner surface 206. Analogously, a second combustion piston 245 having a face 244 slideably and sealably extends through the second assembly bridge first combustion assembly aperture 128 (FIG. 14B) to also slideably and sealably engage the first combustion cylinder inner surface 206. Collectively, the first combustion cylinder inner surface 206 and piston faces (242, 244) define a variable volume first combustion chamber 246, the volume being varied by movement of the first combustion piston face 242 and the second combustion piston face 244. As also shown in FIG. 6, a first connecting rod 248 slideably and sealably extends through the first air pump distal aperture 224. The first air pump piston 226 and the first combustion piston 240 are attached to the first connecting rod 248. Analogously, a second connecting rod 250 slideably and sealably extends through the second air pump distal aperture **224*a*. The second air pump piston 238 and the second combustion piston 245 are attached to the second connecting rod 250. The first combustion assembly axis 152 extends through the first combustion assembly 200, defining a common alignment of each of the combustion pistons (240, 242), the air pump pistons (226, 238), and the combustion assembly connecting rods (248, 250**).

As shown in FIG. 7, the first connecting rod 248, the attached first air pump piston 226, and the attached combustion piston 240 form a first translatable combustion member 249. Similarly, the second connecting rod 250 (not shown), the attached second air pump piston 238 (also not shown), and the attached second combustion piston 245 (also not shown) form a second translatable combustion member 253 (also not shown).

In operation and with reference to FIG. 6, the first combustion assembly translatable combustion members (249, 253) translate axially along the first combustion assembly axis 152, reciprocateably moving proximally and distally. When the first translatable combustion member 249 translates proximally, toward the first combustion chamber 246, the member 249 expands the volume of the first air pump distal chamber 227 and contracts the volume of the first air pump proximal chamber 225 and the first combustion chamber 246. Oppositely, when the member 249 translates distally, away from the first combustion chamber 246, the member 249 contracts the volume of the first air pump distal chamber 227 and expands the volume of the first air pump proximal chamber 225 and the first combustion chamber 246. Analogously, when the second translatable combustion member 253 translates proximally, toward the first combustion chamber 246, the member 253 expands the volume of the second air pump distal chamber 239 and contracts the volume of the second air pump proximal chamber 237 and the first combustion chamber 246. Oppositely, when the member 253 translates distally, away from the first combustion chamber 246, it contracts the volume of the second air pump distal chamber 239 and expands the volumes of the second air pump proximal chamber 237 and the first combustion chamber 246.

FIG. 8A, FIG. 8B, and FIG. 8C show the reciprocating relationship among the translatable members of the combustion assemblies (200, 500) and the hydraulic assemblies (300, 400) through mechanical communication with each other through the pivotable levers (800, 900).

As shown in this series of figures, the first combustion assembly axis 152 extends though the center of the first combustion assembly 200 substantially parallel to the pivot pin axis 150. The first hydraulic assembly axis 154, also substantially parallel to the pivot pin axis 150, extends through the center of the first hydraulic assembly 300. The second hydraulic assembly axis 156, also substantially parallel to the pivot pin axis 150, extends through the center of the second hydraulic assembly 400. The second combustion assembly axis 158, also substantially parallel to the pivot pin axis 150, extends through the center of the second combustion assembly 500.

FIG. 8A shows the first combustion assembly 200 in the start-of-stroke position. In this position, the reciprocating elements are proximally positioned with respect to the first combustion chamber 246, and the levers (800, 900) are angled inwardly toward the first combustion chamber 246. The first side lever segments (802, 804, 902, 904) are proximally positioned with respect to the first combustion assembly 200. The connecting rods (248, 250) extend for most of their respective lengths into the first combustion assembly 200, and the combustion pistons (240, 245) are proximal to one another. The volume of the first combustion chamber 246 is substantially minimized.

If an expanding gas occupies the first combustion chamber 246, the gas applies force to the faces of the combustion pistons (240, 245). That force drives each combustion piston (240, 245) distally in turn pushing the connecting rods (248, 250) distally. The connecting rods in turn apply force to the levers (800, 900) at the first segments (802, 902). In response, the first and second segments (802, 902, 804, 904) of the levers pivot distally, away from their respective combustion and hydraulic chambers (246, 308), as shown in their respective sequential, positional changes in FIG. 8A, FIG. 8B, and FIG. 8C. At the same time, the third and fourth segments (806, 808, 906, 908) pivot proximally, toward the second hydraulic chamber 408 and the second combustion chamber 546.

As further shown in the sequence of figures, the pivoting levers expand the volume of the first hydraulic chamber 308. As the second segment of each lever (804, 904) pivots away from the first hydraulic chamber 308, they draw the hydraulic connecting rods (352, 354) out of the hydraulic assembly. The hydraulic connecting rods (352, 354) in turn pull the hydraulic pistons (328, 340) distally, and as shown in their respective sequential, positional changes in FIG. 8A, FIG. 8B, and FIG. 8C, expand the volume of the hydraulic chamber 308. The first hydraulic chamber 308 in turn back-fills with the low-pressure hydraulic fluid returning through a port in the chamber (not shown).

The pivoting movement of the levers causes an opposite positional change on the remote second hydraulic assembly 400 and the remote second combustion assembly 500 on the second side of the pivot pin axis 150.

As shown in FIG. 8A, FIG. 8B, and FIG. 8C, the pivoting lever arms drive the lever third segments (806, 906) proximally, toward the second hydraulic chamber 408. The third segments (806, 906) press the hydraulic connecting rods (452, 454) toward one another, pushing them proximally toward the second hydraulic chamber 408. The hydraulic connecting rods (452, 454) in turn drive the hydraulic pistons (428, 440) toward one another, their respective faces squeezing the fluid within the chamber 408. As the piston faces squeeze the fluid within the chamber 408, the hydraulic fluid port (not shown) draws off pressurized hydraulic fluid for storage in a hydraulic pressure vessel or for a delivery to a pressurized fluid powered device (also not shown).

The pivoting of the levers drives the lever fourth segments (808, 908) proximally, toward the second combustion chamber 546. The pivoting fourth segments in turn press the connecting rods (548, 550) toward one another, proximally toward the second combustion chamber 546. The connecting rods (548, 550) in turn drive the air pump pistons proximally along the second combustion assembly axis 158, expanding the volume of the distal air pump chambers (527, 539) and reducing the volume of the proximal air pump chambers (525, 537) as shown in FIG. 6. The connecting rods (548, 550) in turn drive the combustion pistons (540, 545) proximally along the second combustion assembly axis 158, compressing the fuel air mixture therein.

In reciprocating, continuous operation, the first sides (826, 926) and second sides (828, 928) of the levers (800, 900), as shown on FIG. 3, alternately and oppositely pivot toward and away from the chambers (246, 308, 408, 546) of their respective assemblies. The alternating, oppositely directed pivoting of the levers (800, 900), toward and away from the assembly chambers (246, 308, 408, 546) in turn alternately and reciprocateably translates the members (249, 253, 353, 360) proximally and distally with respect to their assembly chambers (246, 308, 408, 546). Alternating, reciprocating proximal and distal translation of the members (249, 253, 353, 360) in turn alternately and reciprocateably translates each pair of the piston faces (242, 244; 332, 342; 432, 442; 542, 544) within the assemblies proximally and distally, toward and away from one another. Translation of the piston faces (242, 244; 332, 342; 432, 442; 542, 544) changes the volume of each respective chamber (246, 308, 408, 546), alternately contracting the chamber volume and expanding the chamber volume.

In one embodiment of the present invention, two synchronizers 160*a* and 160*b* mechanically and synchronically connect the lever 800 to the lever 900, as shown in FIG. 8D.

The first synchronizer 160*a* includes a fulcrum 162*a* having a first end 164*a* and second end 166*a*; a synchronizer lever 168*a* having a first end 170*a*, a mid-section 172*a*, and second end 174*a*; a synchronizer first arm link 176*a* having a first end 178*a* and second end 180*a*; and synchronizer second arm link 182*a* having a first end 184*a*, a mid-section 186*a*, and a second end 188*a*. The fulcrum 162*a* is fixed on its first end 164*a* to the first assembly bridge 101 and on its second end

166*a* to the synchronizer lever 168*a*. In turn, the synchronizer lever 168*a* is fixed on its first end 170*a* to the fulcrum 162*a* on the fulcrum's second end 166*a*. In addition, the synchronizer lever 168*a* is further fixed to the first lever first arm 810 through the first arm link 176*a*, attaching to the first synchronizer lever mid-section 172*a*. Finally, the synchronizer lever 168*a* is fixed to the first arm 910 of the second lever 900 through the synchronizer second arm link 182*a* at its second end 174*a*. The synchronizer first arm link 176*a* attaches at its first end 178*a* to the synchronizer lever mid-section 172*a*, and further attaches at its second end 180*a* to the first lever first arm 810 at the first lever second segment 804. In a somewhat similar manner, the synchronizer second arm link 182*a* attaches at its first end 184*a* to the synchronizer lever second end 174*a*, and further attaches at its second end 188*a* to the second lever first arm 910 at the second lever third section 906. Each assembly bridge (101, 103) additionally includes an aperture (190, 192) through which the synchronizer second arm link 182*a* mid-section passes, thereby allowing the levers (800, 900) to mechanically communicate with one another.

The second synchronizer 160*b* includes a fulcrum 162*b* having a first end 164*b* and second end 166*b*; a synchronizer lever 168*b* having a first end 170*b*, a mid-section 172*b*, and second end 174*b*; a synchronizer first arm link 176*b* having a first end 178*b* and second end 180*b*; and synchronizer second arm link 182*b* having a first end 184*b*, a mid-section 186*b*, and a second end 188*b*. The fulcrum 162*b* is fixed on its first end 164*b* to the first assembly bridge 101 and on its second end 166*b* to the synchronizer lever 168*b*. In turn, the synchronizer lever 168*b* is fixed on its first end 170*b* to the fulcrum 162*b* on the fulcrum's second end 166*b*. In addition, the synchronizer lever 168*b* is further fixed to the first lever first arm 810 of the first lever 800 through the first arm link 176*b*, attaching to the second synchronizer lever mid-section 172*b*. Finally, the synchronizer lever 168*b* is fixed to the second lever first arm 910 of the second lever 900 through the synchronizer second arm link 182*b* at its second end 174*b*. The synchronizer first arm link 176*b* attaches at its first end 178*b* to the synchronizer lever mid-section 172*b*, and further attaches at its second end 180*b* to the first lever first arm 810 at the first lever third section 806. In a somewhat similar manner, the synchronizer second arm link 182*b* attaches at its first end 184*b* to the synchronizer lever second end 174*b*, and further attaches at its second end 188*b* to the second lever first arm 910 at the second lever second section 904. Each assembly bridge (101, 103) additionally includes an aperture (194, 196) through which the synchronizer second arm link 182*b* mid-section passes, thereby allowing the levers (800, 900) to mechanically communicate with one another.

The synchronizers 160*a* and 160*b* of this embodiment of the present invention maintain a positional relationship between the levers (800, 900) during operation. They also effect direct mechanical communication between the first lever 800 and the second lever 900. Direct mechanical communication between the levers (800, 900) in turn establishes a positional relationship between the respective angular displacements of the levers (800, 900) about their respective pivot pins (102, 104) such that the angular displacement of one lever about its pivot pin is substantially equivalent in magnitude and opposite in direction to the angular displacement of the other lever about its pivot pin. The synchronization means further maintains the positional relationship during engine operation, an angular displacement of the first lever 800 about its pivot pin being accompanied by an angular displacement of the second lever 900 about its pivot pin of a substantially equal and opposite magnitude. Finally, the positional relationship between the levers (800, 900) maintains positional relations between each pair of the translatable members (249, 253, 353, 360) such that the translation of any paired piston face (242, 244, 332, 342, 432, 442, 542, 544) is of a substantially equal and opposite magnitude with respect to the other (FIG. 8A-C).

In operation, the two synchronizers 160*a* and 160*b* of this embodiment of the present invention control the position of the first lever 800 with respect to the second lever 900, and through the above-discussed mechanical communication maintain the relative positioning of each piston to the opposed piston in each piston pair during reciprocation along each assembly's respective axis. Consequently, in a first pivoting motion, the first lever first side 826 moves toward the second lever first side 926 synchronously, contracting the volume of the first combustion chamber 246 and the first hydraulic chamber 308, while the remote, first lever second side 828 moves away from the remote second lever second side 928, expanding the volume of the second hydraulic chamber 408 and the second combustion chamber 546. In a sequential, subsequent pivoting motion, the first sides of the levers (826, 926) move away from each other synchronously, expanding the volume of the first combustion chamber 246 and the first hydraulic chamber 308, while the remote, second sides of the levers (828, 928) move toward one another, contracting the volume of the second hydraulic chamber 408 and the second combustion chamber 546. The synchronized motion of the levers (800, 900) provides for a selective fluid communication between the hydraulic chambers (308, 408) and either the hydraulic storage chamber or a hydraulic powered apparatus (neither shown).

In one embodiment of the present invention, the selective fluid communication is effected synchronously by the selective hydraulic communication assembly shown in FIG. 9A. The selective hydraulic fluid communication assembly includes an A-side actuator assembly 701, a B-side actuator assembly 702, a spool 750, a spool extension 760, a valve assembly 770, an A-pulse solenoid 780, and a B-pulse solenoid 790, all of which cooperate through the action of the levers 800, 900 (FIG. 1) during the operation to alternatively and selectively place one hydraulic assembly (not shown) in a fluid communication with the hydraulic storage vessel (not shown) and the other hydraulic assembly (not shown) with the low-pressure hydraulic fluid return lines (not shown).

As further shown in FIGS. 9B and 9C, the spool has a first end 752, a mid-section 753, and a second end 754. The first end 752 of the spool is configured to fixedly receive a cap 755 (FIG. 9A). The second end 754 of the spool is fixedly attached to the spool extension 760, the spool extension 760 having a spool control pin 761 and a start to run lever 762. The spool control pin 761 and the start to run lever 762 are fixedly attached in a substantially perpendicular manner to the spool extension 760, and are disposed on substantially opposite sides of the spool extension 760.

FIG. 10 shows the details of the valve assembly 770 included in this embodiment of the selective hydraulic fluid communication assembly. The valve assembly includes a valve block 776 having five ports, a first port 771, a second port 772, a third port 773, a forth port 774, and a fifth port 775. The first port 771 is fluidly communicative with the first hydraulic chamber 308. The second port 772 is fluidly communicative with the second hydraulic chamber 408. Depending on the spool position and the engine mode, the first and the second ports may function as the high pressure or the low pressure input or output ports. The third port 773 is fluidly communicative with the high-pressure vessel (not shown). Depending on the engine mode, the third port may function as either an input or an output port. The fourth port 774 is fluidly communicative with the first low-pressure return line (not shown). The fifth port 775 is fluidly communicative with the second low-pressure return line (not shown). Depending on the spool position, the fourth and the fifth ports may function as either input or output ports.

FIG. 11A-D show the positions of the spool 750 and the directions of the hydraulic fluid flow in the 'start' and 'run' engine modes. The direction of the hydraulic fluid flow is displayed by the arrows M-T. As shown in FIG. 11A and FIG. 11C, in the first spool position (spool down), the spool 750 is arranged in such a way as to place the second port 772 of the valve in a fluid communication with the third port 773 of the valve, thereby connecting the high-pressure vessel (not shown) with the second hydraulic chamber 408. Simultaneously, the mid-section 753 of the spool is arranged in such a way as to place the first port 771 of the valve in a fluid communication with the fifth port 775 of the valve, thereby connecting the first hydraulic chamber 308 with the high-pressure vessel (not shown). In the first position of the spool, the first end 752 of the spool is not participating in a fluid communication.

As shown in FIG. 11B and FIG. 11D, in the second spool position (spool up), the spool 750 is arranged in such a way as to place the first port 771 of the valve in a fluid communication with the third port 773 of the valve, thereby connecting the high-pressure vessel (not shown) with the first hydraulic chamber 308. Simultaneously, the mid-section 753 of the spool is arranged in such a way as to place the second port 772 of the valve in a fluid communication with the fourth port 774 of the valve, thereby connecting the second hydraulic chamber 408 with the first low-pressure return line (not shown). In the second position of the spool, the second end 754 of the spool is not participating in a fluid communication.

In the 'start' mode of the engine, the first spool position (FIG. 11A) allows the high pressure hydraulic liquid to flow, as indicated by arrow N, from the high pressure vessel (not shown) through the third and the second ports (773, 772) into the second hydraulic chamber 408, causing the distal movement of the A-side hydraulic pistons (428, 440) and the A-side combustion pistons (540, 545), as well as the proximal movement of the B-side hydraulic pistons (328, 340) and the B-side combustion pistons (240, 245). In this operation, the low pressure hydraulic liquid from the first hydraulic chamber 308 flows, as indicated by arrow M, through the first and the fifth ports (771, 775) into the second low pressure return line (not shown). Subsequently, the second spool position (FIG. 11B) allows the high pressure hydraulic liquid to flow, as indicated by arrow O, from the high pressure vessel (not shown) through the third and the first ports (773, 771) into the first hydraulic chamber 308, causing the distal movement of the B-side hydraulic pistons (328, 340) and the B-side combustion pistons (240, 245), as well as the proximal movement of the A-side hydraulic pistons (428, 440) and the A-side combustion pistons (540, 545). In this operation, the low pressure hydraulic liquid from the second hydraulic chamber 408 flows, as indicated by arrow P, through the second and the fourth ports (772, 774) into the first low pressure return line (not shown). In the 'start' mode, the high pressure hydraulic liquid from the high pressure hydraulic vessel is used to start the engine, much as an electric starter starts a conventional automobile engine. A fuel-air mixture is compressed between the combustion pistons and ignited to start the engine. Once the engine is started, it is shifted to the 'run' mode.

In the 'run' mode of the engine, the B-side firing (FIG. 11C) causes a distal movement of the B-side combustion pistons (240, 245) and the B-side hydraulic pistons (328, 340), as well as a proximal movement of the A-side combustion pistons (540, 545) and the A-side hydraulic pistons (428, 440). In this operation, the spool 750 occupies the first spool position, which allows the high pressure hydraulic liquid to flow, as indicated by arrow R, from the second hydraulic chamber 408 through the second and third ports (772, 773) into the high pressure vessel (not shown). In turn, the low pressure hydraulic liquid flows, as indicated by arrow Q, from the second low pressure return line (not shown) through the fifth and the first ports (775, 771) into the first hydraulic chamber 308. Subsequently, the A-side firing (FIG. 11D) causes distal movement of the A-side combustion pistons (540, 545) and the A-side hydraulic pistons (428, 440), as well as a proximal movement of the B-side combustion pistons (240, 245) and the B-side hydraulic pistons (328, 340). In this operation, the spool 750 occupies the second spool position, which allows the high pressure hydraulic liquid to flow, as indicated by arrow S, from the first hydraulic chamber 308 through the first and the third ports (771, 773) into the high pressure vessel (not shown). In turn, the low pressure hydraulic liquid flows, as indicated by arrow T, from the first low pressure return line (not shown) through the fourth and the second ports (774, 772) into the second hydraulic chamber 408. In the 'run' mode, the high pressure hydraulic fluid is either stored in the high pressure hydraulic vessel or used to power a desired apparatus.

In this embodiment of the present invention, the selective hydraulic fluid communication assembly further includes a start solenoid comprising an A-pulse solenoid 780 and a B-pulse solenoid 790 which are used only in the 'start' mode of the engine (FIG. 9A). Both A-pulse and B-pulse solenoids (780, 790) are fixed to the first pivot pin bridge 106 (FIG. 2). Each solenoid has a pusher rod (781, 791), a plate (782, 792), and a spring (not shown). In the 'run' mode, the spring of the A-pulse solenoid 780 keeps the A-pulse solenoid plate 782 below the lowest point occupied by the spool cap 755, while the spring of the B-pulse solenoid 790 keeps the B-pulse solenoid plate 792 above the highest point occupied by the spool cap 755. At the beginning of the 'start' mode, either the A-pulse solenoid 780 or the B-pulse solenoid 790 is energized in order to properly align the engine for starting.

When the B-pulse solenoid 790 is energized, the solenoid plate 792 impacts the spool cap 755, thus pushing the spool downward into the first spool position. As described above, with a reference to FIG. 11A, in the first spool position, the high pressure fluid flows, as indicated by arrow N, from the high-pressure vessel (not shown) through the third and second ports (773, 772) into the second hydraulic chamber 408, forcing the distal movement of the A-side hydraulic pistons (428, 440) and the A-side combustion pistons (540, 545). Subsequently, when the spool 750 moves to the second spool position, the spool cap 755 impacts the solenoid plate 792, pushing the solenoid pusher rod 791 back into the 'run' mode position wherein the B-pulse solenoid 790 rests until the end of the engine operation.

Alternatively, when the A-pulse solenoid 780 is energized, the solenoid plate 782 impacts the spool cap 755, thus pulling the spool upward into the second spool position. As described above, with a reference to FIG. 11B, in the second spool position, the high pressure fluid flows, as indicated by arrow O, from the high-pressure vessel (not shown) through the third and first ports (773, 771) into the first hydraulic chamber 308, forcing the distal movement of the B-side hydraulic pistons (328, 340) and the B-side combustion pistons (240, 245). When the spool 750 subsequently moves to the first position, the spool cap 755 impacts the solenoid plate 782, pushing the pusher rod 781 of the A-pulse solenoid back into the 'run' mode position where the solenoid rests until the end of the engine operation. Neither the A-pulse solenoid 780 nor the B-pulse solenoid 790 functions in the 'run' mode of the engine.

It should be understood by a person having ordinary skill in the art that the initial positions of the pusher rods of the A-pulse and B-pulse solenoids (781, 791) may be reversed, i.e. the pusher rod of the A-pulse solenoid 781 may be disposed in the 'run' mode position, while the pusher rod of the B-pulse solenoid 791 may be disposed in the 'start' mode position. In this alternative arrangement of the solenoids, the subsequent movements of the other parts of the selective hydraulic communication assembly will be reversed.

Both the angular and the latitudinal positions of the spool 750 are controlled by a pair of hydraulic valve mechanical actuators 701 and 702 shown in FIG. 9A and shown in detail in FIG. 12A and FIG. 12B. The A-side actuator 701 (FIG. 12A) includes a control rod 703 having a distal end 711 and a proximal end 713; a first impact arm 705 having a first end 715, a mid-section 717 and a second end 719; and a second impact arm 707 having a first end 721 and a second end 723. The control rod 703 is fixed on its distal end 711 to the second lever second arm 912 (not shown) at the second lever third section 906 (FIG. 1) and is pivotally attached on its proximal end 713 to the first impact arm 705, at the first end 715 of the first impact arm 705. The first impact arm 705 fixedly receives a control pivot pin 725 in its second end 719. The first end 721 of the second impact arm 707 is pivotally attached to the mid-section 717 of the first impact arm 705 and fixedly receives a control pivot pin 727 in its second end 723. The control pivot pins 725 and 727 are each disposed at such an angle as to effectively strike the spool control pin 761, as shown on FIG. 9A. The second end 719 of the first impact arm 705 is fixed to the second end 723 of the second impact arm 707 by a connecting bolt 709, thus precluding any movement of the first impact arm 705 and the second impact arm 707 relative to each other during operation but allowing adjustment of their relative positions.

The B-side actuator 702 (FIG. 12B) is similar but opposite in configuration to the A-side actuator and includes a control rod 704 having a distal end 712 and a proximal end 714; a first impact arm 706 having a first end 716, a mid-section 718 and a second end 720; and a second impact arm 708 having a first end 722 and a second end 724. The control rod 704 is fixed on its distal end 712 to the second lever second arm 912 at the second lever second section 904 (FIG. 1). The first end 716 of the first impact arm 706 is pivotally attached to the proximal end 714 of the control rod 704. The impact arm 706 fixedly receives a control pivot pin 726 in its second end 720. The first end 722 of the second impact arm 708 is pivotally attached to the mid-section 718 of the first impact arm 706. The second impact arm 708 fixedly receives a control pivot pin 728 in its second end 724. The control pivot pins 726 and 728 are each disposed at such an angle as to effectively strike the spool control pin 761, as shown in FIG. 9A. The second end 720 of the first impact arm 706 is fixed to the second end 724 of the second impact arm 708 by a connecting bolt 710, thus precluding any movement of the first impact arm 706 and the second impact arm 708 relative to each other during operation of the engine but allowing adjustment of their relative positions.

As shown on FIGS. 12A and 12B each actuator assembly further includes a mode switching solenoid. Namely, the A-side actuator assembly 701 has a start solenoid 730 and the B-side actuator assembly 702 has a run solenoid 740. Both the start and run solenoids (730, 740) are fixed to the first pivot pin bridge 106 (FIG. 2). Each solenoid has a pusher rod (731, 741) and a spring (not shown). In each solenoid (730, 740), the spring serves to keep the respective pusher rod 731 and 741 in a disengaged position. In the 'start' mode of the engine (FIG. 13A-D), the start solenoid 730 is activated to push the start solenoid pusher rod 731 out into the engaged position, while the spring of the run solenoid 740 keeps the run solenoid pusher rod 741 in the disengaged position. Under this arrangement, the start to run lever 762 of the spool extension 760 is disposed towards the run solenoid 740 (FIGS. 13B and 13D). As a result, the spool control pin 761 is turned towards the A-side actuator 701 and is engaged with the control pivot pins 725 and 727 of the first and second impact arms (705, 707). When the second sides of the first and second levers (828, 928) (FIG. 1) move distally (FIGS. 13A and 13B), the control rod 703 also moves distally (not shown), while the first and second impact arms (705, 707) move proximally (not shown). Upon this movement, the control pivot pin 727 impacts the spool control pin 761, pushing the spool 750 from the spool second position to the spool first position. Subsequently, when the second sides of the first and second levers (828, 928) (FIG. 1) move proximately (FIGS. 13C and 13D), the control rod 703 also moves proximately, while the first and second impact arms (705, 707) move distally. In the process of the movement, the control pivot pin 725 impacts the spool control pin 761, pushing the spool 750 from the spool first position to the spool second position. These movements alternate during the 'start' mode until the engine has started.

In the 'run' mode of the engine (FIG. 13E-H), the run solenoid 740 is activated to push the run solenoid pusher rod 741 out in the engaged position, while the spring of the start solenoid keeps the start solenoid pusher rod 731 in the disengaged position. Under this arrangement, the start to run lever 762 of the spool extension 760 is disposed towards the start solenoid 740 (FIGS. 13F and 13H). As a result, the spool control pin 761 is turned towards the B-side actuator 702 and is engaged with the control pivot pins 726 and 728 of the first and second impact arms (706, 708). When the first sides of the first and second levers (826, 926) (FIG. 1) move distally (FIGS. 13E and 13F), the control rod 704 moves distally, and the first and second impact arms (706, 708) move proximally. In the process of the movement, the control pivot pin 728 impacts the spool control pin 761, pushing the spool 750 from the spool second position to the spool first position. Subsequently, when the first sides of the first and second levers (826, 926) (FIG. 1) move proximately (FIGS. 13G and 13H), the control rod 704 moves proximately, and the first and second impact arms (706, 708) move distally. In the process of the movement, the control pivot pin 726 impacts the spool control pin 761, pushing the spool 750 from the spool first position to the spool second position. These movements alternate during the 'run' mode of the engine.

Turning to the combustion assemblies, FIG. 14A, FIG. 14B, and FIG. 14C show additional structure within the first combustion assembly 200 and sequentially describe the operation of the first air pump 216, the first combustion case 202, and the second air pump 228.

FIG. 14A shows details of the first air pump 216 of the first combustion assembly 200. The first air pump 216 includes a first air pump housing 218 having a first air pump outer surface 219 and an inner surface 220, a distal end 222 having a first air pump distal aperture 224, a first air pump inlet 243, and a proximal end 223. The first air pump proximal end 223 sealably attaches to the distal surface of the first assembly bridge 101, encompassing the first assembly bridge first combustion assembly aperture 126 and the first air pump outlet 214, being axially aligned with respect to the first combustion assembly axis 152. The first air pump inlet 243 and the first air pump distal aperture 224 extend from the first air pump outer surface 219 of the first air pump 216 to its inner surface 220, extending through the first air pump housing 218. The first air pump 216 further includes a first air pump piston 226 slideably and sealably engaging the first air pump housing inner surface 220 and having a distal surface 254, a proximal surface 256, and an air channel 258 extending through the piston from the first air pump piston distal surface 254 to its proximal surface 256.

FIG. 14A also shows the variable volume first air pump distal chamber 227 and the variable volume first air pump proximal chamber 225. The first air pump distal chamber 227 is defined by the first air pump housing inner surface 220 and the distal surface 254 of the air pump piston 226, and is pneumatically communicative with the environment external to the combustion case through the first air pump inlet 243. The first air pump proximal chamber 225 is defined by the first air pump housing inner surface 220 and the first air pump piston proximal surface 256. The first air pump proximal chamber 225 is selectively pneumatically communicative with the first air pump distal chamber 227 through the first air pump piston air channel 258, and selectively pneumatically communicative with the first combustion case 202 (FIG. 14C) through the first air pump outlet 214. Both the distal chamber 227 and the proximal chamber 225 are variable volume chambers where the axial translation of the air pump piston 226 causes a change in volume.

FIG. 14A further shows a first air pump reed valve 260 comprising a flexible member having a contact surface 262 and a fixation means 264. In one embodiment of the present invention the fixation means 264 is a screw, and fixedly engages the first air pump reed valve 260 to the proximal surface 256 of the air pump piston 226. The reed valve 260 includes a flexible portion, and in a normally closed first position (shown) sealably contacts the first air pump piston proximal surface 256, substantially occluding the at least one air channel 258 and thereby preventing pneumatic communication between the first air pump distal chamber 227 and the first air pump proximal chamber 225. In a second position (not shown) a portion of the reed valve 260 flexes away from the air channel 258 responsively when the air pressure within the first air pump distal chamber 227 exceeds that within the first air pump proximal chamber 225 by a pre-defined threshold value. When the reed valve 260 is in its first position, the first air pump distal chamber 227 and the first air pump proximal chamber 225 are not pneumatically communicative. If a pressure differential exists between the first air pump distal chamber 227 and the first air pump proximal chamber 225 sufficient to flex a portion of the reed valve 260 away from the air channel 258, the chambers become pneumatically communicative and air can flow from the first air pump distal chamber 227 to the first air pump proximal chamber 225. In one embodiment of the present invention, the reed valve 260 is comprised of spring steel and has an annular shape.

FIG. 14B shows the details of the second air pump 228 of the first combustion assembly 200. Where appropriate, the elements within the second air pump 228 similar in construction to the elements in the first air pump 216 (FIG. 14A) and are identified by a common number followed by an "a" to indicate the similarity. The second air pump 228 includes a second air pump housing 218*a* having a second air pump outer surface 219*a* and an inner surface 220*a*, and a second air pump distal end 222*a* having a distal aperture 224*a*. The second air pump proximal end 223*a* sealably attaches to the proximal surface of the second assembly bridge 103, encompassing the second assembly bridge first combustion assembly aperture 128 and the second air pump outlet 214*a*, further being axially aligned with respect to the first combustion assembly axis 152. Each of the second air pump inlet 243*a*, and the second air pump distal aperture 224*a* extends from the second air pump surface 219*a* of the second air pump 228 to its inner surface 220*a*, through the second air pump housing 218*a*. The second air pump 228 further includes a second air pump piston 238 slideably and sealably engaging the second air pump housing inner surface 220*a* and having a distal surface 254*a*, a proximal surface 256*a*, and at least one air channel 258*a* extending from the second air pump piston distal surface 254*a* to its proximal surface 256*a* through the second air pump piston 238.

FIG. 14B also shows the variable volume second air pump distal chamber 239 and the variable volume second air pump proximal chamber 237. The second air pump distal chamber 239 is defined by the second air pump housing inner surface 220*a* and the second air pump piston distal surface 254*a*, and is pneumatically communicative with the environment external to the combustion case through the second air pump inlet 243*a*. The second air pump proximal chamber 237 is defined by the second air pump housing inner surface 220*a* and the second air pump piston proximal surface 256*a*. The second air pump proximal chamber 237 is selectively pneumatically communicative with the second air pump distal chamber 239 through the second air pump piston air channel 258*a*, and selectively pneumatically communicative with the first combustion case 202 (FIG. 14C) through the second air pump outlet 214*a*. Each of the second air pump distal chamber 239 and the second air pump proximal chamber 237 is a variable volume chamber where the axial translation of the second air pump piston 238 causes a change of volume.

FIG. 14B further shows a second air pump reed valve 260*a* having a flexible portion and having a contact surface 262*a* and a fixation means 264*a*. In one embodiment of the present invention, the fixation means 264*a* is a screw which fixedly engages the second air pump reed valve 260*a* to the proximal surface 256*a* of the second air pump piston 238. The reed valve 260*a* has a flexible portion which, in a normally closed, first position (shown), sealably engages the second air pump piston proximal surface 256*a*, substantially occluding the second air pump piston air channel 258*a*, thereby preventing pneumatic communication between the second air pump distal chamber 239 and the second air pump proximal chamber 237. In a second position (not shown) a portion of the reed valve 260*a* flexes away from the second air pump piston air channel 258*a* responsively when the air pressure within the second air pump distal chamber 239 exceeds that within the second air pump proximal chamber 237 by a pre-defined value. When the second air pump reed valve 260*a* is in its first position, the second air pump distal chamber 239 and the second air pump proximal chamber 237 are pneumatically isolated from each other. If the pressure differential between the second air pump distal chamber 239 and the second air pump proximal chamber 237 exceeds the threshold amount sufficient to flex a portion of the reed valve 260*a* away from the second air pump piston distal surface 254*a*, the channel 258*a* opens, and the second air pump distal chamber 239 becomes pneumatically communicative with the second air pump proximal chamber 237, and air can flow from the second air pump distal chamber 239 to the second air pump proximal chamber 237. In one embodiment of the present invention, the reed valve 260*a* is also comprised of spring steel and has an annular shape.

FIG. 14C shows further details of the first combustion assembly combustion case 202. The case includes a case housing 266 having an inner surface 270, an external surface 268, a first end 272, a mid-section 284, a second end 278, a divider 273 having a proximal surface 275 and a distal surface 279, the case housing 266 wholly containing within it a first combustion cylinder 204. The combustion case first end 272 attaches to the proximal surface of the first assembly bridge 101, being axially aligned along the first combustion assembly axis 152, encompassing each of the first assembly bridge first combustion assembly aperture 126 and the first air pump outlet 214. The first air pump outlet 214 thereby defines a channel from the interior of the first air pump proximal chamber 225 (FIG. 14A) to the interior of the first combustion case 202.

Analogous in arrangement, the combustion case second end 278 is attached to the proximal surface of the second assembly bridge 103, also being axially aligned along the first combustion assembly axis 152, encompassing each of the second assembly bridge first combustion assembly aperture 128, and the second air pump outlet 214*a*. The second air pump outlet 214*a* thereby defines a channel from the interior of the second air pump proximal chamber 237 (FIG. 14B) to the interior of the first combustion case 202.

As also shown in FIG. 14C the first combustion cylinder 204 further includes an outer surface 290, an inner surface 291, a first end 292 and a second end 296. The first combustion cylinder 204 has an inner diameter substantially the same as the diameter of each of the first assembly bridge first combustion assembly aperture 126 and the second assembly bridge first combustion assembly aperture 128, is attached at the first end 292 to the proximal surface of the first assembly bridge 101 and is attached at the second end 296 to the proximal surface of the second assembly bridge 103, and fully encompasses each of the first combustion assembly apertures 126 and 128. The first assembly bridge first combustion assembly aperture 126 and the first combustion cylinder 204 thus share a substantially common diameter and are adapted to further slidedly and sealably receive the first combustion piston 240. In analogous arrangement, the second assembly bridge first combustion assembly aperture 128 and the first combustion cylinder 204 also share a substantially common diameter and are adapted to slideably and sealably receive the second combustion piston 245. In one embodiment, a portion of each of the proximal surfaces of the first assembly bridges (101, 103) further defines a portion of the inner surface of the first combustion case 202.

As further shown in FIG. 14C, the first combustion cylinder 204 contains within it the variable volume first combustion chamber 246, which is defined by the combustion cylinder inner surface 291, the first combustion piston face 242, and the second combustion piston face 244. Since each of the combustion piston faces (242, 244) has a movable surface, if the combustion piston (240, 245) moves, the volume of the first combustion chamber 246 changes. If the combustion piston (240, 245) translates proximally, toward the first combustion chamber 246, the volume of the first combustion chamber 246 decreases. If the volume of the first combustion chamber 246 decreases, the gases therein compress; alternatively, if the first combustion chamber 246 is pneumatically communicative with the outside environment, the gases therein may be forced out of the chamber. Oppositely, if the combustion piston (240, 245) moves distally, away from the first combustion chamber 246, the volume of the first combustion chamber 246 expands. In one embodiment of the present invention, the combustion pistons (240, 245) move substantially synchronously with respect to one another and with respect to the center of the first combustion chamber 246.

As further shown in FIG. 14C, the arrangement of the first combustion case 202 allows for selective pneumatic communication between the chambers defined therein. The first combustion case 202 includes a case first fixed volume chamber 274 defined by the case housing inner surface 270, the case divider proximal surface 275, and the combustion cylinder outer surface 290. The first combustion case 202 further includes a second fixed volume chamber 282 defined by the case housing inner surface 270, the divider distal surface 279, and the combustion cylinder outer surface 290. The first combustion cylinder 204 includes exhaust ports 267, a group of proximal inlets 269, and a group of distal inlets 271, each individual port and inlet extending from the combustion cylinder inner surface 291 through the first combustion cylinder 204 to the combustion cylinder outer surface 290. When the exhaust port(s) 267 is (are) open, the first combustion chamber 246 is in pneumatic communication with the outside environment through the exhaust manifold 283. The exhaust ports 267 are occluded by the first combustion piston 240 if its face 242 is proximally positioned with respect to the exhaust ports 267, and the ports are open if the piston face 242 is distally positioned with respect to the exhaust ports 267. When the inlets 271 are open, the chamber 282 is in pneumatic communication with the first combustion chamber 246, and when the inlets 269 are open, the chamber 274 is in pneumatic communication with the first combustion chamber 246. The second combustion piston 245 occludes the inlets 271 when its face 244 extends proximally into the first combustion chamber 246 with respect to the inlets 271, and further occludes the inlets 269 when its face 244 extends proximally into the chamber 246 with respect to the inlets 269. Whenever a port or inlet is open, pneumatic communication occurs from the chamber having the higher pressure to the chamber, or external environment, having the lower pressure.

In one embodiment of the present invention, the distal movement of the proximally positioned combustion pistons sequentially causes pneumatic communication between the first combustion chamber 246 and the outside environment, the case first chamber 274, and the case second chamber 282. When the pistons are proximally positioned so as to minimize the volume of the first combustion chamber 246, the pistons occlude the exhaust ports 267, the inlets 269, and the inlets 271. As the pistons translate distally along the first combustion assembly axis 152, the movement of the first combustion piston face 242 beyond the exhaust port 267 establishes pneumatic communication between the first combustion chamber 246 and the outside environment through exhaust port 267. Further distal, synchronous translation of the combustion pistons (240, 245) moves the second combustion piston face 244 beyond the inlets 269, thereby establishing pneumatic communication between the chamber 274 and the first combustion chamber 246 through the inlets 269. Still further distal, synchronous translation of the combustion pistons (240, 245) moves the second combustion piston face 244 beyond the inlets 271, thereby establishing pneumatic communication between the chamber 282 and the first combustion chamber 246 through the inlets 271.

FIG. 15A through FIG. 15G show sequentially the relationship of the piston positioning and the air flow between the chambers of the first combustion assembly 200.

FIG. 15A shows the first combustion assembly 200 immediately prior to firing, when the combustion pistons are positioned at their proximal extreme, compressing a fuel air mixture within the chamber 246. The reed valves (260, 285, 287, 260*a*) are in their first, closed position, preventing air movement through the air channels (258, 276, 214*a*, 258*a*). Pressurized air occupies the chamber 274, the chamber 274 being pneumatically isolated with respect to the first combustion chamber 246 and the first air pump proximal chamber 225 by the occluded proximal inlets 269 and the closed reed valve 285. A pressurized fuel air mixture occupies the chamber 282, the chamber 282 being pneumatically isolated with respect to the first combustion chamber 246 and the second air pump proximal chamber 237 by the occluded distal inlets 271 and the closed reed valve 287. Ambient pressure air occupies each of the chambers 227 and 239, each chamber being pneumatically communicative with the environment external to the combustion assembly through the always open air pump inlets (243, 243*a*).

FIG. 15B shows a distal positional change to the reciprocating components from ignition of the fuel-air mixture in the first combustion chamber 246. Ignition of the fuel-air mixture creates an expanding gas within the first combustion chamber 246. The expanding combustion gases apply force to each of the piston faces (242, 244), axially translating the combustion pistons (240, 245) distally along the first combustion assembly axis 152, away from the chamber center and displacing each as shown in comparison of FIG. 15B and FIG. 15A. The expanding combustion gases also axially translate each of the air pump pistons (226, 238) attached to the connecting rods (248, 250), as shown in FIG. 14A and FIG. 14B, distally along the first combustion assembly axis 152 with respect to their positions shown in FIG. 15A, thus reducing the volume of each distal chamber (227, 239) and increasing the volume of each proximal chamber (225, 237). Reducing the volume of the distal chambers (227, 239) increases the pressure therein, forcing some air out of the air pump inlets (243, 243*a*) as indicated by the flow arrow A and the flow arrow D. Axial, distal displacement along the first combustion assembly axis 152 of the air pump pistons (226, 238) also increases the volume of the proximal chambers (225, 237), reducing the pressure therein. When the difference between the increasing pressure within the distal chambers (227, 239) and the decreasing pressure within the proximal chambers (225, 237) reaches the threshold differential pressure of the reed valves (260, 260*a*) between the respective proximal and distal chamber (227 and 225; 239 and 237), the reed valves (260, 260*a*), as shown in FIG. 15A, flex away from the respective air pump pistons (226, 238). The reed valve flexure (shown by the reed valves 260, 260*a* in FIG. 15B) away from their respective air pump pistons (226, 238) opens the air piston air channels (258, 258*a*), allowing air to move from chamber 227 to chamber 225 as indicated by the flow arrow B and from the chamber 239 to the chamber 237 as indicated by the flow arrow C.

FIG. 15C shows a progressive distal positional change to the reciprocating components resulting from the above-discussed detonation of the compressed fuel-air mixture present in the first combustion chamber 246 at the start of the stroke. In this and other embodiments of the present invention, the engine will use compression ignition. Expanding combustion gases in the first combustion chamber 246 further axially translate the first combustion piston 240 distally along the first combustion assembly axis 152 such that the piston face 242 is distally beyond the exhaust port 267. As the piston face 242 crosses the exhaust port 267 plane, the exhaust port 267 opens, establishing pneumatic communication between the first combustion chamber 246 and the external environment, and a first portion of the combustion gases exits the combustion chamber to the environment outside the first combustion assembly 200 as indicated by the flow arrow E. The expanding combustion gases also further axially translate the second combustion piston 245 distally along the first combustion assembly axis 152 such that the piston face 244 moves distally beyond the proximal inlets 269. As the piston face 244 crosses the proximal inlet plane, the inlets 269 open, establishing pneumatic communication between the case first chamber 274 and the first combustion chamber 246. Pneumatic communication between the chambers establishes a flow of air as indicated by the flow arrow F, to force a second portion of the combustion gases from the first combustion chamber 246 to the external environment. In one embodiment of the present invention the flow E starts before the flow F. In other embodiments of the invention the flows may start concurrently.

FIG. 15D shows still further distal positional change to the reciprocating components resulting from the above-discussed detonation of the compressed fuel-air mixture present in the first combustion chamber 246 at the start of the stroke. The expanding gases within the first combustion chamber 246 continue to further axially translate the second combustion piston 245 distally along the first combustion assembly axis 152 until the piston face 244 is distally beyond the distal inlets 271. As the piston face 244 crosses the distal inlet plane, the inlets 271 open, establishing pneumatic communication between the case second chamber 282 and the first combustion chamber 246. Pneumatic communication between the chambers establishes a fuel-air mixture flow indicated by the flow arrow G, the flow in turn forcing a third portion of the combustion gases from the first combustion chamber 246 to the external environment. The proximal inlets 269 (FIG. 15C) are cooperatively sized with respect to the exhaust ports 267 (FIG. 15C) such that the fuel-air mixture wavefront is substantially prevented from exiting the first combustion chamber 246 through the exhaust ports 267 (FIG. 15C) to the environment external to the combustion chamber.

FIG. 15E shows the combustion assembly at the end of the expansion stroke, immediately preceding proximal movement of the combustion pistons (240, 245), as shown in FIG. 15C. In this position, the first portion, second portion, and third portion of the combustion gases discussed above have left the first combustion chamber 246. The fuel-air mixture occupies the chamber 246. Ambient pressure air occupies the chamber 225, and an ambient pressure fuel-air mixture occupies the chamber 237. The chambers 246, 274, and 282 remain pneumatically communicative through the inlets, and the first combustion chamber 246 remains pneumatically communicative with the external environment through the exhaust ports 267 (FIG. 15C). The reed valve 260 is in its first, closed position, stopping pneumatic communication between the first air pump distal chamber 227 and the first air pump proximal chamber 225. Similarly, the reed valve 260*a* is in its first, closed position, stopping pneumatic communication between the second air pump distal chamber 239 and the second air pump proximal chamber 237. In one embodiment of the present invention, a valve present on the exhaust manifold halts the exhaust flow E prior to the stopping of Flow F, keeping the first combustion chamber 246 pressurized with respect to the external environment.

FIG. 15F shows the beginning of the compression stroke as the combustion pistons (240, 245) are pushed into the first combustion chamber 246 by the above-discussed pivoting levers. The levers (not shown) have ceased pivoting distally with respect to the first combustion assembly 200, away from the first combustion chamber 246, and have started to pivot proximally, toward the first combustion chamber 246. This pivoting forces the air pistons (226, 238) and the combustion pistons (240, 245) to translate proximally axially along the first combustion assembly axis 152, thereby beginning to compress the fuel-air mixture within the first combustion chamber 246. In the first air pump, the axial translation of the air pump piston 226 proximally along the first combustion assembly axis 152 increases the volume of the distal chamber 227, drawing ambient air into the first air pump distal chamber 227 through the first air pump inlet 243, establishing a flow of air indicated by the flow arrow J. The axial translation of the air piston 226 proximally along the first combustion assembly axis 152 also decreases the volume of the proximal chamber 225, increasing the air pressure within the chamber. Progressive increasing pressure within the chamber 225 reaches a threshold differential value with respect to the pressure within the combustion case first chamber 274 in turn causing the reed valve 285 to flex away from the first air pump outlet 214 (flexure of the reed valve 285 shown in FIG. 15F), allowing pneumatic communication between the first air pump proximal chamber 225 and the case first chamber 274, establishing a flow of air indicated by the flow arrow H.

Analogously, in the second air pump 228 (FIG. 14B), axial translation of the air piston 238 proximally along the first combustion assembly axis 152 increases the volume of the distal chamber 239, drawing ambient air into the second air pump distal chamber 239 through the second air pump inlet 243*a*, establishing a flow of air indicated by the flow arrow K. The second air pump distal chamber 239 also includes a fuel inlet 235, selectively fluidly communicative with a fuel source (not shown), which adds and mixes fuel to the expanding volume of the distal chamber 239, as indicated by the flow arrow L. The axial translation of the air piston 238 proximally along the first combustion assembly axis 152 also decreases the volume of the proximal chamber 237, increasing the pressure of the fuel-air mixture within the proximal chamber 237. Progressive increasing pressure within the chamber 237 reaches a threshold differential value with respect to the pressure within the combustion case second chamber 282, in turn causing the reed valve 287 to flex away from the second air pump outlet 214*a* (flexure of the reed valve 287 shown in FIG. 15F), allowing pneumatic communication between the second air pump proximal chamber 237 and the case second chamber 282, The flow of a fuel-air mixture between the second air pump distal chamber 239 and the second air pump proximal chamber 237 is indicated by the flow arrow I.

As shown collectively in FIG. 15A through FIG. 15G, continuing the combustion piston (240, 245) proximal, axial translation along the first combustion assembly axis 152 sequentially occludes the distal inlets 271, the proximal inlets 269, and the exhaust ports 267, leaving the combustion chamber pneumatically isolated as shown in FIG. 15G. In the one embodiment of the present invention, the air flow E, the air flow F, and the air flow G initiate sequentially and terminate sequentially through the axial spacing of the planes defined by the exhaust ports 267, the proximal inlets 269, and the distal inlets 271 along the first combustion assembly axis 152. In another embodiment of the invention, two or more of the air flow E, the air flow F, and the air flow G may initiate and terminate at the same time. In still another embodiment of the invention, the initiation and termination of air flow may be controlled through mechanical or electronic valves incorporated in one or more of the exhaust ports 267, the proximal inlets 269, and the distal inlets 271 occluding them independently of the combustion piston (240, 245) positions along the first combustion assembly axis 152.

By using the apparatus and methods of the present invention described above, a hydraulic engine can be constructed and operated achieving several advantages over those presently known in the art. As can be appreciated by those of skill in the art, multiple engines of the invention can be modularly integrated and operated as a single unit to provide high power output and allowing for economical, low power output operation. Finally, it is possible to have moveable masses on the lever arms to adjust their inertia and thus the compression ratio to adapt the engine to varying fuel types, including gasoline, gasoline/alcohol mixtures, alcohol, diesel, or the like.

It is noted that the terms "first," "second," "top", "bottom", "up", "down", and the like, herein do not denote any amount, order, or importance, but rather are used to distinguish one element from another, and the terms "a" and "an" herein do not denote a limitation of quantity, but rather denote the presence of at least one of the referenced item. As used herein the term "about", when used in conjunction with a number in a numerical range, is defined being as within one standard deviation of the number "about" modifies. The suffix "(5)" as used herein is intended to include both the singular and the plural of the term that it modifies, thereby including one or more of that term (e.g., the bearings(s) includes one or more bearings).

As will be recognized by those skilled in the pertinent art based upon the teachings herein, numerous changes and modifications may be made to the above-described and other embodiments of the invention without departing from its scope as defined in the appended claims. Accordingly, this detailed description of the embodiments is to be taken in an illustrative as opposed to a limiting sense.

What is claimed is:

1. An opposed piston engine for providing a supply of pressurized hydraulic fluid comprising:

a frame having a first pivot pin and a second pivot pin, the pivot pins defining a pivot pin axis;

a first lever pivotally mounted on said first pivot pin and having a first segment and a second segment on one side of the pivot pin, and a third segment and a fourth segment on the other side of the pivot pin;

a second lever pivotally mounted on said second pivot pin and having a first segment and a second segment on one side of the pivot pin, and a third segment and a fourth segment on the other side of the pivot pin, whereby said first and second levers are movable in a substantially common plane;

a first combustion assembly fixed with respect to said frame and including (i) a combustion cylinder having an inner surface, (ii) a first piston having a face and being slideably and sealably engaged with said combustion cylinder inner surface and in mechanical communication with the first segment of the first lever, and (iii) a second piston having a face and being slideably and sealably engaged with said combustion cylinder inner surface and in mechanical communication with the first segment of the second lever, whereby said first piston and said second piston are substantially opposed and said face of the first piston, said face of the second piston, and said inner surface of the combustion cylinder substantially define a first combustion chamber;

a first hydraulic assembly fixed with respect to said frame including (i) a hydraulic cylinder having an inner surface, (ii) a first piston having a face and being slideably and sealably engaged with said hydraulic cylinder inner surface and in mechanical communication with the second segment of the first lever, and (iii) a second piston having a face and being slideably and sealably engaged with said hydraulic cylinder inner surface and in mechanical communication with the second segment of the second lever whereby said first piston and said second piston are substantially opposed and said face of the first piston, said face of the second piston, and said inner surface of the hydraulic cylinder substantially define a first hydraulic chamber;

a second hydraulic assembly fixed with respect to said frame including (i) a hydraulic cylinder having an inner surface, (ii) a first piston having a face and being slideably and sealably engaged with said hydraulic cylinder inner surface and in mechanical communication with the third segment of the first lever, and (iii) a second piston having a face and being slideably and sealably engaged with said hydraulic cylinder inner surface and in mechanical communication with the third segment of the second lever whereby said first piston and said second piston are substantially opposed and said face of the first piston, said face of the second piston, and said inner surface of the hydraulic cylinder substantially define a second hydraulic chamber;

a second combustion assembly fixed with respect to said frame including (i) a combustion cylinder having an inner surface, (ii) a first piston having a face and being slideably and sealably engaged with said combustion cylinder inner surface and in mechanical communication with the fourth segment of the first lever, and (iii) a second piston having a face and being slideably and sealably engaged with said combustion cylinder inner surface and in mechanical communication with the fourth segment of the second lever, whereby said first piston and said second piston are substantially opposed and said face of the first piston, said face of the second piston, and said inner surface of the combustion cylinder substantially define a second combustion chamber;

whereby an expansion of one of the combustion chambers causes a compression in the remote hydraulic chamber, thereby producing pressurized hydraulic fluid.

2. The engine of claim 1, wherein at least one of the first and second combustion assemblies further comprises:

a case including (i) an outer surface; (ii) an inner surface; (iii) a first end having a first aperture and first inlet each defining a passage through said case from said inner surface to said outer surface; (iv) a second end having a second aperture and a second inlet each defining a passage through said case from said inner surface to said outer surface; and (iv) a mid-section having a third aperture extending through said case from said inner surface to said outer surface;

the combustion cylinder being wholly contained within said case and having (i) an outer surface; (ii) a first end having a first aperture substantially aligned with said combustion case first aperture; (iii) a second end having a second aperture substantially aligned with said combustion case second aperture; (iv) a first port defining a passage through said combustion cylinder from said inner surface to said outer surface; (v) a first inlet defining a passage through said combustion cylinder from said inner surface to said outer surface; and (vi) a second inlet defining a passage through said case from said inner surface to said outer surface;

a divider sealably extending from said case inner surface to said combustion cylinder outer surface having a first surface and a second surface wherein (i) said divider first surface, said case inner surface, and said combustion cylinder outer surface define a case first chamber including said combustion cylinder first inlet whereby the case first chamber is pneumatically communicative with the combustion chamber; and (ii) said divider second surface, said case inner surface, and said combustion cylinder outer surface define a case second chamber including said combustion cylinder second inlet and said case second inlet whereby the case second chamber is selectively pneumatically communicative with the combustion chamber and the environment outside of the combustion case;

an exhaust manifold sealingly fixed to said combustion cylinder exterior surface, enveloping said combustion cylinder first port, passing through one of the case chambers, and extending through said case third aperture whereby the combustion chamber is selectively pneumatically communicative with the environment outside of the combustion case;

a means for selectively allowing pneumatic communication between the outside environment and said case first chamber through said first end inlet;

a means for selectively allowing pneumatic communication between the outside environment and said case second chamber through said second end inlet;

a means for selectively supplying pressurized air to said case first chamber through said case first inlet;

a means for selectively supplying a pressurized fuel-air mixture to said case second chamber through said case second inlet;

wherein the first piston slideably and sealably passes through said combustion cylinder first aperture and said first case aperture to effect mechanical communication with the first lever, and the second piston slideably and sealably passes through said combustion cylinder second aperture and said second case aperture to effect mechanical communication with the second lever.

3. The engine of claim 2 which further comprises two synchronizers, whereby the positional relationship of the first lever and the second lever is maintained during operation of the engine and wherein each synchronizer comprises:

a fulcrum having a first end and a second end;

a synchronizer lever having a first end, a mid-section, and second end;

a synchronizer first arm link having a first end and second end; and a synchronizer second arm link having a first end, a mid-section, and second end wherein:

the fulcrum is fixed on its first end to the frame on one side of the pivot pin axis and on its second end to the first end of the synchronizer lever;

the synchronizer lever midsection is fixed to one engine lever on the same side of the pivot pin axis as the fulcrum attachment through the first lever link; and the second end of the synchronizer lever arm is fixed on the opposite side of the pivot pin axis from the fulcrum attachment to the other engine lever through the synchronizer second lever link.

4. The engine of claim 2 wherein the means for allowing selective pneumatic communication between the outside environment and said case first chamber through said first end inlet comprises:

a flexible member having (i) a surface; (ii) a first position; and (iii) a second position; wherein at least a portion of said flexible member is fixed to the case inner surface; in said first position said surface substantially sealably engages the case inner surface about the periphery of said inlet thus occluding the inlet; and in said second position at least a portion of said surface disengages from the inner surface allowing pneumatic communication through the inlet;

wherein movement of said flexible member between said first position and said second position is effected when the pressure within the inlet exceeds that within the case first chamber by a defined amount.

5. The engine of claim 2 wherein the means for selectively supplying pressurized air to case first chamber through case first inlet is an air pump further comprising:

a housing having (i) an outer surface and an inner surface; (ii) a first end having a first aperture substantially aligned with the combustion case first aperture and a first inlet, each defining a passage through said housing extending from said inner surface to said outer surface; (iii) a second end having a second aperture substantially aligned with the combustion case first aperture and an outlet substantially aligned with the case first inlet, each defining a passage through said housing extending from said inner surface to said outer surface wherein the second end is fixedly engaged to the first end of the case;

an air piston having (i) a distal surface; (ii) a proximal surface; and (iii) at least one channel extending from said distal surface to said proximal surface, said air piston slideably and sealably engaging said housing inner surface and being in mechanical communication with the first combustion piston;

a variable volume distal chamber defined by (i) said inner surface of the housing, and (ii) said distal surface of the air piston, said chamber being pneumatically communicative with the outside environment;

a variable volume proximal chamber defined by (i) said inner surface of the housing, and (ii) said proximal surface of the air piston, said chamber being selectively pneumatically communicative with the case first chamber through said outlet;

a means for selectively pneumatically communicating between said distal chamber and the proximal chamber through the air piston channel;

wherein reciprocal movement of the air piston forces air from the distal chamber to the proximal chamber within said housing and thereafter to the case first chamber.

6. The engine of claim 5 wherein the means for selectively pneumatically communicating between said distal chamber and proximal chamber through the air piston channel further comprises:

a flexible member having (i) a surface; (ii) a first position; and (iii) a second position wherein at least a portion of said flexible member is fixed to the air piston proximal surface whereby in said first position said surface substantially sealably engages the proximal surface air piston about the periphery of the air piston channel thus occluding the air channel and in said second position at least a portion of said surface disengages from the air piston proximal surface thus allowing pneumatic communication between the distal chamber and proximal chamber; and whereby movement of said flexible member between said first position and said second position is effected where the pressure within the distal chamber exceeds that within the proximal chamber by a defined amount.

7. The engine of claim 2 that further comprises a selective hydraulic communication assembly which comprises:

an hydraulic vessel and two low pressure hydraulic lines;

an actuator assembly;

a spool having a first end, a mid-section, and a second end;

a spool extension having a first end and a second end and having a spool control pin attached to said second end and being fixed by its first end to the spool second end;

a valve assembly comprising a manifold having an interior and five ports;

wherein:

the spool is contained within the manifold and regulates fluid communication between the ports of the manifold;

the actuator assembly is in mechanical communication with the spool control pin to position the spool in one of two positions within the manifold;

the first port is in fluid communication with the first hydraulic chamber, the second port is in fluid communication with the second hydraulic chamber, the third port is in fluid communication with the high pressure hydraulic fluid vessel, the fourth port is in fluid communication with the first low pressure hydraulic line, and the fifth port is in communication with the second low pressure hydraulic line;

whereby:

when the spool is in one position the first hydraulic chamber is in communication with the hydraulic vessel and the second hydraulic chamber is in communication with the first low pressure hydraulic line; and when the spool is in the other position the second hydraulic chamber is in communication with the hydraulic vessel and the first hydraulic chamber is in communication with the second low pressure hydraulic line.

8. The engine of claim 2 wherein the means for selectively supplying pressurized air to case second chamber through case first inlet is an air pump comprising:

a housing having (i) an outer surface and an inner surface; (ii) a first end having a first aperture substantially aligned with the combustion case first aperture and a first inlet, each defining a passage through said housing extending from said inner surface to said outer surface; (iii) a second end having a second aperture substantially aligned with the combustion case first aperture and an outlet substantially aligned with the case first inlet, each defining a passage through said housing extending from said inner surface to said outer surface wherein the second end is fixedly engaged to first end of the case;

an air piston having (i) a distal surface; (ii) a proximal surface; and (iii) at least one channel extending from said distal surface to said proximal surface, said air piston slideably and sealably engaging said housing inner surface and being in mechanical communication with the second combustion piston;

a variable volume distal chamber defined by (i) said inner surface of the housing, and (ii) said distal surface of the air piston, said chamber being pneumatically communicative with the outside environment;

a variable volume proximal chamber defined by (i) said inner surface of the housing, and (ii) said proximal surface of the air piston, said chamber being selectively pneumatically communicative with the case second chamber through said outlet;

a means for selectively pneumatically communicating between said distal chamber and the proximal chamber through the air piston channel; and a means for introducing fuel into the second air pump distal chamber;

wherein reciprocal movement of the air piston forces air from the distal chamber to the proximal chamber within said housing and thereafter to the case second chamber.

9. The engine of claim 8 that further comprises a selective hydraulic communication assembly which comprises:

an hydraulic vessel and two low pressure hydraulic lines;

an actuator assembly;

a spool having a first end, a mid-section, and a second end;

a spool extension having a first end and a second end and having a spool control pin attached to said second end and being fixed by its first end to the spool second end;

a valve assembly comprising a manifold having an interior and five ports;

wherein:

the spool is contained within the manifold and regulates fluid communication between the ports of the manifold;

the actuator assembly is in mechanical communication with the spool control pin to position the spool in one of two positions within the manifold;

the first port is in fluid communication with the first hydraulic chamber, the second port is in fluid communication with the second hydraulic chamber, the third port is in fluid communication with the high pressure hydraulic fluid vessel, the fourth port is in fluid communication with the first low pressure hydraulic line, and the fifth port is in communication with the second low pressure hydraulic line;

whereby:

when the spool is in one position the first hydraulic chamber is in communication with the hydraulic vessel and the second hydraulic chamber is in communication with the first low pressure hydraulic line; and when the spool is in the other position the second hydraulic chamber is in communication with the hydraulic vessel and the first hydraulic chamber is in communication with the second low pressure hydraulic line.

10. The engine of claim 9 wherein the means for introducing fuel into the second air pump distal chamber comprises:

an inlet defining a channel extending from the outer surface of the housing to the inner surface of the second air pump distal chamber, said inlet being fluidly communicative with a fuel source; and a means for metering fuel through said inlet.

11. The engine of claim 10 wherein the means for selectively allowing pneumatic communication between said distal chamber and proximal chamber through the air piston channel further comprises:

a flexible member having (i) a surface; (ii) a first position; and (iii) a second position; wherein at least a portion of said flexible member is fixed to the air piston proximal surface whereby in said first position said surface substantially sealably engages the proximal surface air piston about the periphery of the air piston channel thus occluding the air channel and in said second position at least a portion of said surface disengages from the air piston proximal surface thus allowing pneumatic communication between the distal chamber and proximal chamber; and wherein movement of said flexible member between said first position and said second position is effected where the pressure within the distal chamber exceeds that within the proximal chamber.

12. The engine of claim 11 that further comprises a selective hydraulic communication assembly which comprises:

a high pressure hydraulic fluid vessel and two low pressure hydraulic lines;

an actuator assembly;

a spool having a first end, a mid-section, and a second end;

a spool extension having a first end and a second end and having a spool control pin attached to said second end and being fixed by its first end to the spool second end;

a valve assembly comprising a manifold having an interior and five ports;

wherein:

the spool is contained within the manifold and regulates fluid communication between the ports of the manifold;

the actuator assembly is in mechanical communication with the spool control pin to position the spool in one of two positions within the manifold;

the first port is in fluid communication with the first hydraulic chamber, the second port is in fluid communication with the second hydraulic chamber, the third port is in fluid communication with the high pressure hydraulic fluid vessel, the fourth port is in fluid communication with the first low pressure hydraulic line, and the fifth port is in communication with the second low pressure hydraulic line;

whereby:

when the spool is in one position the first hydraulic chamber is in communication with the high pressure hydraulic fluid vessel and the second hydraulic chamber is in communication with the first low pressure hydraulic line; and when the spool is in the other position the second hydraulic chamber is in communication with the high pressure hydraulic fluid vessel and the first hydraulic chamber is in communication with the second low pressure hydraulic line.

13. The engine of claim 1 further comprising:

an hydraulic vessel in selective fluid communication with the first and second hydraulic chambers;

two axes, one passing through the center line of the hydraulic piston of each hydraulic assembly;

each hydraulic assembly further including (i) an outer surface; (ii) a first end having a first aperture defining a passage through the cylinder from the inner surface to said outer surface; (iii) a second end having a second aperture defining a passage through the cylinder from the inner surface to said outer surface; and (iv) a port extending through the cylinder from the inner surface to said outer surface through which the hydraulic chamber is in selective hydraulic communication with said hydraulic vessel;

each hydraulic assembly mechanically communicating with the first lever through a first connecting rod substantially coaxial with the relevant axis and having (i) a distal end pivotally connected to the second section of the first lever, (ii) a midsection at least a portion of which slideably and sealably engages said cylinder first aperture, and (iii) a proximal end fixed to the hydraulic assembly first piston;

each hydraulic assembly mechanically communicating with the second lever through a second connecting rod substantially coaxial with the relevant axis and having (i) a distal end pivotally connected to the second section of the second lever, (ii) a midsection at least a portion of which slideably and sealably engages said cylinder second aperture, and (iii) a proximal end fixed to the hydraulic assembly second piston;

whereby movement of each pair of hydraulic pistons toward one another alternately reduces the volume of the relevant hydraulic chamber thereby forcing hydraulic fluid through the port therein and into the hydraulic vessel.

14. The engine of claim 1 which further comprises two synchronizers, whereby the positional relationship of the first lever and the second lever is maintained during operation of the engine.

15. The engine of claim 14 wherein each synchronizer comprises:

a fulcrum having a first end and a second end;

a synchronizer lever having a first end, a mid-section, and second end;

a synchronizer first arm link having a first end and second end; and a synchronizer second arm link having a first end, a mid-section, and second end wherein:

the fulcrum is fixed on its first end to the frame on one side of the pivot pin axis and on its second end to the first end of the synchronizer lever;

the synchronizer lever midsection is fixed to one engine lever on the same side of the pivot pin axis as the fulcrum attachment through the first lever link; and the second end of the synchronizer lever arm is fixed on the opposite side of the pivot pin axis from the fulcrum attachment to the other engine lever through the synchronizer second lever link.

16. A method for providing a supply of pressurized hydraulic fluid with an opposed piston engine comprising:

providing an engine including (i) a frame having a first pivot pin and second pivot pin, said pivot pins defining an axis, (ii) a first lever pivotally mounted on said first pivot pin and a second lever pivotally mounted on said second pivot pin, (iii) a first and a second combustion assembly fixed with respect to said frame, each said combustion assembly having a combustion cylinder with an inner surface, a first piston having a face and in mechanical communication with said first lever, a second piston having a face and in mechanical communication with said second lever, and a combustion chamber defined by said cylinder inner surface and said piston faces, (iv) a first and a second hydraulic assembly fixed with respect to said frame, each said hydraulic assembly having a hydraulic cylinder with an inner surface, a first piston having a face and in mechanical communication with said first lever, a second piston having a face and in mechanical communication with said second lever, and a hydraulic chamber defined by said hydraulic cylinder inner surface and said piston faces wherein the first combustion assembly and the first hydraulic assembly are on one side of the axis and the second combustion assembly and hydraulic assembly are on the other side of the axis;

substantially minimizing the first combustion chamber and the first hydraulic chamber;

charging the volume of said second hydraulic chamber with hydraulic fluid;

causing the volume of said first combustion chamber to expand, whereby the volume of the first hydraulic chamber is expanded, the volume of the second hydraulic chamber is reduced, and the volume of the second combustion chamber is reduced;

thereby pressurizing the hydraulic fluid in the second hydraulic chamber and making pressurized hydraulic fluid available as a pressurized hydraulic fluid supply.

17. The method of claim 16 wherein the step of causing the first combustion chamber to expand further comprises:

introducing a fuel-air mixture into the combustion chamber;

driving the first piston and second piston toward one another thereby compressing the fuel-air mixture therein; and detonating the fuel air mixture, creating an expanding gas and driving the opposed pistons away from one another.

18. The method of claim 17 which further comprises:

charging the first case chamber with air pressurized with respect to the ambient atmosphere;

charging the second case chamber with a fuel-air mixture pressurized with respect to the ambient atmosphere, said steps occurring as the first piston and second piston are being driven toward one another;

placing the combustion chamber in pneumatic communication with the ambient atmosphere, thereby allowing a first portion of the gas therein to exhaust to the environment outside the combustion assembly;

placing the combustion chamber in pneumatic communication with the first chamber, thereby displacing a second portion of the gas therein to the outside environment with said compressed air therein; and placing the combustion chamber in pneumatic communication with the second chamber, thereby displacing a third portion of the gas therein to the outside environment with said compressed fuel-air mixture therein, said steps occurring subsequently to detonating of the fuel-air mixture.

19. A method for providing a supply of pressurized hydraulic fluid with an opposed piston engine comprising:

providing an engine including (i) a frame having two pivot pins defining an axis and first and second levers attached to said frame by said pivot pins, (ii) a first and second combustion assembly fixed with respect to said frame and on opposite sides of the pivot pin axis, each said combustion assembly having a) a combustion cylinder with an inner surface, b) a first and second combustion piston each having a face and slidedly and sealably engaging said cylinder inner surface, c) a combustion chamber within said cylinder defined by the cylinder inner surface and said piston faces, d) a first connecting rod connecting the first piston to the first lever arm, and e) a second connecting rod connecting the second piston to the second lever, (iii) a first and second hydraulic assembly fixed with respect to said frame and on opposite sides of the pivot pin axis, each said hydraulic assembly having a) a hydraulic cylinder with an inner surface, b) a first and second hydraulic piston each having a face and each slidedly and sealably engaging said cylinder inner surface, c) a hydraulic chamber within said cylinder defined by the cylinder inner surface and said piston faces, d) a first connecting rod connecting the first piston to the first lever, and e) a second connecting rod connecting the second piston to the second lever;

introducing a fuel-air mixture into the combustion chamber of one of the combustion assemblies;

introducing a hydraulic fluid into the hydraulic chamber of the hydraulic assembly on the opposite side of the pivot pin axis from the combustion chamber into which the fuel-air mixture has been introduced;

detonating the fuel-air mixture, driving apart the pistons defining the combustion chamber into which the fuel-air mixture had been introduced therein thereby pivoting the first and second levers about the pivot pins and driving together the pistons defining the hydraulic chamber into which hydraulic fluid has been introduced and pressurizing the fluid within the hydraulic chamber; and providing at least a portion of the pressurized hydraulic fluid within the hydraulic chamber.

20. The method of claim 19 wherein the engine further comprises a selective hydraulic communication assembly which comprises:

an hydraulic vessel and two low pressure hydraulic lines;

an actuator assembly;

a spool having a first end, a mid-section, and a second end;

a spool extension having a first end and a second end and having a spool control pin attached to said second end and being fixed by its first end to the spool second end;

a valve assembly comprising a manifold having an interior and five ports;

wherein:

the spool is contained within the manifold and regulates fluid communication between the ports of the manifold;

the actuator assembly is in mechanical communication with the spool control pin to position the spool in one of two positions within the manifold;

the first port is in fluid communication with the first hydraulic chamber, the second port is in fluid communication with the second hydraulic chamber, the third port is in fluid communication with the high pressure hydraulic fluid vessel, the fourth port is in fluid communication with the first low pressure hydraulic line, and the fifth port is in communication with the second low pressure hydraulic line;

whereby:

when the spool is in one position the first hydraulic chamber is in communication with the hydraulic vessel and the second hydraulic chamber is in communication with the first low pressure hydraulic line; and when the spool is in the other position the second hydraulic chamber is in communication with the hydraulic vessel and the first hydraulic chamber is in communication with the second low pressure hydraulic line.

* * * * *